US011423762B1

(12) United States Patent
Hruska et al.

(10) Patent No.: US 11,423,762 B1
(45) **Date of Patent: *Aug. 23, 2022**

(54) PROVIDING DEVICE POWER-LEVEL NOTIFICATIONS

(71) Applicant: Amazon Technologies, Inc., Seattle, WA (US)

(72) Inventors: Ryan David Hruska, North Royalton, OH (US); Elliott Lemberger, Santa Monica, CA (US); John Modestine, Los Angeles, CA (US); Sang Min Park, Los Angeles, CA (US); Michael V. Recker, Gaithersburg, MD (US)

(73) Assignee: Amazon Technologies, Inc., Seattle, WA (US)

( * ) Notice: Subject to any disclaimer, the term of this patent is extended or adjusted under 35 U.S.C. 154(b) by 175 days.

This patent is subject to a terminal disclaimer.

(21) Appl. No.: 16/788,712

(22) Filed: Feb. 12, 2020

Related U.S. Application Data

(63) Continuation of application No. 16/208,188, filed on Dec. 3, 2018, now Pat. No. 10,665,082.

(60) Provisional application No. 62/610,636, filed on Dec. 27, 2017.

(51) Int. Cl.
*G08B 21/00* (2006.01)
*G08B 21/18* (2006.01)
*G08B 5/38* (2006.01)

(52) U.S. Cl.
CPC ..... *G08B 21/182* (2013.01); *G08B 5/38* (2013.01)

(58) Field of Classification Search
CPC ..... G08B 21/182; G08B 5/38; G08B 5/22; G08B 13/19; G08B 21/18; H04W 8/22; H04W 8/24; H04W 36/22; H04W 4/60; H04W 36/0055; H04W 4/50; H04W 88/00; G06N 20/00; G06N 5/04; G06N 5/043;

(Continued)

(56) References Cited

U.S. PATENT DOCUMENTS 7,193,644 B2 3/2007 Carter
8,139,098 B2 3/2012 Carter
8,144,183 B2 3/2012 Carter (Continued)

OTHER PUBLICATIONS

Office Action for U.S. Appl. No. 16/208,188, dated Jun. 27, 2019, Hruska, "Providing Device Power-level Notifications", 13 pages.

*Primary Examiner* — Anh V La
(74) *Attorney, Agent, or Firm* — Lee & Hayes, P.C.

(57) ABSTRACT

This application is directed to techniques and processes for notifying a user about power levels of electronic devices. For example, a first electronic device may receive data representing the power level of a second electronic device. The first electronic device may then determine that the power level is below a threshold power level. After the determination, the first electronic device may detect a user and/or a client device located within a threshold distance to the first electronic device and/or the second electronic device. The first electronic device may then send data to the second electronic device, wherein the data includes a command to emit light according to a pattern indicating that the power level is below the threshold power level. Additionally, the first electronic device may send a message to the client device, where the message indicates that the power level is below the threshold power level.

20 Claims, 16 Drawing Sheets

(58) Field of Classification Search
CPC ... H04M 1/7253; H04M 1/22; H04M 2250/12
USPC ..... 340/657, 663, 660, 661, 691.1, 686.1, 340/686.6, 693.1
See application file for complete search history.

(56) References Cited

U.S. PATENT DOCUMENTS 8,154,581 B2 4/2012 Carter
8,780,201 B1 7/2014 Scalisi et al.
8,823,795 B1 9/2014 Scalisi et al.
8,842,180 B1 9/2014 Kasmir et al.
8,872,915 B1 10/2014 Scalisi et al.
8,937,659 B1 1/2015 Scalisi et al.
8,941,736 B1 1/2015 Scalisi
8,947,530 B1 2/2015 Scalisi
8,953,040 B1 2/2015 Scalisi et al.
9,013,575 B2 4/2015 Scalisi
9,049,352 B2 6/2015 Scalisi et al.
9,053,622 B2 6/2015 Scalisi
9,058,738 B1 6/2015 Scalisi
9,060,103 B2 6/2015 Scalisi
9,060,104 B2 6/2015 Scalisi
9,065,987 B2 6/2015 Kasmir et al.
9,094,584 B2 7/2015 Scalisi et al.
9,113,051 B1 8/2015 Scalisi
9,113,052 B1 8/2015 Scalisi et al.
9,118,819 B1 8/2015 Scalisi et al.
9,142,214 B2 9/2015 Scalisi
9,160,987 B1 10/2015 Kasmir et al.
9,165,444 B2 10/2015 Scalisi
9,172,920 B1 10/2015 Kasmir et al.
9,172,921 B1 10/2015 Scalisi et al.
9,172,922 B1 10/2015 Kasmir et al.
9,179,107 B1 11/2015 Scalisi et al.
9,179,108 B1 11/2015 Scalisi et al.
9,179,109 B1 11/2015 Kasmir et al.
9,196,133 B2 11/2015 Scalisi et al.
9,197,867 B1 11/2015 Scalisi et al.
9,230,424 B1 1/2016 Scalisi et al.
9,237,318 B2 1/2016 Kasmir et al.
9,247,219 B2 1/2016 Kasmir et al.
9,253,455 B1 2/2016 Harrison et al.
9,342,936 B2 5/2016 Scalisi
9,508,239 B1 11/2016 Harrison et al.
9,736,284 B2 8/2017 Scalisi et al.
9,743,049 B2 8/2017 Scalisi et al.
9,769,435 B2 9/2017 Scalisi et al.
9,786,133 B2 10/2017 Harrison et al.
9,799,183 B2 10/2017 Harrison et al.
9,905,105 B1 2/2018 Ikonen et al.
10,665,082 B1 * 5/2020 Hruska ..... G08B 29/181
2006/0121951 A1 6/2006 Perdomo et al.
2011/0164512 A1 7/2011 Citrano, III et al.
2015/0156307 A1 6/2015 Kim et al.
2016/0073351 A1 3/2016 Cardozo et al.
2016/0277879 A1 9/2016 Daoura et al.
2017/0236390 A1 * 8/2017 Herschkowitz ..... G08B 7/06 340/539.12
2018/0024202 A1 1/2018 Erickson et al.
2018/0124459 A1 * 5/2018 Knox ..... H04N 21/4223
2018/0262894 A1 9/2018 Daoura et al.

* cited by examiner

PROVIDING DEVICE POWER-LEVEL NOTIFICATIONS

RELATED APPLICATIONS

This application claims priority to and is a continuation of U.S. patent application Ser. No. 16/208,188, filed on Dec. 3, 2018, titled "PROVIDING DEVICE POWER-LEVEL NOTIFICATIONS," which claims priority to U.S. Provisional Patent Application No. 62/610,636, filed Dec. 27, 2017, titled "LOW BATTERY NOTIFICATIONS FOR AUDIO/VIDEO RECORDING AND COMMUNICATION DEVICES," the entire contents of which are incorporated herein by reference.

BACKGROUND

Electronic devices for the home, such as audio/video (A/V) recording and communication devices, light emitters, sensors, automation devices, etc., may be battery powered. When the battery level of such an electronic device becomes depleted, the electronic device may cease operating as intended. For instance, an A/V device, such as a video doorbell, may no longer generate and/or send image data; a light emitter may no longer emit light, or may grow progressively dimmer; a sensor may no longer detect motion and/or detect a door opening/closing; an automation device, such as a smart lock, may no longer lock/unlock an entrance, and/or the like. Low-battery notifications provided to a user give the user the opportunity recharge and/or replace the low battery of the electronic device, lessening the chance that the battery of the electronic device will discharge completely and render the electronic device non-functional.

BRIEF DESCRIPTION OF THE DRAWINGS

The various embodiments of the present disclosure are directed to providing device power-level notifications, which will now be discussed in detail with an emphasis on highlighting the advantageous features. These embodiments depict the novel and non-obvious embodiments for providing device power-level notifications, as shown in the accompanying drawings, which are for illustrative purposes only. These drawings include the following figures, in which like numerals indicate like parts.

DETAILED DESCRIPTION

Figure 1A:
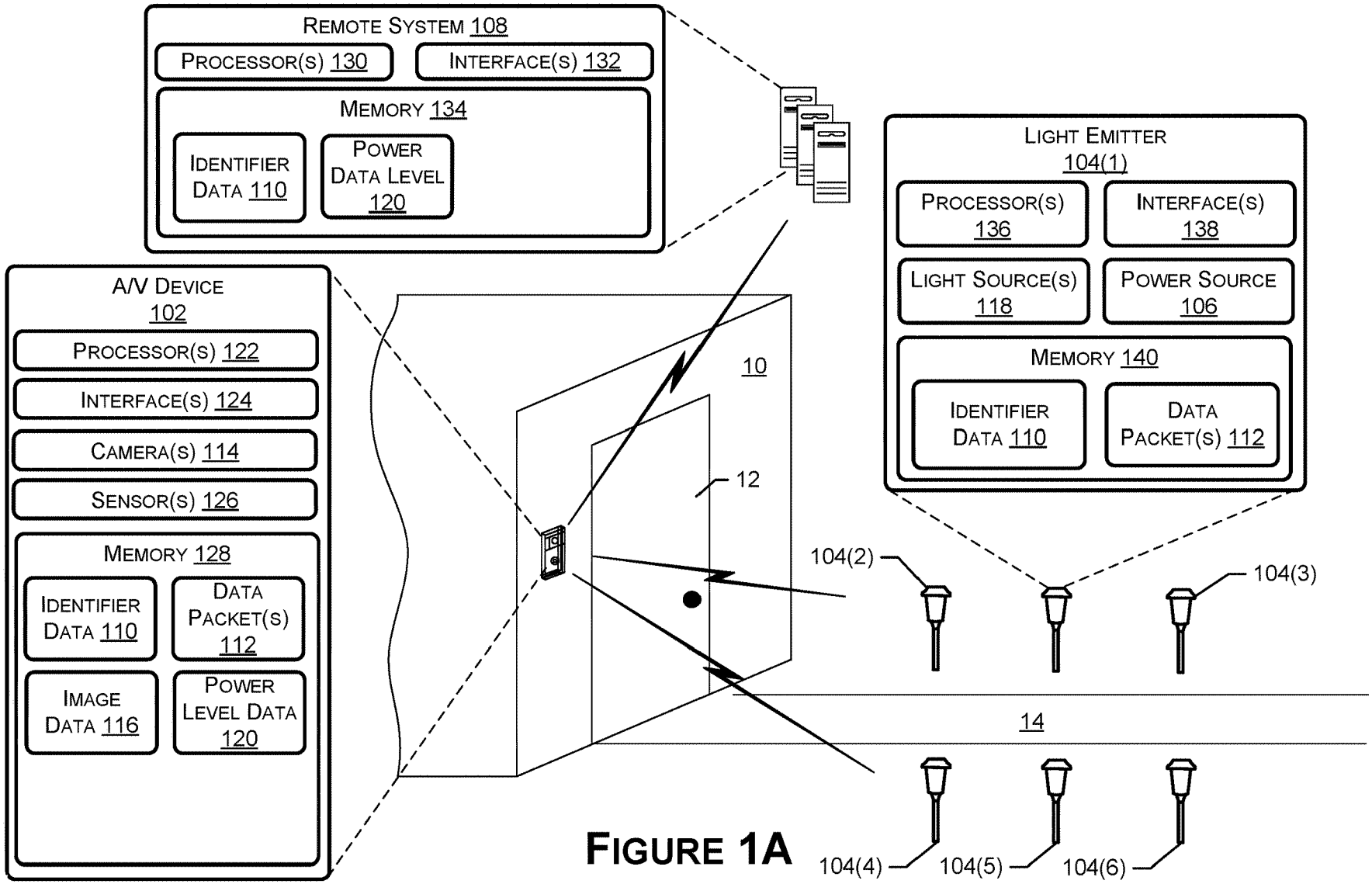
FIGS. 1A-1B are schematic diagrams of examples of notifying a user of a low power level associated with an electronic device, according to various aspects of the present disclosure.

The present disclosure describes systems and techniques for providing device power level notifications. For example, a user may install multiple electronic devices around the user's environment, such as the user's house, business, apartment, and/or the like. The electronic devices may include, but are not limited to, A/V devices (e.g., video doorbells), light emitters (e.g., perimeter lights, walkway lights, etc.), sensors (e.g., motion sensors), automation devices (e.g., smart locks), hub devices, voice-activated devices, appliances, and/or any other type of electronic device. When installing the electronic devices, a remote system may receive data associated with the electronic devices. For instance, the data may represent identifiers of the electronic devices installed at the user's environment. An identifier for an electronic device may include, but is not limited to, an Internet Protocol (IP) address, a media access control (MAC) address, a numerical identifier, an alphabetic identifier, a mixed numerical and alphabetic identifier, and/or any other type of identifier that may be used to identify the electronic device. In some examples, the remote system may then store data that associates at least two of the electronic devices with each other, such as being included in a group of devices.

In some examples, one or more of the electronic devices may be powered using an external power source. For instance, when installing such an electronic device, the user may connect the electronic device to an external power source (e.g., AC mains, an electric power grid, etc.). Additionally, or alternatively, in some examples, one or more of the electronic devices may be powered using an internal power source. The internal power source may include an energy storage device, such as, but is not limited to, one or more batteries, one or more fuel cells, and/or any other type of energy storage device. When a device is powered using an internal power source, the electronic device may not operate as intended when the power level of the internal power source falls below a threshold power level. For instance, an A/V device may no longer generate and/or send image data, a light emitter may no longer emit light (or may emit progressively dimmer light), a sensor may no longer detect motion and/or detect a door opening/closing, an automation device may no longer lock/unlock an entrance, and/or the like.

In some examples, in order to conserve power of a first electronic device that includes an internal power source, a second electronic device (and/or a remote system) may notify the user about the low power level of the first electronic device. In various embodiments, the second electronic device may be connected to an external power source (e.g., AC mains), or may simply have an internal power source that is more robust than that of the first electronic device, or that currently has a higher power level than the internal power source of the first electronic device.

The second electronic device may determine the power level of the first electronic device using various techniques. In some examples, the second electronic device determines the power level based at least in part on receiving a data packet from the first electronic device. For instance, the data packet may include at least data representing an identifier associated with the first electronic device and data representing the power level of the internal power source of the first electronic device. In some instances, the first electronic device may send the data packet(s) at set time intervals, where the intervals may be regular or irregular. In some examples, the first electronic device may send the data packet when the power level of the internal power source falls below a threshold power level. Still further, in some instances, the first electronic device may send the data packet in response to a request from the second electronic device for the power level. For instance, the first electronic device may receive, from the second electronic device, a data packet that includes at least data representing the identifier of the first electronic device and data representing a request for the power level. In some examples, the first electronic device receives these data packet(s) at set time intervals, where the intervals may be regular or irregular.

In various embodiments, the functions performed by the second electronic device may be performed by one or more remote devices or systems. For example, as described above, the second electronic device and/or the remote system may send a request, to the first electronic device, for the power level of the first electronic device. In response, the first electronic device may send the data packet to the second electronic device and/or to the remote system. For ease of illustration, in further examples below that describe functions performed by the second electronic device, it is to be understood that at least some of these functions may be performed by the remote devices or systems, either in place of, or in addition to, the functions performed by the second electronic device.

Additionally, or alternatively, in some examples, the second electronic device may determine the power level of the first electronic device using computer vision analysis. For instance, the second electronic device may generate image data representing the first electronic device. The second electronic device may then analyze the image data using one or more computer vision algorithms, such as object recognition or the like. Based at least in part on the analysis, the second electronic device may determine that the image data represents the first electronic device is emitting light using a pattern. The pattern may include, but is not limited to, the first electronic device flashing its light, the first electronic device changing an intensity level of its light, the first electronic device changing a color of its light, and/or the like. Based at least in part on the pattern, the second electronic device may determine the power level of the first electronic device. For example, when the power level of the first electronic device falls below the threshold power level, the first electronic device may begin flashing its light. The second electronic device may then determine that the power level of the first electronic device is below the threshold power level when the second electronic device determines that the image data represents the first electronic device flashing its light.

In some examples, the second electronic device may generate and/or store data indicating the power level of the first electronic device. Additionally, or alternatively, in some examples, the second electronic device may send the data to the remote system, which may then store the data. The second electronic device may then notify the user of the low power level for the first electronic device. In some examples, the second electronic device notifies the user when the power level of the first electronic device falls below the threshold power level.

In some examples, the second electronic device notifies the user when the user is in proximity to the first electronic device, the second electronic device, and/or another electronic device (e.g., another electronic device included in a group of devices of which the first electronic device is a member). For instance, the second electronic device (and/or another electronic device) may detect the presence of the user and/or a client device associated with the user. In some examples, to detect the presence, the second electronic device may receive data from the client device, such as when the client device is in proximity to (e.g., within wireless communication range of) the second electronic device. The second electronic device may receive the data using a short-range communication protocol or technology, such a Bluetooth, Bluetooth Low Energy (BLE), Zigbee, and/or the like. In particular, the second electronic device and the client device may be paired with one another during a process of setting up the second electronic device, and/or at a later time. Once paired, the second electronic device and the client device may automatically connect to one another whenever the two devices are within wireless communication range of one another. The data may represent an identifier associated with the client device, which the second electronic device may match to stored data representing the identifier of the client device. Based at least in part on the match, the second electronic device may determine that the client device sent the data to the second electronic device. As such, the second electronic device may determine that the client device is in proximity to the second electronic device.

Additionally, or alternatively, in some examples, to detect the presence, the second electronic device may generate image data. The second electronic device may then analyze the image data using one or more computer vision algorithms, such as object recognition, facial recognition, and/or the like. Based at least in part on the analysis, the second electronic device may determine that the image data represents a person. Additionally, in some examples, based at least in part on the analysis, the second electronic device may determine that the image data represents a specific person, such as the user associated with the first and second electronic devices. Based at least in part on the determination, the second electronic device may determine that the user is in proximity to the second electronic device.

Additionally, or alternatively, in some examples, to detect the presence, the second electronic device may receive data from another electronic device, where the data indicates that the other electronic device detected the presence of the user and/or the client device. In such examples, the other electronic device may detect the presence of the user and/or the client device using similar processes as described herein with regard to the second electronic device.

In any of the foregoing examples, the second electronic device may notify the user of the low power level of the first electronic device. For a first example, the second electronic device may generate a data packet that includes data representing at least the identifier associated with the first electronic device, data representing a command to activate a light source, and/or data representing a command to activate the light source using a pattern. The second electronic device may then send the data packet to the first electronic device. In response to receiving the data packet, the first electronic device may activate (e.g., illuminate) its light source and/or activate its light source according to the pattern. As such, the user, when located proximate the first electronic device, may notice that the first electronic device is activating its light source and/or activating its light source according to the pattern. The light source may thus notify the user of the low power level of the first electronic device.

For a second example, the second electronic device may generate a data packet that includes data representing at least an identifier associated with a group of devices of which the first electronic device is a member (and/or representing identifiers of electronic devices in the group), data representing the identifier associated with the first electronic device, data representing a command to activate a light source, and/or data representing a command to activate the light source using a pattern. The second electronic device may then send the data packet to first electronic device as well as to other electronic devices that are associated with the first electronic device (e.g., the electronic devices in the group). Based at least in part on receiving the data packet, the electronic devices may activate (e.g., illuminate) light sources and/or activate the light sources according to the pattern. In some examples, the pattern may include causing each of the other electronic devices to activate a respective light source to notify the user of the low power level of the first electronic device.

For a third example, the second electronic device may send a message to the client device, where the message indicates the power level of the first electronic device and/or indicates that the power level is below the threshold power level. The client device may receive the message and, in response, display a user interface that indicates the power level of the first electronic device and/or indicates that the power level is below the threshold power level. In some examples, in addition to sending the message, the second electronic device may send a data packet to one or more other electronic devices with a command to activate respective light emitters, similar to the examples described above. As such, the user can further determine that the first electronic device includes the low power level based at least in part on how the one or more other electronic devices are activating their respective light emitters.

For a fourth example, the second electronic device may generate image data representing at least the first electronic device. The second electronic device may then send the image data to the client device. Additionally, the second electronic device may send, to the client device, data indicating the power level of the first electronic device and/or data indicating that the power level of the first electronic device is below the threshold power level. The client device may receive the image data from the second electronic device and display image(s) represented by the image data. Additionally, using the data, the client device may display an interface element associated with the first electronic device that indicates the low power level of the first electronic device. As such, the user, using the client device, is made aware of the low power level of the first electronic device.

In some examples, by performing the processes described herein, the first electronic device, which is powered using the internal power source, may conserve power by leveraging other electronic devices to notify the user about the low power level of the internal power source. For instance, in some examples, since the first electronic device is powered using the internal power source, the first electronic device may be configured to activate (e.g., turn on, increase power to, etc.) a network interface of the first electronic device at set time intervals. While activated, the first electronic device may use the network interface to send data (e.g., data packets) to and/or receive data from other electronic devices. If the first electronic device does not have data to send, and/or does not receive data from another electronic device, the first electronic device may then deactivate (e.g., turn off, decrease power to, etc.) the network interface in order to conserve power. As such, when the power level of the first electronic device is below the threshold power level, the first electronic device may increase the length of the time intervals in between activating the network interface, and/or send less data when activating the network interface, in order to conserve power. This benefit results from the second electronic device storing data indicating the low power level of the first electronic device, and then using that data to notify the user about the low power level of the first electronic device, without the first electronic device needing to perform any additional steps or transmit any additional data after sending the data indicating the low power level to the second electronic device.

As described herein, the electronic devices may send data packets to and/or receive data packets from other electronic devices. In some examples, a data packet may include, but is not limited to, data (e.g., a header, a preamble, etc.) that synchronizes the electronic device with the other electronic devices, data representing an identifier associated with the group of electronic devices, data representing an identifier associated with the electronic device, data representing a current status of the electronic device, data represented a power level of an internal power source of the electronic device, data representing a command to be performed by the electronic device and/or another electronic device, and/or the like. In such examples, the other electronic devices can use the data included within the data packet to determine that the data packet was sent from another electronic device included in the group of devices and/or determine which electronic device sent the data packet.

In some examples, the electronic devices send the data packets at set time intervals (e.g., every millisecond, every second, every five seconds, and/or any other time interval, including irregular intervals). In such examples, the set time intervals may be similar for the electronic devices and/or the set time intervals may be different for at least some of the electronic devices. For instance, electronic devices that receive power from external power sources may use a first, shorter, time interval, while electronic devices that receive power from internal power sources may use a second, longer, time interval. When using time intervals to send data packets, an electronic device may activate a network interface and/or send a first data packet at a first time, determine that the time interval has elapsed, and then activate the network interface and/or send a second data packet at a second time.

As further described herein, an electronic device may activate light source(s) by causing the light source(s) to emit light (e.g., causing the light source(s) to illuminate). The electronic device may activate the light source(s) by providing power to the light source(s). Additionally, an electronic device may deactivate light source(s) by causing the light source(s) to cease emitting the light (e.g., causing the light source(s) to no longer illuminate). The electronic device may deactivate the light source(s) by ceasing to provide power to the light source(s).

Moreover, as described herein, and in some examples, a command may include one or more sets of instructions that, when executed by an electronic device (e.g., one or more processors of the electronic device), causes the electronic device to perform a function. For example, a command may include a set of instructions associated with activating a light source according to a pattern. As such, an electronic device that executes the set of instructions may cause a light source to activate according to the pattern. Additionally, in some examples, a command may include data (e.g., a flag) that, when received by an electronic device, causes the electronic device to execute one or more sets of instructions (e.g., stored on the electronic device) associated with performing a function. For example, the data may be associated with activating a light source according to a pattern. As such, when an electronic device receives the command, the electronic device may execute one or more sets of stored instructions that cause the electronic device to activate a light source according to the pattern. While these are just some examples of commands, in other examples a command may include other types of instructions and/or data that cause an electronic device to perform a function.

The remaining detailed description describes the present embodiments with reference to the drawings. In the drawings, reference numbers label elements of the present embodiments. These reference numbers are reproduced below in connection with the discussion of the corresponding drawing features.

Figure 1B:
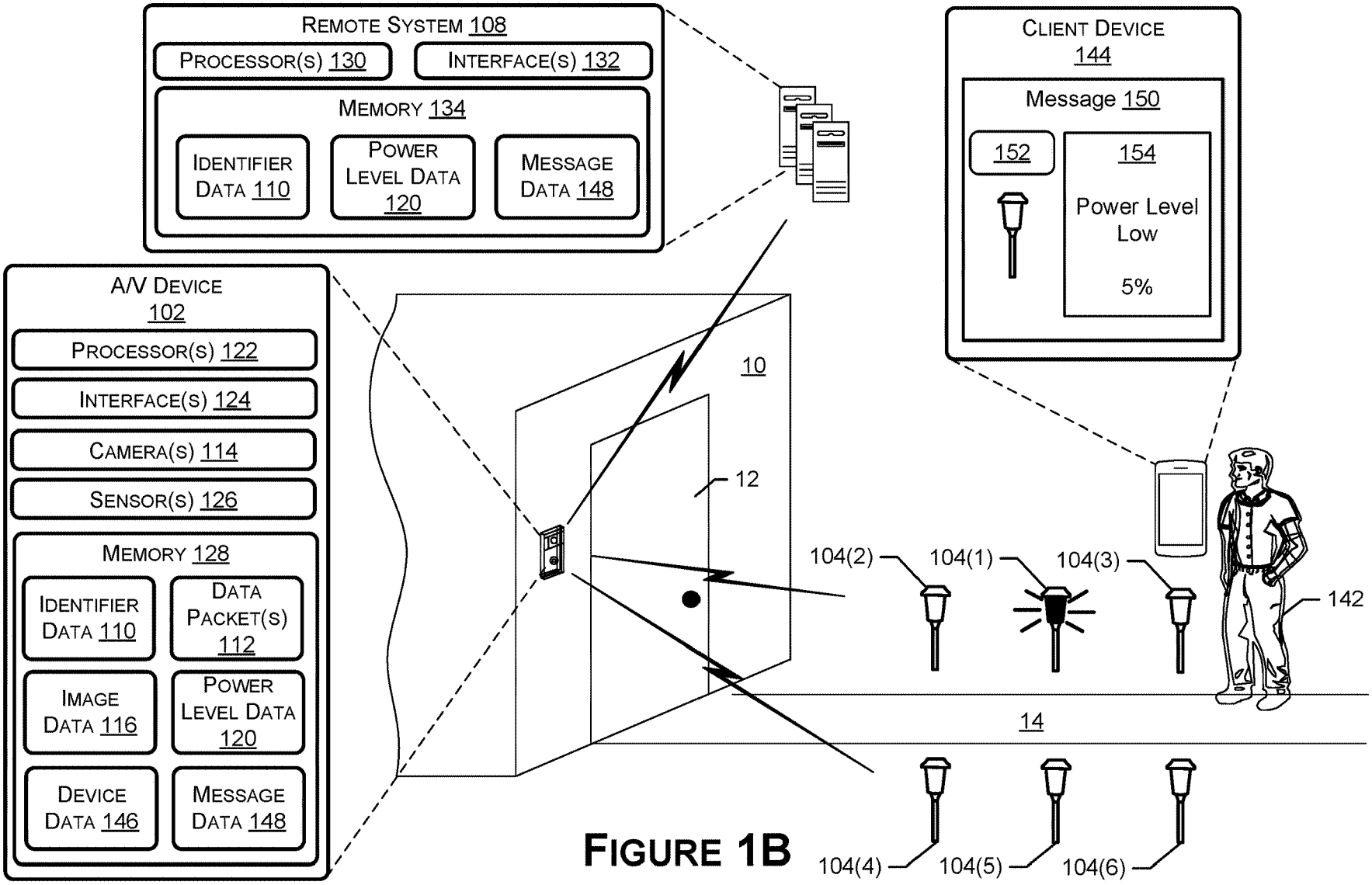

FIGS. 1A-1B are schematic diagrams of examples of using electronic devices to notify a user of a low power level associated with an electronic device, according to various aspects of the present disclosure. For example, and as illustrated in FIG. 1A, electronic devices may be installed around a property, such as a house 10. The electronic devices may include at least an A/V device 102 (e.g., a video doorbell) located near an entrance 12 of the house 10. In the examples of FIGS. 1A-1B, the A/V device 102 may be connected to an external power source (e.g., AC mains) for receiving power. The electronic devices may further include light emitters 104(1)-(6) (e.g., perimeter lights, walkway lights, etc.) located outside of the house 10, such as along a path 14 to the entrance 12. In the example of FIGS. 1A-1B, the light emitters 104(1)-(6) may be powered by internal power sources 106. For example, the first light emitter 104(1) may include at least one battery that powers the first light emitter 104(1).

During a process of installing the electronic devices, a remote system 108 may receive identifier data 110 associated with the electronic devices. For instance, the identifier data 110 may represent identifiers of the electronic devices installed at the property. An identifier for an electronic device may include, but is not limited to, an IP address, a MAC address, a numerical identifier, an alphabetic identifier, a mixed numerical and alphabetic identifier, and/or any other type of identifier that may be used to identify the electronic device. In some examples, using the identifier data 110, the remote system 108 may then store data that associates at least two of the electronic devices as being included in a group of devices. Additionally, the remote system 108 may send the identifier data 110 to at least the A/V device 102. The A/V device 102 may then use the identifier data 100 to identify the light emitters 104(1)-(6).

In some examples, in order to conserve power of the light emitters 104(1)-(6) that include internal power sources 106, the A/V device 102 (and/or the remote system 108) may notify a user 142 (FIG. 1B) about the power levels of the light emitters 104(1)-(6). For instance, the A/V device 102 may determine the power level of the first light emitter 104(1). In some examples, the A/V device 102 determines the power level based at least in part on receiving a data packet 112 from the first light emitter 104(1). For instance, the data packet 112 may include at least data representing an identifier associated with the first light emitter 104(1) and data representing the current power level of the internal power source 106 of the first light emitter 104(1). In some instances, the first light emitter 104(1) may send data packet(s) 112 at set time intervals. In some instances, the first light emitter 104(1) may send the data packets in response to receiving a request for the power level. For instance, the A/V device 102 may send requests at set time intervals. In some examples, the first light emitter 104(1) may send data packet(s) 112 that include data indicating the power level when the power level is below a threshold power level. The threshold power level may include, but is not limited to, 5%, 10%, 15%, 20%, and/or any other level that may be associated with the internal power source 106.

In various embodiments, the functions performed by the A/V device 102 may be performed by the remote system 108. For example, as described above, the A/V device 102 (and/or the remote system 108) may notify the user about the power levels of the light emitters 104(1)-(6). For ease of illustration, in further examples below that describe functions performed by the A/V device 102, it is to be understood that at least some of these functions may be performed by the remote system 108, either in place of, or in addition to, the functions performed by the A/V device 102.

Additionally, or alternatively, in some examples, the A/V device 102 may determine the power level using computer vision analysis. For instance, the A/V device 102 may use a camera 114 to generate image data 116 representing at least the first light emitter 104(1). The A/V device 102 may then analyze the image data 116 using one or more computer vision algorithms, such as one or more object recognition algorithms. Based at least in part on the computer vision analysis, the A/V device 102 may determine that the light source(s) 118 of the first light emitter 104(1) is/are emitting light using a pattern. The pattern may include, but is not limited to, the first light emitter 104(1) flashing the light source(s) 118, the first light emitter 104(1) changing an intensity level of the light source(s) 118, the first light emitter 104(1) changing a color of the light source(s) 118, and/or any other type of pattern. Based at least in part on the pattern, the A/V device 102 may determine the power level of the first light emitter 104(1).

For a first example, the first light emitter 104(1) may cause the light source(s) 118 to emit the light at an intensity that indicates the power level of the internal power source 106. For instance, if the internal power source 106 includes a high-power level, such as around 90%, the first light emitter 104(1) may cause the light source(s) 118 to emit the light at a high intensity (e.g., very bright). Additionally, if the internal power source 106 includes a medium-power level, such as around 50%, then the first light emitter 104(1) may cause the light source(s) 118 to emit the light at a medium intensity (e.g., bright). Furthermore, if the internal power source 106 includes a low-power level, such as around 10%, then the first light emitter 104(1) may cause the light source(s) 118 to emit the light at a low intensity (e.g., dim). As such, based at least in part on the computer vision analysis, the A/V device 102 may determine the intensity (e.g., low intensity) of the light being emitted by the first light emitter 104(1). The A/V device 102 may then determine the power level (e.g., low-power level) based at least in part on the intensity.

In some instances, the intensity corresponds to the brightness of the light being emitted by the first light emitter 104(1). For instance, "high intensity" may correspond to a maximum brightness level (e.g., 100% brightness) of the light, "medium intensity" may correspond to 50% of the maximum brightness level for the light, and "low intensity" may correspond to 10% of the maximum brightness level for the light. However, this is just one example of different intensities corresponding to different brightness levels and, in other examples, different percentages of brightness levels may correspond to the different levels of intensity.

In some instances, the A/V device 102 may store data indicating the different brightness levels for the light. The data may be sent to the A/V device 102 during a configuration process for the first light emitter 104(1). For instance, the first light emitter 104(1), the remote system 108, and/or another device (e.g., a client device) may send the data to the A/V device 102 during the configuration process. Additionally, or alternatively, the A/V device 102 may determine the different brightness levels using computer vision analysis during the configuration process of the first light emitter 104(1). For instance, the first light emitter 104(1) may begin emitting the light at the maximum brightness level when the first light emitter 104(1) is being configured. The A/V device 102 may then analyze image data 116 using computer vision analysis to determine the brightness level of the light when the first light emitter 104(1) is emitting the light at the maximum brightness. The first light emitter 104(1) may then change the brightness level to other known levels, such as 50% of the maximum brightness level, and the A/V device 102 can perform similar computer vision analysis to determine those brightness levels. The A/V device 102 may then generate and store the data indicating the different brightness levels.

In some instances, the first light emitter 104(1) may continuously emit the light at an intensity that corresponds to the power level of the internal power source 106. For instance, the first light emitter 104(1) may emit the light at 100% of its maximum brightness level when the internal power source 106 is at 100%, emit the light at 75% of its maximum brightness level when the internal power source 106 is at 75%, emit the light at 50% of its maximum brightness level when the internal power source 106 is at 50%, and so forth. In other instances, the first light emitter 104(1) may continuously emit the light at the maximum brightness level as long as the internal power source 106 includes a sufficient amount of power, but change the brightness level to indicate the power level of the internal power source 106 when receiving data (e.g., a data packet 112) from the A/V device 102 that represents a request for the power level. After a threshold period of time from receiving the data, the first light emitter 104(1) may once again begin emitting the light at the maximum brightness level. The threshold period of time may include, but is not limited to, one second, five seconds, thirty seconds, one minute, and/or any other period of time.

For a second example, the first light emitter 104(1) may cause the light source(s) 118 to emit the light using different patterns that indicate the power level of the internal power source 106. For instance, if the internal power source 106 includes a high power level, such as around 90%, the first light emitter 104(1) may cause the light source(s) 118 to emit the light using by flashing the light at a high frequency (e.g., 5 flashes per second). Additionally, if the internal power source 106 includes a medium power level, such as around 50%, then the first light emitter 104(1) may cause the light source(s) 118 to emit the light by flashing the light at a moderate frequency (e.g., 3 flashes per second). Furthermore, if the internal power source 106 includes a low power level, such as around 10%, then the first light emitter 104(1) may cause the light source(s) 118 to emit the light by flashing the light at a low frequency (e.g., 1 flash per second). As such, based at least in part on the analysis, the A/V device 102 may determine the frequency at which the light is flashing at the first light emitter 104(1). The A/V device 102 may then determine the power level (e.g., a low power level) based at least in part on the flashing frequency.

In some instances, rather than flashing the light at a frequency, the first light emitter 104(1) may flash the light a number of times that indicates the power level of the internal power source 106. For instance, the first light emitter 104(1) may flash the light ten times over a given period of time to indicate that the power level for the internal power source is at 100%, flash the light nine times over the given period of time to indicate that the power level for the internal power source is at 90%, flash the light five times over the given period of time to indicate that the power level for the internal power source is at 50%, and/or so forth. The given period of time may include, but is not limited to, one second, five seconds, thirty seconds, one minute, and/or any other period of time. While this is just one example of the number of times the first light emitter 104(1) may flash the light over the given period of time, in other examples, the first light emitter 104(1) may use any other number of flashes to indicate the power level of the internal power source 106.

In other examples, the first light emitter 104(1) may use any other pattern to indicate the power level of the internal power source 106. Additionally, in some examples, to perform the analysis, the A/V device 102 may store data that associates one or more light patterns with one or more respective power levels of the internal power source 106. In such examples, the A/V device 102 may analyze the image data 116 to determine that the first light emitter 104(1) is causing the light source(s) 118 to emit the light according to a pattern. The A/V device 102 may then match the identified pattern to a pattern represented by the stored data. Based at least in part on the match, the A/V device 102 may use the stored data to determine that the pattern is associated with a particular power level of the internal power source 106.

With reference to FIG. 1A, in some examples the A/V device 102 may generate power level data 120 indicating the power level of the first light emitter 104(1). The A/V device 102 may then store the power level data 120. Additionally, in some examples, the A/V device 102 may send to the power level data 120 to the remote system 108, which may then store the power level data 120. In some examples, the A/V device 102 may continue to perform the processes described herein in order to continue to monitor (e.g., determine) the power level of the internal power source 106 of the first light emitter 104(1). In such examples, when the power level changes, the A/V device 102 may update the power level data 120 to indicate the new power level and/or store new power level data 120 that indicates the new power level.

In some examples, the A/V device 102 may perform similar processes to determine and/or monitor the power levels of the internal power sources of the other light emitters 104(2)-(6). Additionally, in some examples, another electronic device (e.g., one of the light emitters 104(2)-(6)) may perform similar processes to determine and/or monitor the power level of the internal power source 106 of the first light emitter 104(1). In such examples, the electronic device that determines and/or monitors the power level may be powered by an external power source. In some examples, the electronic device that determines and/or monitors the power level may be powered by an internal power source. In some of these examples, the internal power source of the electronic device that determines and/or monitors the power level of other devices may be more robust, or may simply have a higher power level currently than that of the internal power sources of the other devices.

As further illustrated in the example of FIG. 1A, the A/V device 102 includes one or more processor(s) 122, one or more network interface(s) 124, one or more sensor(s) 126, and memory 128. Additionally, the remote system 108 includes one or more processor(s) 130, one or more network interface(s) 132, and memory 134. Furthermore, the first light emitter 104(1) (as well as the other light emitter(s) 104(2)-(6)) include one or more processor(s) 136, one or more network interface(s) 138, and memory 140.

As illustrated in the example of FIG. 1B, after determining the power level of the first light emitter 104(1), the A/V device 102 may notify the user 142 of the power level. In some examples, the A/V device 102 notifies the user 142 when the power level is below the threshold power level. In some examples, the A/V device 102 notifies the user 142 when the user 142 is in proximity to the first light emitter 104(1), the A/V device 102, and/or one or more of the other light emitters 104(2)-(6).

For instance, the A/V device 102 may detect the presence of the user 142 and/or a client device 144 associated with the user 142. In some examples, to detect the presence, the A/V device 102 may receive device data 144 from the client device 144, such as when the client device 144 is within wireless communication range of the A/V device 102. For example, the A/V device 102 may receive the device data 146 using a short-range communication protocol or technology, such a Bluetooth, Bluetooth Low Energy (BLE), Zigbee, and/or the like. In particular, the A/V device 102 and the client device 144 may be paired with one another during a process of setting up the A/V device 102, and/or at a later time. Once paired, the A/V device 102 and the client device 144 may automatically connect to one another whenever the two devices are within wireless communication range of one another.

The device data 146 received by the A/V device 102 may represent at least an identifier associated with the client device 144. For instance, the identifier may include, but is not limited to, an IP address, a MAC address, a numerical identifier, an alphabetic identifier, a mixed numerical and alphabetic identifier, and/or any other type of identifier that may be used to identify the client device 144. The A/V device 102 may then match the identifier from the device data 146 with identifier data 110 representing the identifier of the client device 144, which the A/V device 102 may store in the memory 128 (and/or the remote system 108 may store in the memory 134). Based at least in part on the match, the A/V device 102 (and/or the remote system 108) may determine that the client device 144 is in proximity to the A/V device 102.

Additionally, or alternatively, in some examples, to detect the presence, the A/V device 102 may generate image data 116. The A/V device 102 may then analyze the image data 116 using one or more computer vision algorithms, such as object recognition, facial recognition, and/or the like. Based at least in part on the analysis, the A/V device 102 may determine that the image data 116 represents a person. Additionally, in some examples, based at least in part on the analysis, the A/V device 102 may determine that the image data 116 represents a specific person, such as the user 142. For example, the A/V device 102 may store facial recognition data representing image(s) depicting the user 142. The A/V device 102 may then use the facial recognition data to analyze the image data 116 when performing facial recognition and, based at least in part on the analysis, identify that the image data 116 represents the user 142. In either of the examples, based at least in part on determining that the image data 116 represents a person and/or the user 142, the A/V device 102 may determine that the user 142 is in proximity to the A/V device 102.

Additionally, or alternatively, in some examples, to detect the presence, the A/V device 102 may use the camera(s) 114 and/or the sensor(s) 126 (e.g., a motion sensor) to detect motion of the user 142. Additionally, or alternatively, in some examples, to detect the presence, the A/V device 102 may receive data from another electronic device, such as one of the light emitters 104(2)-(6), where the data indicates that the other electronic device detected the presence of the user 142 and/or the client device 144. In such examples, the other electronic device may detect the presence of the user 142 and/or the client device 144 using the processes described herein with regard to the A/V device 102.

In any of the foregoing examples, based at least in part on detecting the user 142 and/or the client device 144, the A/V device 102 may notify the user 142 of the power level of the first light emitter 104(1), and/or that the power level for the first light emitter 104(1) is below the threshold power level. In some examples, to notify the user 142, the A/V device 102 may generate a data packet 112 that includes data representing at least the identifier associated with the first light emitter 104(1), data representing a command to activate the light source(s) 118, and/or data representing a command to activate the light source(s) 118 using a pattern. The A/V device 102 may then send the data packet 112 to the first light emitter 104(1). In response to receiving the data packet 112, the first light emitter 104(1) may activate (e.g., illuminate) the light source(s) 118 and/or activate the light source(s) 118 according to the pattern. As such, the user 142, when located proximate the first light emitter 104(1), may notice that the first light emitter 104(1) is activating the light source(s) 118 and/or activating the light source(s) 118 according to the pattern. This action may notify the user 142 of the low power level of the first light emitter 104(1).

For a first example, the pattern indicated by the data packet 112 may be associated with electronic devices that include power levels below the threshold power level. As such, the first light emitter 104(1) may receive the data packet 112 and, based at least in part on data or a command in the data packet 112, cause the light source(s) 118 to begin to emit the light according to the pattern. Since the user 142 is located in proximity to the first light emitter 104(1), the user 142 may determine that the first light emitter 104(1) is emitting the light using the pattern, indicating to the user 142 that the power level of the first light emitter 104(1) is below the threshold power level.

For a second example, the first light emitter 104(1) may cause the light source(s) 118 to emit the light at an intensity that indicates the power level of the internal power source 106. For instance, if the internal power source 106 includes a high-power level, such as around 90%, the first light emitter 104(1) may cause the light source(s) 118 to emit the light at a high intensity (e.g., very bright). Additionally, if the internal power source 106 includes a medium-power level, such as around 50%, then the first light emitter 104(1) may cause the light source(s) 118 to emit the light at a medium intensity (e.g., bright). Furthermore, if the internal power source 106 includes a low-power level, such as around 10%, then the first light emitter 104(1) may cause the light source(s) 118 to emit the light at a low intensity (e.g., dim). As such, when the first light emitter 104(1) is causing the light source(s) 118 to emit the light at a given intensity (e.g., low intensity), the user 142 that is located in proximity to the first light emitter 104(1) can look at the intensity of the light. Based at least in part on the intensity, the user 142 may determine the power level (e.g., low-power level) of the first light emitter 104(1).

For a third example, the first light emitter 104(1) may cause the light source(s) 118 to emit the light using different patterns that indicate the power level of the internal power source 106. For instance, if the internal power source 106 includes a high-power level, such as around 90%, the first light emitter 104(1) may cause the light source(s) 118 to emit the light using by flashing the light at a high frequency (e.g., 5 flashes per second). Additionally, if the internal power source 106 includes a medium-power level, such as around 50%, then the first light emitter 104(1) may cause the light source(s) 118 to emit the light by flashing the light at a moderate frequency (e.g., 3 flashes per second). Furthermore, if the internal power source 106 includes a low-power level, such as around 10%, then the first light emitter 104(1) may cause the light source(s) 118 to emit the light by flashing the light at a low frequency (e.g., 1 flash per second). As such, when the first light emitter 104(1) is causing the light source(s) 118 to flash the light at a given frequency, the user 142 that is located in proximity to the first light emitter 104(1) can see the flashing frequency of the light. Based at least in part on the flashing frequency, the user 142 may determine the power level (e.g., a low power level) of the first light emitter 104(1).

In some instances, rather than flashing the light at a frequency, the first light emitter 104(1) may flash the light a number of times that indicates the power level of the internal power source 106. For instance, the first light emitter 104(1) may flash the light ten times over a given period of time to indicate that the power level for the internal power source is at 100%, flash the light nine times over the given period of time to indicate that the power level for the internal power source is at 90%, flash the light five times over the given period of time to indicate that the power level for the internal power source is at 50%, and so forth. The given period of time may include, but is not limited to, one second, five seconds, thirty seconds, one minute, and/or any other period of time. While this is just one example of the number of times the first light emitter 104(1) may flash the light over the given period of time, in other examples, the first light emitter 104(1) may use any other number of flashes to indicate the power level of the internal power source 106.

For a fourth example, the first light emitter 104(1) may cause the light source(s) 118 to emit different colors of light that indicate the power level of the internal power source 106. For instance, the first light emitter 104(1) may cause a the light source(s) 118 to emit red light when the internal power source 106 includes a high-power level, such as around 90%, cause a the light source(s) 118 to emit green light when the internal power source 106 includes a medium-power level, such as around 50%, and cause a the light source(s) 118 to emit blue light when the internal power source 106 includes a low-power level, such as around 10%. While this is just one example of causing the light source(s) 118 to emit different colors of light indicating different power levels, in other examples, the first light emitter 104(1) may use other colors to indicate any power level of the internal power source 106.

Additionally, or alternatively, in some examples, the A/V device 102 may generate a data packet 112 that includes data representing at least an identifier associated with a group of devices (e.g., a subset of the light emitters 104(1)-(6), and/or data representing identifiers of individual ones of the light emitters 104(1)-(6)), data representing the identifier associated with the first light emitter 104(1), data representing a command to activate light source(s), and/or data representing a command to activate the light source(s) according to a pattern. The A/V device 102 may send the data packet 112 to the first light emitter 104(1) as well as the other light emitters 104(2)-(6) that are associated with the first light emitter 104(1) (e.g., those of the light emitters 104(1)-(6) included in the group of devices). Based at least in part on receiving the data packet 112, the light emitters 104(1)-(6) may activate (e.g., illuminate) the light source(s) 118 and/or activate the light source(s) 118 according to the pattern. In some examples, the pattern may include causing each of the light emitters 104(2)-(6) to activate respective light source(s) while the first light emitter 104(1) does not activate its light source(s) 118. In some examples, the pattern may include causing each of the light emitter 104(2)-(6) to activate respective light source(s) such that the light emitters 104(2)-(6) are "pointing" to the first light emitter 104(1). In either example, the user 142, which is located in proximity to the light emitters 104(1)-(6), may notice that the light emitters 104(2)-(6) are activating the light source(s) and/or activating the light source(s) according to the pattern. This may notify the user 142 that the power level of the first light emitter 104(1) is below the threshold power level.

For a third example, the A/V device 102 may send message data 148 representing a message 150 to the client device 144. The message 150 may include, but is not limited to, an indication 152 (e.g., an identifier) of the first light emitter 104(1) (and/or any other light emitters 104 that currently have a low battery), an indication 154 of the current power level (e.g., 5%) of the first light emitter 104(1), and/or an indication that the power level is low and/or below the threshold power level. The client device 144 may receive the message data 148 and, in response, display the message 150. In some examples, in addition to sending the message data 148 representing the message 150, the A/V device 102 may send a data packet 112 to the one or more of the light emitters 104(1)-(6) that currently have a low battery to cause the one or more light emitters 104(1)-(6) to emit light and/or emit light according to a pattern, similar to the examples described above. As such, the user 142 can more easily identify which of the light emitters 104(1)-(6) currently has the low power level, or the power level below the threshold power level, based at least in part on how the one or more light emitters 104(1)-(6) are emitting light.

For a fourth example, the A/V device 102 may generate image data 116 representing at least the first light emitter 104(1). The A/V device 102 may then send the image data 116 to the client device 144. Additionally, the A/V device 102 may send, to the client device 144, power level data 120 indicating the power level of the first light emitter 104(1) and/or power level data 120 indicating that the power level of the first light emitter 104(1) is below the threshold power level. The client device 144 may receive the image data 116 from the A/V device 102 and, based at least in part on receiving the image data 116, display image(s) represented by the image data 116. Additionally, using the power level data 120, the client device 214 may display an interface element associated with the first light emitter 104(1) that indicates the power level of the first light emitter 104(1) and/or indicates that the power level is below the threshold power level. As such, the user 142, using the client device 144, can determine the power level of the first light emitter 104(1) and/or determine that the power level is below the threshold power level.

For a fifth example, the A/V device 102 may output sound that indicates the power level of the first light emitter 104(1) and/or indicates that the power level is below the threshold power level. For instance, the sound may include one or more words, such as "The power level of the first light emitter 104(1) is 5%," or "The power level of the first light emitter 104(1) is low," or "The battery of the first light emitter 104(1) needs to be recharged." When outputting sound, the A/V device 210 may also send a data packet 112 to one or more of the light emitters 104(1)-(6) (e.g., to cause the light emitters 104 that has the low power level to blink or flash), and/or send message data 148 to the client device 144, similar to the examples above.

In some instances, the A/V device 102 may determine that the user 142 and/or the client device 144 is no longer located proximate to the first light emitter 104(1) and/or the A/V device 102. For a first example, the A/V device 102 may analyze additional image data 116 using computer vision analysis and, based at least in part on the analysis, determine that the additional image data 116 does not represent the user 142. For a second example, the A/V device 102 may determine that additional device data 146 has not been received from the client device 144 for a threshold period of time. The threshold period of time may include, but is not limited to, five seconds, ten seconds, thirty seconds, and/or any other period of time. For a third example, the A/V device 102 may determine that the threshold period of time has elapsed since the transmitting of the data packet 112 to the first light emitter 104(1) that includes the command to activate the light source(s) 118 according to the pattern. In either of the examples above, based on determining that the user 142 and/or the client device 144 is no longer located proximate to the first light emitter 104(1) and/or the A/V device 102, the A/V device 102 may cause the first light emitter 104(1) to cease activating the light source(s) 118 according to the pattern.

For example, the A/V device 102 may generate an additional data packet 112 that includes data representing at least the identifier associated with the first light emitter 104(1), data representing a command to cease activating the light source(s) 118, and/or data representing a command to cease activating the light source(s) 118 using the pattern. The A/V device 102 may then send the additional data packet 112 to the first light emitter 104(1). In response to receiving the additional data packet 112, the first light emitter 104(1) may cease activating the light source(s) 118 and/or cease activating the light source(s) 118 according to the pattern.

As shown in the example of FIG. 1B, the A/V device 102 sends the message data 148 to the client device 144 for displaying the message 150 when the user 142 is located proximate to the first light emitter 104(1) (and/or the A/V device 102). As such, the user 142 can determine, using the message 150, that there is a light emitter nearby that includes the low power level. Additionally, since the user is located proximate to the first light emitter 104(1) that is emitting the light to indicate the power level, the user 142 can further determine that it is the first light emitter 104(1) (e.g., not one of the other light emitters 104(2)-(6)) that includes the low battery. In other words, the user 142 may more easily detect that the first light emitter 104(1) includes the low power level. However, in other examples, the A/V device 102 may send the message 148 to the client device 144 at other times, such as when the user 142 is not located proximate to the first light emitter 104(1).

Although the above example describes the A/V device 102 detecting the user 142, in other examples, the first light emitter 104(1) may detect that the user 142 is located proximate to the first light emitter 104(1), using one or more of the processes described above with regard to the A/V device 102. The first light emitter 104(1) may then activate the light source(s) 118 according to the pattern in order to notify the user 142 about the power level of the internal power source 106. Additionally, in some examples, the first light emitter 104(1) may send image data 116 to the client device 144 that represents the message 150.

Additionally, in some examples, the first light emitter 104(1) may disable one or more components based on the power level of the internal power source 106. For instance, the first light emitter 104(1) may disable the one or more components when the power level falls below the threshold power level. To disable a component, the first light emitter 104(1) may cease providing power to the component. For a first example, if the first light emitter 104(1) includes sensor(s), such as a motion sensor, a camera, a light sensor, and/or the like, the first light emitter 104(1) may disable one or more of the sensor(s) based on the power level. For a second example, the first light emitter 104(1) may disable the network interface(s) 138 and/or periodically disable the network interface(s) 138.

As used herein, a processor, such as the processor(s) 122, the processor(s) 130, and/or the processor(s) 136 may include multiple processors and/or a processor having multiple cores. Further, the processors may comprise one or more cores of different types. For example, the processors may include application processor units, graphic processing units, and so forth. In one implementation, the processor may comprise a microcontroller and/or a microprocessor. The processor(s) 122, the processor(s) 130, and/or the processor(s) 136 may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 122, the processor(s) 130, and/or the processor(s) 136 may possess its own local memory, which also may store program components, program data, and/or one or more operating systems.

The memory 128, the memory 134, and/or the memory 140 may include volatile and nonvolatile memory, removable and non-removable media implemented in any method or technology for storage of information, such as computer-readable instructions, data structures, program component, or other data. The memory 128, the memory 134, and/or the memory 140 includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory 128, the memory 134, and/or the memory 140 may be implemented as computer-readable storage media ("CRSM"), which may be any available physical media accessible by the processor(s) 122, the processor(s) 130, and/or the processor(s) 136 to execute instructions stored on the memory 128, the memory 134, and/or the memory 140. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s).

Further, functional components may be stored in the respective memories, or the same functionality may alternatively be implemented in hardware, firmware, application specific integrated circuits, field programmable gate arrays, or as a system on a chip (SoC). In addition, while not illustrated, each respective memory, such as the memory 128, the memory 134, and/or the memory 140, discussed herein may include at least one operating system (OS) component that is configured to manage hardware resource devices such as the network interface(s), the I/O devices of the respective apparatuses, and so forth, and provide various services to applications or components executing on the processors. Such OS component may implement a variant of the FreeBSD operating system as promulgated by the FreeBSD Project; other UNIX or UNIX-like variants; a variation of the Linux operating system as promulgated by Linus Torvalds; the FireOS operating system from Amazon.com Inc. of Seattle, Wash., USA; the Windows operating system from Microsoft Corporation of Redmond, Wash., USA; LynxOS as promulgated by Lynx Software Technologies, Inc. of San Jose, Calif.; Operating System Embedded (Enea OSE) as promulgated by ENEA AB of Sweden; and so forth.

The network interface(s) 124, the network interface(s) 132, and/or the network interface(s) 138 may enable messages between the remote system 108, the A/V device 102, and/or the light emitter(s) 104(1)-(6), and/or with one or more other remote systems, as well as other networked devices. The network interface(s) 124, the network interface(s) 132, and/or the network interface(s) 138 may include one or more network interface controllers (NICs) or other types of transceiver devices to send and receive messages over a network.

For instance, each of the network interface(s) 124, the network interface(s) 132, and/or the network interface(s) 138 may include a personal area network (PAN) component to enable messages over one or more short-range wireless message channels. For instance, the PAN component may enable messages compliant with at least one of the following standards IEEE 802.15. 4 (ZigBee), IEEE 802.15.1 (Bluetooth), IEEE 802.11 (WiFi), or any other PAN message protocol. Furthermore, each of the network interface(s) 124, the network interface(s) 132, and/or the network interface(s) 138 may include a wide area network (WAN) component to enable message over a wide area network.

Figure 2:
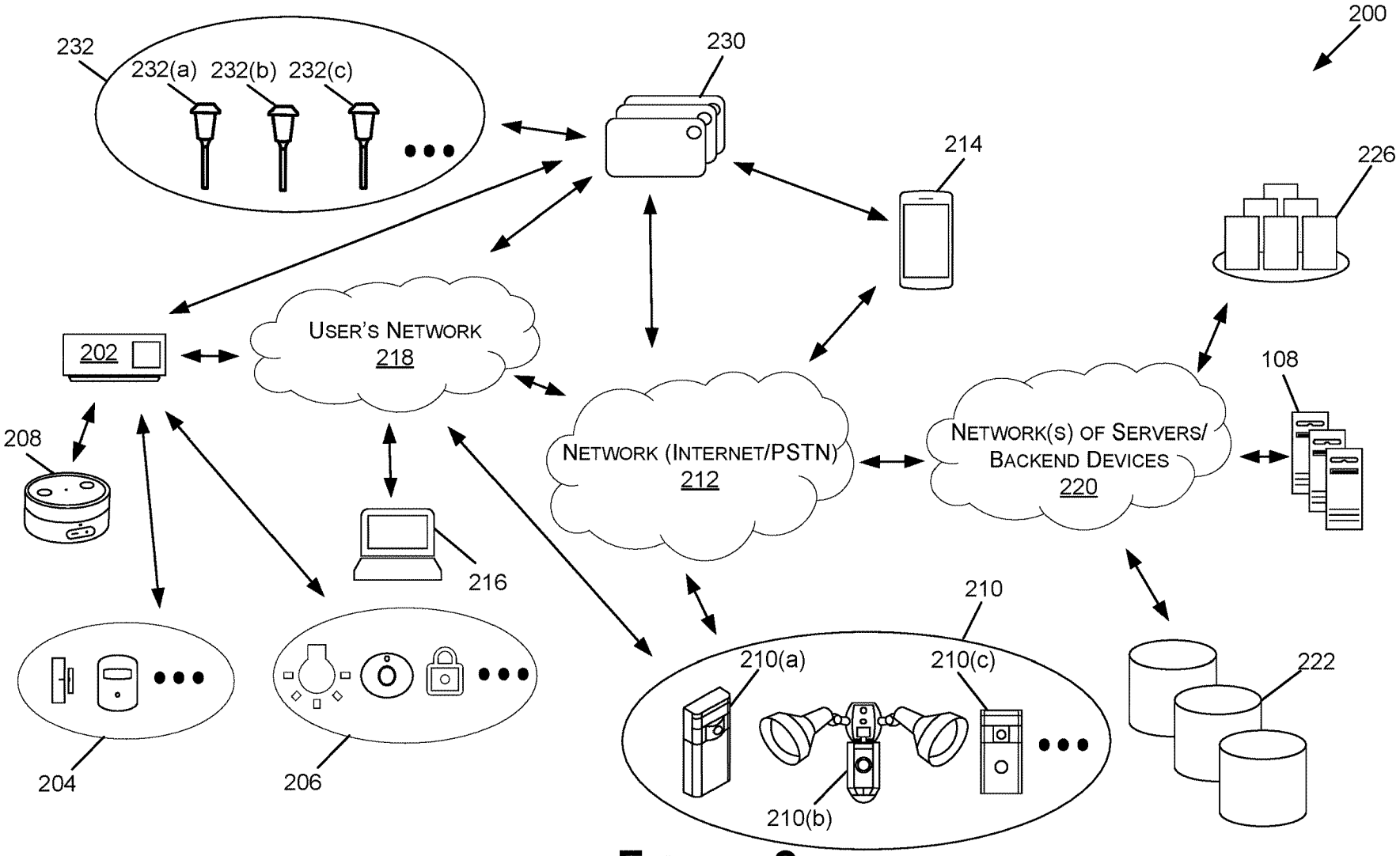
FIG. 2 is a functional block diagram illustrating a system for communicating in a network, according to various aspects of the present disclosure.

FIG. 2 is a functional block diagram illustrating a system 200 for communicating in a network according to various aspects of the present disclosure. Home automation, or smart home, is building automation for the home. Home automation enable users (e.g., homeowners and authorized individuals) to control and/or automate various devices and/or systems, such as lighting, heating (e.g., smart thermostats), ventilation, home entertainment, air conditioning (HVAC), blinds/shades, security devices (e.g., contact sensors, smoke/CO detectors, motion sensors, etc.), washers/dryers, ovens, refrigerators/freezers, and/or other network connected devices suitable for use in the home. In various embodiments, Wi-Fi is used for remote monitoring and control of such devices and/or systems. Smart home devices (e.g., hub devices 202, sensors 204, automation devices 206, a virtual assistant (VA) device 208, Audio/Video (A/V) devices 210, electronic device(s) 230 (although only one is shown for clarity reasons), light emitters 232), when remotely monitored and controlled via a network (Internet/a public switched telephone network (PSTN)) 212, may be considered to be components of the "Internet of Things." Smart home systems may include switches and/or sensors (e.g., the sensors 204) connected to a central hub such as the smart-home hub device 202 and/or the VA device 208 (the hub device 202 and/or the VA device 208 may alternatively be referred to as a gateway, a controller, a home-automation hub, or an intelligent personal assistance device) from which the system 200 may be controlled through various user interfaces, such as voice commands and/or a touchscreen. Various examples, of user interfaces may include any or all of a wall-mounted terminal (e.g., a keypad, a touchscreen, etc.), software installed on the client devices 214, 216 (e.g., a mobile application), a tablet computer, or a web interface. Furthermore, these user interfaces are often but not always supported by Internet cloud services. In one example, the Internet cloud services are responsible for obtaining user input via the user interfaces (e.g., a user interface of the hub device 202 and/or the VA device 208) and causing the smart home devices (e.g., the sensors 204, the automation devices 206, etc.) to perform an operation in response to the user input.

The hub device 202, the VA device 208, the sensors 204, the automation devices 206, the A/V devices 210, the electronic device(s) 230, the light emitters 232, and/or client devices 214, 216 may use one or more wired and/or wireless communication protocols to communicate, including, for example and without limitation, Wi-Fi (e.g., the user's network 218), X10, Ethernet, RS-485, 6LoWPAN, Bluetooth LE (BLE), ZigBee, Z-Wave, and/or a low power wide-area networks (LPWAN), such as a chirp spread spectrum (CSS) modulation technology network (e.g., LoRaWAN), an Ultra Narrow Band modulation technology network (e.g., Sigfox, Telensa, NB-IoT, etc.), RingNet, and/or the like.

The user's network 218 may be, for example, a wired and/or wireless network. If the user's network 218 is wireless, or includes a wireless component, the user's network 218 may be a Wi-Fi network compatible with the IEEE 802.11 standard and/or other wireless communication standard(s). Furthermore, the user's network 218 may be connected to other networks such as the network 212, which may comprise, for example, the Internet and/or PSTN.

The system 200 may include one or more A/V devices 210 (which may represent, and/or be similar to, the A/V device 102). The A/V devices 210 may include security cameras 210(*a*), light cameras 210(*b*) (e.g., floodlight cameras, spotlight cameras, etc.), A/V doorbells 210(*c*) (e.g., wall powered and/or battery powered A/V doorbells), and/or other devices capable of recording audio data and/or image data. The A/V devices 210 may be configured to access a user's network 218 to connect to a network (Internet/PSTN) 212 and/or may be configured to access a cellular network to connect to the network (Internet/PSTN) 212.

The system 200 may further include a smart-home hub device 202 connected to the user's network 218 and/or the network (Internet/PSTN) 212. The smart-home hub device 202 (also known as a home automation hub, gateway device, or network device(s)), may comprise any device that facilitates communication with and control of the sensors 204, automation devices 206, the VA device 208, the electronic device(s) 230, the light emitters 232, and/or the one or more A/V devices 210. For example, the smart-home hub device 202 may be a component of a security system and/or a home automation system installed at a location (e.g., a property, a premise, a home, a business, etc.). In some embodiments, the A/V devices 210, the VA device 208, the sensors 204, the electronic device(s) 230, the light emitters 232, and/or the automation devices 206 communicate with the smart-home hub device 202 directly and/or indirectly using one or more wireless and/or wired communication protocols (e.g., BLE, Zigbee, Z-Wave, etc.), the user's network 218 (e.g., Wi-Fi, Ethernet, etc.), and/or the network (Internet/PSTN) 212. In some of the present embodiments, the A/V devices 210, the VA device 208, the sensors 204, the electronic device(s) 230, the light emitters 232, and/or the automation devices 206 may, in addition to or in lieu of communicating with the smart-home hub device 202, communicate with the client devices 214, 216, the VA device 208, and/or one or more of components of the network of servers/backend devices 220 directly and/or indirectly via the user's network 218 and/or the network (Internet/PSTN) 212.

As illustrated in FIG. 2, the system 200 includes the VA device 208. The VA device 208 may be connected to the user's network 218 and/or the network (Internet/PSTN) 212. The VA device 208 may include an intelligent personal assistant, such as, without limitation, Amazon Alexa® and/or Apple Siri®. For example, the VA device 208 may be configured to receive voice commands, process the voice commands to determine one or more actions and/or responses (e.g., send the voice commands to the one or more components of the network of servers/backend devices 220 for processing), and perform the one or more actions and/or responses, such as to activate and/or change the status of one or more of the sensors 204, automation devices 206, the electronic device(s) 230, the light emitters 232, or the A/V devices 210. In some embodiments, the VA device 208 is configured to process user inputs (e.g., voice commands) without sending information to the network of servers/backend devices 220 for processing. The VA device 208 may include at least one speaker (e.g., for playing music, for outputting the audio data generated by the A/V devices 210, for outputting the voice of a digital assistant, etc.), at least one a microphone (e.g., for receiving commands, for recording audio data, etc.), and a display (e.g., for displaying a user interface, for displaying the image data generated by the A/V devices 210, etc.). In various embodiments, the VA device 208 may include an array of speakers that are able to produce beams of sound.

Although illustrated as a separate component in FIG. 2, in some embodiments the VA device 208 may not be a separate component from the hub device 202. In such embodiments, the hub device 202 may include the functionality of the VA device 208 or the VA device 208 may include the functionality of the hub device 202.

The VA device 208, the hub device 202, and/or the combination thereof may be configured to communicate with the A/V devices 210 in response to inputs (e.g., voice inputs, touch inputs, etc.) from users. For example, the VA device 208, the hub device 202, and/or the combination thereof may receive an input indicating a request to turn on the exterior lights (e.g., the light emitter(s) 232). The VA device 208, the hub device 202, and/or the combination thereof may then generate and send data representative of the input to the A/V device(s) 210 over the first network. In some examples, the data representative of the input is sent to the A/V device(s) 210 over the first network and/or the network (Internet/PSTN) 212 via the remote system 108. In other examples, the data representative of the input is sent directly to the A/V device(s) 210 over the first network.

The one or more sensors 204 may include, for example, at least one of a door sensor, a window sensor, a contact sensor, a tilt sensor, a temperature sensor, a carbon monoxide sensor, a smoke detector, a light sensor, a glass break sensor, a freeze sensor, a flood sensor, a moisture sensor, a motion sensor, and/or other sensors that may provide the user/owner of the security system a notification of a security event at his or her property.

The one or more automation devices 206 may include, for example, at least one of an outdoor lighting system, an indoor lighting system, and indoor/outdoor lighting system, a temperature control system (e.g., a thermostat), a shade/blind control system, a locking control system (e.g., door lock, window lock, etc.), a home entertainment automation system (e.g., TV control, sound system control, etc.), an irrigation control system, a wireless signal range extender (e.g., a Wi-Fi range extender, a Z-Wave range extender, etc.) a doorbell chime, a barrier control device (e.g., an automated door hinge), a smart doormat, and/or other automation devices. In some examples, the electronic device(s) 230 and/or the light emitters 232 may be considered automation devices and/or may be considered part of an automation device or system (e.g., an outdoor lighting system, an indoor lighting system, and indoor/outdoor lighting system, etc.).

As described herein, in some of the present embodiments, some or all of the client devices 214, 216, the A/V device(s) 210, the smart-home hub device 202, the VA device 208, the sensors 204, the automation devices 206, the electronic device(s) 230, and the light emitters 232, may be referred to as a security system and/or a home-automation system. The security system and/or home-automation system may be installed at location, such as a property, home, business, or premises for the purpose of securing and/or automating all or a portion of the location.

The system 200 may further include one or more client devices 214, 216 (which may represent, and/or be similar to, the client device 144). The client devices 214, 216 may communicate with and/or be associated with (e.g., capable of access to and control of) the A/V devices 210, a smart-home hub device 202, the VA device 208, sensors 204, automation devices 206, the electronic device(s) 230, and/or the light emitters 232. In various embodiments, the client devices 214, 216 communicate with other devices using one or more wireless and/or wired communication protocols, the user's network, and/or the network (Internet/PSTN) 212, as described herein. The client devices 214, 216 may comprise, for example, a mobile device such as a smartphone or a personal digital assistant (PDA), or a computing device such as a tablet computer, a laptop computer, a desktop computer, etc. In some embodiments, the client devices 214, 216 includes a connected device, such as a smart watch, Bluetooth headphones, another wearable device, or the like. In such embodiments, the client devices 214, 216 may include a combination of the smartphone or other device and a connected device (e.g., a wearable device), such that alerts, data, and/or information received by the smartphone or other device are provided to the connected device, and one or more controls of the smartphone or other device may be input using the connected device (e.g., by touch, voice, etc.).

The A/V devices 210, the hub device 202, the VA device 208, the automation devices 206, the sensors 204, the electronic device(s) 230, the light emitters 232, and/or the client devices 214, 216 may also communicate, via the user's network 218 and/or the network (Internet/PSTN) 212, with network(s) of servers and/or backend devices 220, such as (but not limited to) one or more remote storage devices 222 (may be referred to interchangeably as "cloud storage device(s)"), one or more remote system 108 (which may represent, and/or be similar to, the remote system 108), and one or more backend application programming interfaces (APIs) 226. While FIG. 2 illustrates the storage device 222, the remote system 108, and the backend API 226 as components separate from the network 220, it is to be understood that the storage device 222, the remote system 108, and/or the backend API 226 may be considered to be components of the network 220. For example, the network 220 may include a data center with a plurality of computing resources used to implement the storage device 222, the remote system 108, and the backend API 226.

The remote system 108 may comprise a computer program or other computer executable code that, when executed by processor(s) of the remote system 108, causes the remote system 108 to wait for requests from other computer systems or software (clients) and provide responses. In an embodiment, the remote system 108 shares data and/or hardware and/or software resources among the client devices 214, 216. This architecture is called the client-server model. The client devices 214, 216 may run on the same computer or may connect to the remote system 108 over the network (Internet/PSTN) 212 and/or the network 220. Examples of computing servers include database servers, file servers, mail servers, print servers, web servers, game servers, and application servers. The term server may be construed broadly to include any computerized process that shares a resource to one or more client processes.

The backend API 226 may comprise, for example, a server (e.g. a real server, or a virtual machine, or a machine running in a cloud infrastructure as a service), or multiple servers networked together, exposing at least one API to clients. In various embodiments, the backend API 226 is provided by servers including various components such as an application server (e.g. software servers), a caching layer, a database layer, or other components suitable for implementing one or more APIs. The backend API 226 may, for example, comprise a plurality of applications, each of which communicate with one another using one or more public APIs. In some embodiments, the backend API 226 maintains user data and provides user management capabilities, thereby reducing the load (e.g., memory and processor consumption) of the client devices 214, 216.

In various embodiments, an API is a set of routines, protocols, and tools for building software and applications. Furthermore, the API may describe a software component in terms of its operations, inputs, outputs, and underlying types, defining functionalities that are independent of their respective implementations, which allows definitions and implementations to vary without compromising the interface. As such, the API may provide a programmer with access to a particular application's functionality without the need to modify the particular application.

The backend API 226 illustrated in FIG. 2 may further include one or more services (also referred to as network services). A network service is an application that provides data storage, manipulation, presentation, communication, and/or other capability. Network services are often implemented using a client-server architecture based at least in part on application-layer network protocols. Each service may be provided by a server component (e.g., the remote system 108) running on one or more computers (such as a dedicated server computer offering multiple services) and accessed via a network by client components running on other devices (e.g., client devices 214, 216). However, the client and server components can both be run on the same machine. Clients and servers may have a user interface, and sometimes other hardware associated with them.

The network 220 may be any wireless network, any wired network, or a combination thereof, configured to operatively couple the above-mentioned components, devices, components, and/or systems as illustrated in FIG. 2. For example, the network 220, the user's network 218, and/or the network (Internet PSTN) 212 may include one or more of the following: a PSTN (public switched telephone network), the Internet, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, a Digital Data Service (DDS) connection, a DSL (Digital Subscriber Line) connection, an Ethernet connection, an ISDN (Integrated Services Digital Network) line, a dial-up port such as a V.90, V. 34, or V. 34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), LTE, VoLTE, LoRaWAN, LPWAN, RPMA, LTE Cat-"X" (e.g. LTE Cat 1, LTE Cat 0, LTE CatM1, LTE Cat NB1), CDMA (Code Division Multiple Access), TDMA (Time Division Multiple Access), FDMA (Frequency Division Multiple Access), and/or OFDMA (Orthogonal Frequency Division Multiple Access) cellular phone networks, global navigation satellite system (GNSS), such as global positioning systems (GPS), CDPD (cellular digital packet data), RIM (Research in Motion, Limited) duplex paging network, Bluetooth radio, or an IEEE 802.11-based radio frequency network. The network can further include or interface with any one or more of the following: RS-232 serial connection, IEEE-4024 (Firewire) connection, Fibre Channel connection, IrDA (infrared) port, SCSI (Small Computer Systems Interface) connection, USB (Universal Serial Bus) connection, or other wired or wireless, digital or analog, interface or connection, mesh or Digi® networking.

The system 200 may also include the electronic device(s) 230. The electronic device(s) 230 may be configured to control the light emitters 232. For example, one or more of the electronic device(s) 230 may include, but is not limited to, a transformer, a light switch, a power source, a light controller, and/or any other type of device that is cable of controlling the light emitters 232. The light emitters 232 may include pathway lights, walkway lights, floodlights, spotlights, security lights, dome lights, entryway lights, garden lights, outdoor lights, indoor lights, landscape lighting, accent lighting, wall sconces, bullets, globes, and/or any other type of electronic device that includes a light source capable of emitting light.

In some examples, the light emitters 232 (which may represent, and/or be similar to, the light emitters 104(1)-(6)) may include at least a first type of light emitter 232(1), a second type of light emitter 232(2), and a third type of light emitter 232(3). The first type of light emitters 232(1) may be configured to receive power from the electronic device(s) 230 (and/or another external power source). To control the first type of light emitters 232(1), the electronic device(s) 230 may begin to provide power to the first type of light emitters 232(1) to activate (e.g., turn on, cause to emit light, etc.) the first type of light emitters 232(1) and cease providing the power the deactivate (e.g., turn off, cause to cease emitting the light, etc.) the first type of light emitters 232(1). Additionally, the second type of light emitters 232(2) may be configured to receive power from the electronic device(s) 230 (and/or another external power source). To control the second type of light emitters 232(2), network device(s) may send first data to the second type of light emitters 232(2) that are configured to cause the second type of light emitters 232(2) to activate, and send second data to the second type of light emitters 232(2) that are configured to cause the second type of light emitters 232(2) to deactivate. Furthermore, the third type of light emitters 232(3) may be configured to receive power from a source that is external to the electronic device(s) 230, such as a battery. To control the third type of light emitters 232(3), network device(s) may send first data to the third type of light emitters 232(3) that are configured to cause the third type of light emitters 232(3) to activate, and send second data to the third type of light emitter 232(3) that are configured to cause the third type of light emitters 232(3) to deactivate.

In some examples, one or more of the electronic devices (e.g., the A/V devices 210, the hub device 202, the VA device 208, the automation devices 206, the sensors 204, the electronic device(s) 230, the light emitters 232, etc.) may be powered using external power sources. Additionally, in some examples, one or more of the electronic devices (e.g., the A/V devices 210, the hub device 202, the VA device 208, the automation devices 206, the sensors 204, the electronic device(s) 230, the light emitters 232, etc.) may be powered using internal power sources.

Figure 3:
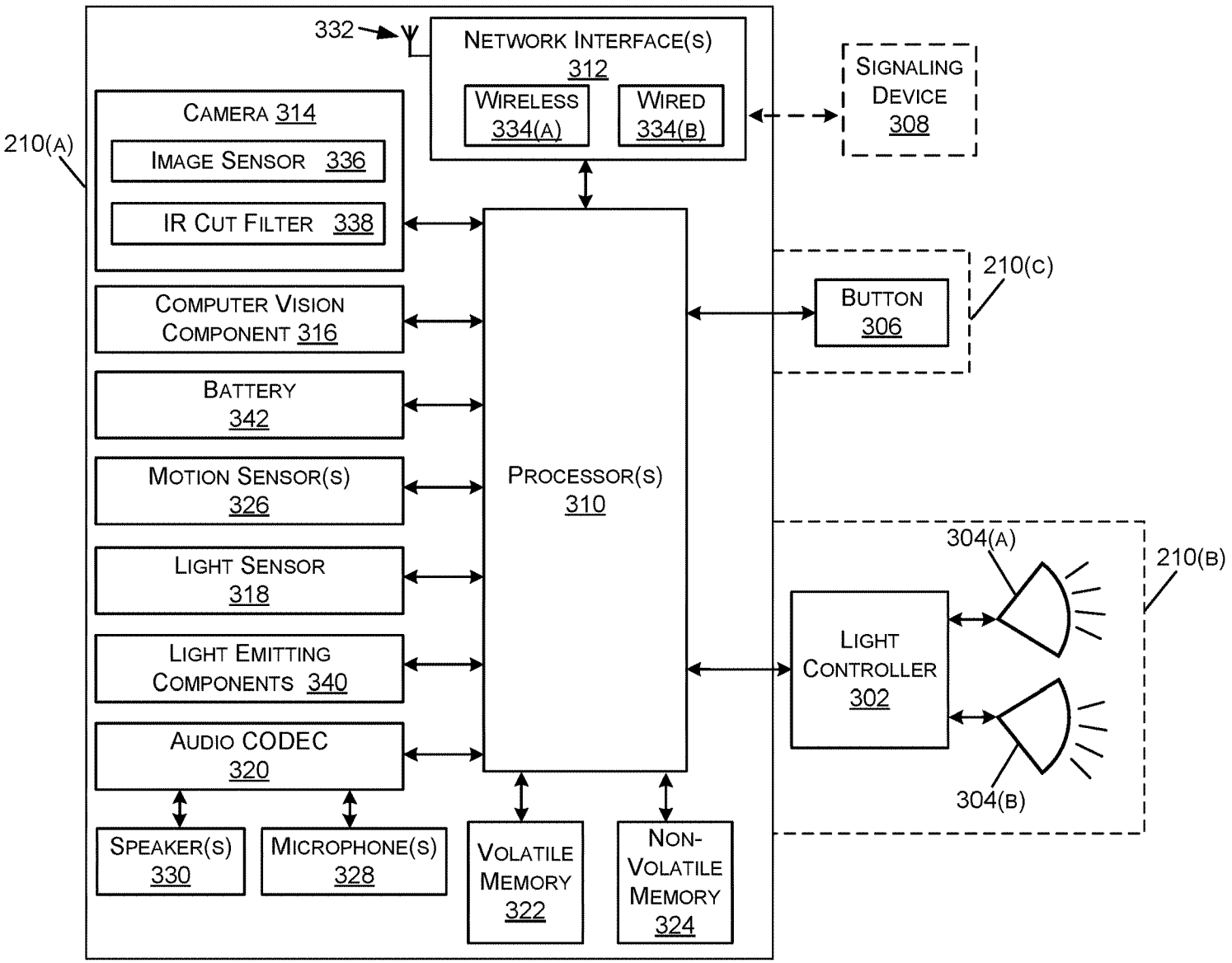
FIG. 3 is a functional block diagram illustrating one example embodiment of an A/V device, according to various aspects of the present disclosure.

FIG. 3 is a functional block diagram for an A/V device 210 according to various aspects of the present disclosure. In some embodiments, the one or more A/V devices 210 may include the security camera 210(*a*). In other embodiments, the one or more A/V devices 210 may include the light camera 210(*b*), which may include some or all of the components of the security camera 210(*a*) in addition to a light controller 302 and one or more lights (e.g., light sources) 304(*a*), 304(*b*). In some embodiments, the one or more A/V devices 210 may include the A/V doorbell 210(*c*), which may include some or all of the components of the security camera 210(*a*) in addition to a touch surface(s) 306, and in some embodiments, a connection to a signaling device 308 (e.g., a pre-installed signaling device, such as a wired signaling device, and/or a wireless signaling device, connected over Wi-Fi, BLE, or another wireless communication protocol).

With further reference to FIG. 3, the A/V device 210 may include a processor(s) 310, a network interface(s) 312, a camera 314, a computer vision component 316, a light sensor 318, an audio CODEC (coder-decoder) 320, volatile memory 322, and non-volatile memory 324. The processor(s) 310 (alternatively referred to herein as a "CPU," a "controller," and/or a "microcontroller) may comprise an integrated circuit including a processor core, memory, and programmable input/output peripherals. The processor(s) 310 may receive input signals, such as data and/or power, from the camera 314, motion sensor(s) 326, light sensor 318, microphone(s) 328, speaker(s) 330, and/or the network interface(s) 312, and may perform various functions as described in the present disclosure. In various embodiments, when the processor(s) 310 is triggered by the motion sensor(s) 326, the camera 314, the speaker(s) 330, the microphone(s) 328, the network interface(s) 312, and/or another component, the processor(s) 310 performs one or more processes and/or functions. For example, when the light sensor 318 detects a low level of ambient light, the light sensor 318 may trigger the processor(s) 310 to enable a night vision camera mode. The processor(s) 310 may also provide data communication between various components such as between the network interface(s) 312 and the camera 314.

With further reference to FIG. 3, the network interface(s) 312 may comprise an integrated circuit including a processor core, memory, and programmable input/output peripherals. The network interface(s) 312 may be operatively connected to the processor(s) 310. In some embodiments, the network interface(s) 312 is configured to handle communication links between the A/V device 210 and other, external devices, external receivers, external transmitters, and/or external transceivers, and to route incoming/outgoing data appropriately. For example, inbound data from an antenna 332 of the network interface(s) 312 may be routed through the network interface(s) 312 before being directed to the processor(s) 310, and outbound data from the processor(s) 310 may be routed through the network interface(s) 312 before being directed to the antenna 332 of the network interface(s) 312. As another example, the network interface(s) 312 may be configured to send data to and/or receive data from a remote network device(s) (e.g., one or more components of the network(s) of servers/backend devices 220 described in FIG. 2). The network interface(s) 312 may include wireless 334(*a*) and wired 334(*b*) adapters. For example, the network interface(s) 312 may include one or more wireless antennas, radios, receivers, transmitters, and/or transceivers (not shown in FIG. 3 for simplicity) configured to enable communication across one or more wireless networks, such as, without limitation, Wi-Fi, cellular, Bluetooth, Z-Wave, Zigbee, LPWAN(s), and/or satellite networks. The network interface(s) 312 may receive inputs, such as power and/or data, from the camera 314, the processor(s) 310, the button 306 (in embodiments where the A/V device 210 is the video doorbell 210(*c*)), the motion sensors 326, a reset button (not shown in FIG. 3 for simplicity), and/or the non-volatile memory 324. The network interface(s) 312 may also include the capability of communicating over wired connections, such as with a signaling device 308. For example, when the button 306 of the video doorbell 210(*c*) is pressed, the network interface(s) 312 may be triggered to perform one or more functions, such as to send a signal over the wired 334(*b*) connection to the signaling device 308 (although, in some embodiments, the signal be sent over a wireless 334(*a*) connection to the signaling device) to cause the signaling device 308 to emit a sound (e.g., a doorbell tone, a user customized sound, a ringtone, a seasonal ringtone, etc.). The network interface(s) 312 may also act as a conduit for data communicated between various components and the processor(s) 310.

With further reference to FIG. 3, the A/V device 210 may include the non-volatile memory 324 and the volatile memory 322. The non-volatile memory 324 may comprise flash memory configured to store and/or send data. For example, in certain embodiments the non-volatile memory 324 may comprise serial peripheral interface (SPI) flash memory. In some embodiments, the non-volatile memory 324 may comprise, for example, NAND or NOR flash memory. The volatile memory 322 may comprise, for example, DDR3 SDRAM (double data rate type three synchronous dynamic random-access memory). In the embodiment illustrated in FIG. 3, the volatile memory 322 and the non-volatile memory 324 are illustrated as being separate from the processor(s) 310. However, the illustration of FIG. 3 is not intended to be limiting, and in some embodiments the volatile memory 322 and/or the non-volatile memory 324 may be physically incorporated with the processor(s) 310, such as on the same chip. The volatile memory 322 and/or the non-volatile memory 324, regardless of their physical location, may be shared by one or more other components (in addition to the processor(s) 310) of the present A/V device 210.

With further reference to FIG. 3, the A/V device 210 may include the camera 314. The camera 314 may include an image sensor 336. The image sensor 336 may include a video recording sensor and/or a camera chip. In one aspect of the present disclosure, the imager sensor 336 may comprise a complementary metal-oxide semiconductor (CMOS) array and may be capable of recording high definition (e.g., 722p, 1800p, 4K, etc.) video files. The camera 314 may include a separate camera processor (not shown in FIG. 3 for simplicity), or the processor(s) 310 may perform the camera processing functionality. The processor(s) 310 (and/or camera processor) may include an encoding and compression chip. In some embodiments, the processor(s) 310 (and/or the camera processor) may comprise a bridge processor. The processor(s) 310 (and/or the camera processor) may process video recorded by the image sensor 336 and/or audio recorded by the microphone(s) 328, and may transform this data into a form suitable for transfer by the network interface(s) 312 to the network (Internet/PSTN) 212. In various embodiments, the camera 314 also includes memory, such as volatile memory that may be used when data is being buffered or encoded by the processor(s) 310 (and/or the camera processor). For example, in certain embodiments the camera memory may comprise synchronous dynamic random-access memory (SD RAM).

The camera 314 may further include an IR cut filter 338 that may comprise a system that, when triggered, configures the image sensor 336 to see primarily infrared light as opposed to visible light. For example, when the light sensor 318 detects a low level of ambient light (which may comprise a level that impedes the performance of the image sensor 336 in the visible spectrum), a light-emitting components 340 may shine infrared light through an enclosure of the A/V device 210 out to the environment, and the IR cut filter 338 may enable the image sensor 336 to see this infrared light as it is reflected or refracted off of objects within the field of view of the doorbell. This process may provide the A/V device with the "night vision" function mentioned above.

With further reference to FIG. 3, the A/V device 210 may comprise the light sensor 318 and the one or more light-emitting components 340, such as LED's. The light sensor 318 may be one or more sensors capable of detecting the level of ambient light of the surrounding environment in which the A/V device 210 may be located. The light-emitting components 340 may be one or more light-emitting diodes capable of producing visible light when supplied with power (e.g., to enable night vision). In some embodiments, when activated, the light-emitting components 340 illuminates a light pipe.

The A/V device 210 may further include one or more speaker(s) 330 and/or one or more microphone(s) 328. The speaker(s) 330 may be any electromechanical device capable of producing sound in response to an electrical signal input. The microphone(s) 328 may be an acoustic-to-electric transducer or sensor capable of converting sound waves into an electrical signal. In some embodiments, the A/V device 210 may include two or more microphone(s) 328 that are spaced from one another (e.g., located on different sides of the A/V device 210) to provide noise cancelling and/or echo cancelling for clearer audio. The speaker(s) 330 and/or microphone(s) 328 may be coupled to an audio CODEC 320 to enable digital audio received by client devices to be decompressed and output by the speaker(s) 330 and/or to enable audio data captured by the microphone(s) 328 to be compressed into digital audio data. The digital audio data may be received from and sent to client devices using the network interface(s) 312 (in some embodiments, through one or more intermediary devices such as the hub device 202, the VA device 208, and/or one or more components of the network of servers/backend devices 220 as described in FIG. 2). For example, when a visitor (or intruder) who is present in the area about the A/V device 210 speaks, sound from the visitor (or intruder) is received by the microphone(s) 328 and compressed by the audio CODEC 320. Digital audio data is then sent through the network interface(s) 312 to the network 212 via the user's network 218, routed by the remote system 108 and/or the backend API 226 and delivered to the client device(s) 214, 216 as described above in connection with FIG. 2. When the user speaks, after being transferred through the network 212, the user's network 218, and the network interface(s) 312, the digital audio data from the user is decompressed by the audio CODEC 320 and emitted to the visitor through the speaker(s) 330.

With further reference to FIG. 3, the A/V device 210 may be battery powered using a battery 342 and/or may be powered using a source of external AC (alternating-current) power, such as a household AC power supply (alternatively referred to herein as "AC mains" or "wall power"). The AC power may have a voltage in the range of 112-220 VAC, for example. The incoming AC power may be received by an AC/DC adapter (not shown), which may convert the incoming AC power to DC (direct-current) and may step down the voltage from 112-220 VAC to a lower output voltage of about 12 VDC and an output current of about 2 A, for example. In various embodiments, the output of the AC/DC adapter is in a range from about 9 V to about 15 V and in a range from about 0.5 A to about 5 A. These voltages and currents are examples provided for illustration and are not intended to be limiting.

However, in other embodiments, a battery 342 may not be included. In embodiments that include the battery 342, the A/V device 210 may include an integrated circuit (not shown) capable of arbitrating between multiple voltage rails, thereby selecting the source of power for the A/V device 210. The A/V device 210 may have separate power rails dedicated to the battery 342 and the AC power source. In one aspect of the present disclosure, the A/V device 210 may continuously draw power from the battery 342 to power the A/V device 210, while at the same time routing the AC power to the battery, thereby allowing the battery 342 to maintain a substantially constant level of charge. Alternatively, the A/V device 210 may continuously draw power from the AC power to power the doorbell, while only drawing from the battery 342 when the AC power is low or insufficient. Still, in some embodiments, the battery 342 comprises the sole source of power for the A/V device 210. In such embodiments, the components of the A/V device 210 (e.g., spring contacts, connectors, etc.) are not be connected to a source of AC power. When the battery 342 is depleted of its charge, it may be recharged, such as by connecting a power source to the battery 342 (e.g., using a USB connector).

Although not illustrated in FIG. 3, in some embodiments, the A/V device 210 may include one or more of an accelerometer, a barometer, a humidity sensor, and a temperature sensor. The accelerometer may be one or more sensors capable of sensing motion and/or acceleration. The one or more of the accelerometer, the barometer, the humidity sensor, and the temperature sensor may be located outside of a housing of the A/V device 210 so as to reduce interference from heat, pressure, moisture, and/or other stimuli generated by the internal components of the A/V device 210.

With further reference to FIG. 3, the A/V device 210 may include one or more motion sensor(s) 326. However, in some embodiments, the motion sensor(s) 326 may not be included, such as where motion detection is performed by the camera 314 or another device. The motion sensor(s) 326 may be any type of sensor capable of detecting and communicating the presence of an object within their field of view. As such, the motion sensor(s) 326 may include one or more (alone or in combination) different types of motion sensors. For example, in some embodiments, the motion sensor(s) 326 may comprise passive infrared (PIR) sensors, which may be secured on or within a PIR sensor holder that may reside behind a lens (e.g., a Fresnel lens). In such an example, the PIR sensors may detect IR radiation in a field of view, and produce an output signal (typically a voltage) that changes as the amount of IR radiation in the field of view changes. The amount of voltage in the output signal may be compared, by the processor(s) 310, for example, to one or more threshold voltage values to determine if the amount of voltage in the output signal is indicative of motion, and/or if the amount of voltage in the output signal is indicative of motion of an object that is to be captured by the camera 314 (e.g., motion of a person and/or animal may prompt activation of the camera 314, while motion of a vehicle may not). Although the above discussion of the motion sensor(s) 326 primarily relates to PIR sensors, depending on the embodiment, the motion sensor(s) 326 may include additional and/or alternate sensor types that produce output signals including alternative data types. For example, and without limitation, the output signal may include an amount of voltage change based at least in part on the presence of infrared radiation in a field of view of an active infrared (AIR) sensor, the output signal may include phase shift data from a microwave-type motion sensor, the output signal may include doppler shift data from an ultrasonic-type motion sensor, the output signal may include radio wave disturbance from a tomographic-type motion sensor, and/or the output signal may include other data types for other sensor types that may be used as the motion sensor(s) 326 of the A/V device 210.

In some embodiments, computer vision component(s) (CVM) 316 may be included in the A/V device 210 as the motion sensor(s) 326, in addition to, or alternatively from, other motion sensor(s) 326. For example, the CVM 316 may be a low-power CVM (e.g., Qualcomm Glance) that, by operating at low power (e.g., less than 2 mW of end-to-end power), is capable of providing computer vision capabilities and functionality for battery powered devices (e.g., the A/V device 210 when powered by the battery 342). The low-power CVM may include a lens, a CMOS image sensor, and a digital processor that may perform embedded processing within the low-power CVM itself, such that the low-power CVM may output post-processed computer vision metadata to the processor(s) 310 (e.g., via a serial peripheral bus interface (SPI)). As such, the low-power CVM may be considered to be one or more of the motion sensor(s) 326, and the data type output in the output signal may be the post-processed computer vision metadata. The metadata may include information such as the presence of a particular type of object (e.g., person, animal, vehicle, parcel, etc.), a direction of movement of the object, a distance of the object from the A/V device 210, etc. In various embodiments, the motion sensor(s) 326 include a plurality of different sensor types capable of detecting motion such as PIR, AIR, low-power CVM, and/or cameras.

As indicated above, the A/V device 210 may include the CVM 316 (which may be the same as the above described low-power CVM 316 implemented as one or more motion sensor(s) 326, or may be additional to, or alternative from, the above described low-power CVM 316). For example, the A/V device 210, the hub device 202, the VA device 208, and/or one or more component of the network(s) of servers/backend devices 220 may perform any or all of the computer vision processes and functionalities described herein. In addition, although the CVM 316 is only illustrated as a component of the A/V device 210, the computer vision component 316 may additionally, or alternatively, be included as a component of the hub device 202, the VA device 208, and/or one or more components of the network of servers/backend devices 220. With respect to the A/V device 210, the CVM 316 may include any of the components (e.g., hardware) and/or functionality described herein with respect to computer vision, including, without limitation, one or more cameras, sensors, and/or processors. In some of the present embodiments, with reference to FIG. 3, the microphone(s) 328, the camera 314, the processor(s) 310, and/or the image sensor 336 may be components of the CVM 316. In some embodiments, the CVM 316 may include an internal camera, image sensor, and/or processor, and the CVM 316 may output data to the processor(s) 310 in an output signal, for example.

As a result of including the CVM 316, some of the present embodiments may leverage the CVM 316 to implement computer vision for one or more aspects, such as motion detection, object recognition, and/or facial recognition. Computer vision includes methods for acquiring, processing, analyzing, and understanding images and, in general, high-dimensional data from the real world in order to produce numerical or symbolic information, e.g., in the form of decisions. Computer vision seeks to duplicate the abilities of human vision by electronically perceiving and understanding an image. Understanding in this context means the transformation of visual images (the input of the retina) into descriptions of the world that can interface with other thought processes and elicit appropriate action. This image understanding can be seen as the disentangling of symbolic information from image data using models constructed with the aid of geometry, physics, statistics, and learning theory. Computer vision has also been described as the enterprise of automating and integrating a wide range of processes and representations for vision perception. As a scientific discipline, computer vision is concerned with the theory behind artificial systems that extract information from images. The image data can take many forms, such as video sequences, views from multiple cameras, or multi-dimensional data from a scanner.

One aspect of computer vision comprises determining whether or not the image data contains some specific object, feature, or activity. Different varieties of computer vision recognition include: Object Recognition (also called object classification)—One or several pre-specified or learned objects or object classes can be recognized, usually together with their 2D positions in the image or 3D poses in the scene. Identification—An individual instance of an object is recognized. Examples include identification of a specific person's face or fingerprint, identification of handwritten digits, or identification of a specific vehicle. Detection—The image data are scanned for a specific condition. Examples include detection of possible abnormal cells or tissues in medical images or detection of a vehicle in an automatic road toll system. Detection based at least in part on relatively simple and fast computations is sometimes used for finding smaller regions of interesting image data that can be further analyzed by more computationally demanding techniques to produce a correct interpretation.

Several specialized tasks based at least in part on computer vision recognition exist, such as: Optical Character Recognition (OCR)—Identifying characters in images of printed or handwritten text, usually with a view to encoding the text in a format more amenable to editing or indexing (e.g., ASCII). 2D Code Reading—Reading of 2D codes such as data matrix and QR codes. Facial Recognition. Shape Recognition Technology (SRT)—Differentiating human beings (e.g., head and shoulder patterns) from objects.

Image acquisition—A digital image is produced by one or several image sensors, which, besides various types of light-sensitive cameras, may include range sensors, tomography devices, radar, ultra-sonic cameras, etc. Depending on the type of sensor, the resulting image data may be a 2D image, a 3D volume, or an image sequence. The pixel values may correspond to light intensity in one or several spectral bands (gray images or color images), but can also be related to various physical measures, such as depth, absorption or reflectance of sonic or electromagnetic waves, or nuclear magnetic resonance.

Pre-processing—Before a computer vision method can be applied to image data in order to extract some specific piece of information, it is usually beneficial to process the data in order to assure that it satisfies certain assumptions implied by the method. Examples of pre-processing include, but are not limited to re-sampling in order to assure that the image coordinate system is correct, noise reduction in order to assure that sensor noise does not introduce false information, contrast enhancement to assure that relevant information can be detected, and scale space representation to enhance image structures at locally appropriate scales.

Feature extraction—Image features at various levels of complexity are extracted from the image data. Typical examples of such features are: Lines, edges, and ridges; Localized interest points such as corners, blobs, or points; More complex features may be related to texture, shape, or motion.

Detection/segmentation—At some point in the processing a decision may be made about which image points or regions of the image are relevant for further processing. Examples are: Selection of a specific set of interest points; Segmentation of one or multiple image regions that contain a specific object of interest; Segmentation of the image into nested scene architecture comprising foreground, object groups, single objects, or salient object parts (also referred to as spatial-taxon scene hierarchy).

High-level processing—At this step, the input may be a small set of data, for example a set of points or an image region that is assumed to contain a specific object. The remaining processing may comprise, for example: Verification that the data satisfy model-based and application-specific assumptions; Estimation of application-specific parameters, such as object pose or object size; Image recognition—classifying a detected object into different categories; Image registration—comparing and combining two different views of the same object.

Decision making—Making the final decision required for the application, for example match/no-match in recognition applications.

One or more of the present embodiments may include a vision processing unit (not shown separately, but may be a component of the CVM 316). A vision processing unit is an emerging class of microprocessor; it is a specific type of AI (artificial intelligence) accelerator designed to accelerate machine vision tasks. Vision processing units are distinct from video processing units (which are specialized for video encoding and decoding) in their suitability for running machine vision algorithms such as convolutional neural networks, SIFT, etc. Vision processing units may include direct interfaces to take data from cameras (bypassing any off-chip buffers), and may have a greater emphasis on on-chip dataflow between many parallel execution units with scratchpad memory, like a manycore DSP (digital signal processor). But, like video processing units, vision processing units may have a focus on low precision fixed-point arithmetic for image processing.

Some of the present embodiments may use facial recognition hardware and/or software, as a part of the computer vision system. Various types of facial recognition exist, some or all of which may be used in the present embodiments.

Some face recognition identify facial features by extracting landmarks, or features, from an image of the subject's face. For example, an algorithm may analyze the relative position, size, and/or shape of the eyes, nose, cheekbones, and jaw. These features are then used to search for other images with matching features. Other algorithms po a gallery of face images and then compress the face data, only saving the data in the image that is useful for face recognition. A probe image is then compared with the face data. One of the earliest successful systems is based at least in part on template matching techniques applied to a set of salient facial features, providing a sort of compressed face representation.

Recognition algorithms can be divided into two main approaches, geometric, which looks at distinguishing features, or photometric, which is a statistical approach that distills an image into values and compares the values with templates to eliminate variances.

Popular recognition algorithms include principal component analysis using eigenfaces, linear discriminant analysis, elastic bunch graph matching using the Fisherface algorithm, the hidden Markov model, the multilinear subspace learning using tensor representation, and the neuronal motivated dynamic link matching.

Further, a newly emerging trend, claimed to achieve improved accuracy, is three-dimensional face recognition. This technique uses 3D sensors to capture information about the shape of a face. This information is then used to identify distinctive features on the surface of a face, such as the contour of the eye sockets, nose, and chin.

One advantage of 3D face recognition is that it is not affected by changes in lighting like other techniques. It can also identify a face from a range of viewing angles, including a profile view. Three-dimensional data points from a face vastly improve the precision of face recognition. 3D research is enhanced by the development of sophisticated sensors that do a better job of capturing 3D face imagery. The sensors work by projecting structured light onto the face. Up to a dozen or more of these image sensors can be placed on the same CMOS chip—each sensor captures a different part of the spectrum.

Another variation is to capture a 3D picture by using three tracking cameras that point at different angles; one camera pointing at the front of the subject, a second one to the side, and a third one at an angle. All these cameras work together to track a subject's face in real time and be able to face detect and recognize.

Another emerging trend uses the visual details of the skin, as captured in standard digital or scanned images. This technique, called skin texture analysis, turns the unique lines, patterns, and spots apparent in a person's skin into a mathematical space.

Another form of taking input data for face recognition is by using thermal cameras, which may only detect the shape of the head and ignore the subject accessories such as glasses, hats, or make up.

Further examples of automatic identification and data capture (AIDC) and/or computer vision that can be used in the present embodiments to verify the identity and/or authorization of a person include, without limitation, biometrics. Biometrics refers to metrics related to human characteristics. Biometrics authentication (or realistic authentication) is used in various forms of identification and access control. Biometric identifiers are the distinctive, measurable characteristics used to label and describe individuals. Biometric identifiers can be physiological characteristics and/or behavioral characteristics. Physiological characteristics may be related to the shape of the body. Examples include, but are not limited to, fingerprints, palm veins, facial recognition, three-dimensional facial recognition, skin texture analysis, DNA, palm prints, hand geometry, iris recognition, retina recognition, and odor/scent recognition. Behavioral characteristics may be related to the pattern of behavior of a person, including, but not limited to, typing rhythm, gait, and voice recognition.

The present embodiments may use any one, or any combination of more than one, of the foregoing biometrics to identify and/or authenticate a person who is either suspicious or who is authorized to take certain actions with respect to a property or expensive item of collateral. For example, with reference to FIG. 3, the CVM 316, and/or the camera 314 and/or the processor(s) 310 may receive information about the person using any one, or any combination of more than one, of the foregoing biometrics.

Again, with reference to FIG. 3, in embodiments where the A/V device 210 includes a light camera, the A/V device 210 may include the light controller 302 and one or more lights 304(*a*), 304(*b*) (collectively referred to herein as "lights 304"). The light controller 302 may include a switch for controlling the lights 304. For example, in response to the motions sensor(s) 326 and/or the camera 314 detecting motion, the light controller 302 may receive an output signal from the processor(s) 310 that causes the light controller 302 to activate the one or more lights 304(*a*), 304(*b*). In some embodiments, the light camera may include motion sensor(s) 326 detecting motion for controlling activation of the lights 304, and may further include the camera 314 for detecting motion for activating the recording of the image data using the camera 314 and/or the recording of the audio data using the microphone(s) 328. In other embodiments, the motion sensor(s) 326 may detect the motion for activating the lights 304, the camera 314, and the microphone(s) 328, or the camera 314 may detect the motion for activating the lights 304, the camera 314 to being recording the image data, and the microphone(s) 328 to being recording the audio data. The lights 304 may include floodlights, spotlights, porch lights, or another type of illumination device. The lights 304 may provide for better image data quality when ambient light levels are low (e.g., at dusk, dawn, or night), while also providing a deterrent effect by being illuminated when motion is detected.

Although the A/V device 210 is referred to herein as an "audio/video" device, the A/V device 210 need not have both audio and video functionality. For example, in some embodiments, the A/V device 210 may not include the speakers 330, microphones 328, and/or audio CODEC. In such examples, the A/V device 210 may only have video recording and communication functionalities. In other examples, the A/V device 210 may only have the speaker(s) 330 and not the microphone(s) 328, or may only have the microphone(s) 328 and not the speaker(s) 330.

In some examples, the A/V device 210 may operate as a "bridge" between other devices. For example, the A/V device 210 may receive first data that is sent from a first device, such as the remote system 108, where the first data includes is associated with a second device (e.g., the first data includes a command to be executed by the second device), such as a light emitter 232. The A/V device 210 may then send the first data to the second device. Additionally, the A/V device 210 may receive second data from the second device, where the second data is associated with the first device (e.g., the second data indicates that the command was executed). The A/V device 210 may then send the second data to the remote system 108. In some examples, the A/V device 210 may be sending/receiving the first data over a first network and be sending/receiving the second data over a second network. For example, the first network may include a wireless local area network, such as, but not limited to, the Internet, a local intranet, a Personal Area Network (PAN), a Local Area Network (LAN), a Wide Area Network (WAN), and/or the like. Additionally, the second network may include a low-power wide-area network (LPWAN), such as, but not limited to, a chirp spread spectrum (CSS) modulation technology network (e.g., LoRaWAN), an Ultra Narrow Band modulation technology network (e.g., Sigfox, Telensa, NB-IoT, etc.), RingNet, and/or the like.

Figure 4:
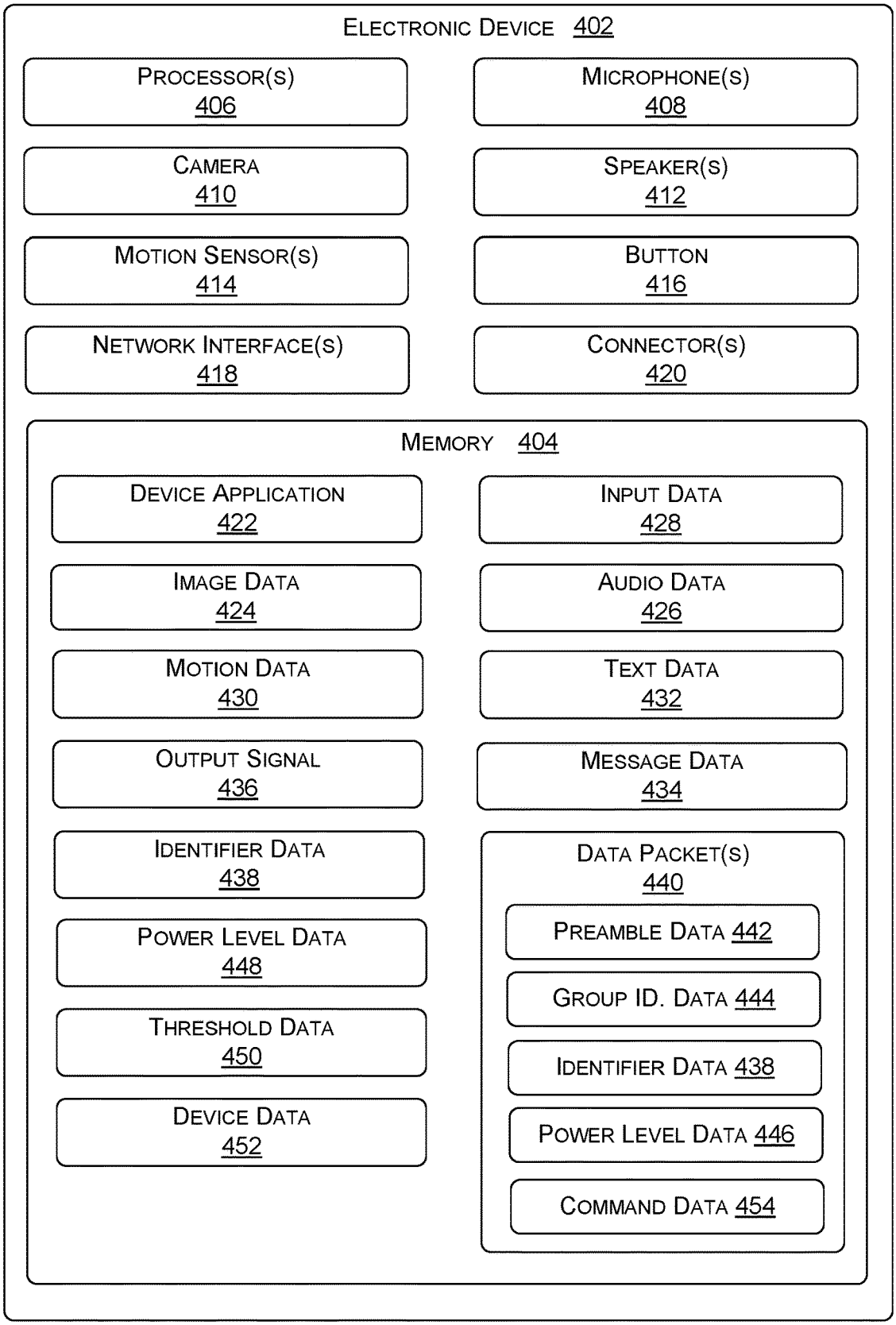
FIG. 4 is a functional block diagram illustrating one example embodiment of an electronic device, according to various aspects of the present disclosure.

FIG. 4 is a functional block diagram illustrating an embodiment of an electronic device 402, according to various aspects of the present disclosure. In some embodiments, the electronic device 402 may be similar, and/or represent, the A/V device 102, an A/V device 210, a hub device 202, a VA device 208, an automation device 206, a sensor 204, an electronic device 230, a light emitter 232, and/or any other type of device.

As shown in FIG. 4, the electronic device 402 includes memory 404 (which may represent, and/or be similar to, the memory 128, the volatile memory 322, and/or the non-volatile memory 324), processor(s) 406 (which may represent, and/or be similar to, the processor(s) 112 and/or the processor(s) 310), microphone(s) 408 (which may be similar to, and/or represent, the microphone(s) 328), a camera 410 (which may be similar to, and/or represent, the camera 114 and/or the camera 314), speaker(s) 412 (which may represent, and/or be similar to, the speaker(s) 330), motion sensor(s) 414 (which may represent, and/or be similar to, the sensor(s) 126 and/or the motion sensor(s) 326), a button 416 (which may represent, and/or be similar to, the button 306), and/or network interface(s) 418 (which may be similar to, and/or represent, the network interface(s) 124 and/or the network interface(s) 312). In some examples, the electronic device 402 may include one or more additional components not shown in FIG. 4. Additionally, in some examples, the electronic device 402 may omit one or more of the components shown in FIG. 4.

The memory 404 stores a device application 422. In various embodiments, the device application 422 may include instructions that cause the processor(s) 406 to generate image data 424 (which may represent, and/or be similar to, the image data 116) using the camera 410, audio data 426 using the microphone(s) 408, input data 428 using the button 416 (and/or the camera 410 and/or the motion sensor(s) 414, depending on the embodiment), and/or motion data 430 using the camera 410 and/or the motion sensor(s) 414. In some embodiments, the device application 422 may also include instructions that cause the processor(s) 406 to generate text data 432 describing the image data 424, the audio data 426, and/or the input data 428, such as in the form of metadata, for example.

In addition, the device application 422 may include instructions that cause the processor(s) 406 to send the image data 424, the audio data 426, the motion data 430, the input data 428, the text data 432, and/or the message data 434 (which may represent, and/or be similar to, the message data 148) representing message(s) to the client devices 214, 216, the hub device 202, and/or the remote system 108 using the network interface(s) 418. In various embodiments, the device application 422 may also include instructions that cause the processor(s) 406 to generate and send an output signal 436 that may include the image data 424, the audio data 426, the text data 432, the input data 428, and/or the motion data 430. In some of the present embodiments, the output signal 436 may be sent to the remote system 108 and/or the hub device 202 using the network interface(s) 418. The remote system 108 may then send (or forward) the output signal 436 to the client device(s) 214, 216, and/or the hub device 202 may then send (or forward) the output signal 436 to the client device(s) 214, 216, and/or the hub device 202 may then send (or forward) the output signal 436 to the remote system 108, and the remote system 108 may then send (or forward) the output signal 436 to the client device(s) 214, 216. In other embodiments, the output signal 436 may be sent directly to the client device(s) 214, 216 by the electronic device 402.

In further reference to FIG. 4, the image data 424 may comprise image sensor data, such as, but not limited to, exposure values and data regarding pixel values for a particular sized grid. The image data 424 may include still images, live video, and/or pre-recorded images and/or video. The image data 424 may be generated by the camera 410 in a field of view of the camera 410. The image data 424 may be representative of (e.g., depict) a physical environment in a field of view of the camera 410. In some embodiments, the physical environment may include one or more objects (e.g., persons, vehicles, animals, items, electronic devices, etc.), and the image data 424 may be representative of the one or more objects, such as the one or more objects within the physical environment.

In further reference to FIG. 4, the motion data 430 may comprise motion sensor data generated in response to motion events. For example, the motion data 430 may include an amount or level of a data type generated by the motion sensor(s) 414 (e.g., the voltage level output by the motion sensor(s) 414 when the motion sensor(s) 414 are PIR type motion sensor(s)). In some of the present embodiments, such as those where the electronic device 402 does not include the motion sensor(s) 414, the motion data 430 may be generated by the camera 410. In such embodiments, based at least in part on a frame by frame comparison of changes in the pixels from the image data 424, it may be determined that motion is present.

The input data 428 may include data generated in response to an input to the button 416. The button 416 may receive an input (e.g., a press, a touch, a series of touches and/or presses, etc.) and may generate the input data 428 in response that is indicative of the type of input. In embodiments where the electronic device 402 is not a doorbell (e.g., the video doorbell 210(*c*)), the electronic device 402 may not include the button 416, and the electronic device 402 may not generate the input data 428.

With further reference to FIG. 4, the processor(s) 406 may generate message data 434 representing message(s). As described herein, the message(s) may include push notifications, email messages, short message service (SMS) messages, multimedia messages (MMS), voicemail messages, video message, audio messages, data transmissions, and/or any other type of electronic communication that an electronic device can send to another electronic device. The electronic device 402 may then send, using the network interface(s) 418, the message data 434 to the client device 214, 216, the remote system 108, and/or the hub device 202. For example, in response to detecting motion using the camera 410 and/or the motion sensor(s) 414, the electronic device 402 may generate and send the message data 434. In some of the present examples, the electronic device 402 may further send the image data 424, the audio data 426, the text data 432, and/or the motion data 430.

The image data 424, the audio data 426, the text data 432, and/or the motion data 430 may be tagged with (e.g., a time stamp, based at least in part on clock data) and/or stored separately (e.g., on the remote system 108, the hub device 202, and/or the electronic device 402) based at least in part on when the motion was detected, how long the motion was detected for, and/or a duration of time associated with the detected motion, or motion event (e.g., the duration of time may include the time the motion was detected plus an additional time, such as, without limitation, 5 seconds, 10 seconds, or 30 seconds). For example, each separate detection of motion, or motion event, may be associated with image data 424, audio data 426, text data 432, and/or motion data 430 representative of the detection of motion, or motion event. As a result, when a request for data pertaining to particular motion event, or a particular time period, is received (e.g., by the client device 214, 216, the remote system 108, and/or the hub device 202), the image data 424, the audio data 426, the text data 432, and/or the motion data 430 associated with a particular motion event, and/or associated with motion event(s) within the particular time period, may be sent, retrieved, and/or received.

Although examples discuss the electronic device 402 generating and sending the image data 424, the audio data 426, the text data 432, and/or the motion data 430 when motion is detected, in other examples the data may be generated and/or sent at other times. For example, the image data 424, the audio data 426, the text data 432, and/or the motion data 430 may be generated and sent continuously (e.g., in a streaming manner), periodically, upon request, etc. In examples where the image data 424, the audio data 426, the text data 432, and/or the motion data 430 may be generated and sent continuously, the detection of motion (e.g., a motion event) may cause an indication of when the motion was detected (e.g., a time stamp) and/or how long the motion was detected for (e.g., a duration) to be associated with the image data 424, the audio data 426, the text data 432, and/or the motion data 430. As a result, even though the image data 424, the audio data 426, the text data 432, and/or the motion data 430 may be continuously generated by the electronic device 402, image data 424, the audio data 426, the text data 432, and/or the motion data 430 associated with motion events may be tagged and/or stored separately (e.g., similar to that of the image data 424, the audio data 426, the text data 432, and/or the motion data 430 generated in response to the detection of motion), from the image data 424, the audio data 426, the text data 432, and/or the motion data 430 that is not associated with motion events.

As further illustrated in FIG. 4, the electronic device 402 may store identifier data 438 (which may represent, and/or be similar to, the identifier data 110). The identifier data 438 may represent identifier(s) associated with one or more electronic devices (e.g., the A/V device(s) 210, the hub device(s) 202, the VA device(s) 208, the automation device(s) 206, the sensor(s) 204, the electronic device(s) 230, the light emitter(s) 232, and/or the client device(s) 214, 216). In some examples, the electronic device 402 may be included in a group of devices, and the identifier data 438 may represent identifiers for one or more other electronic devices included in the group of devices. In some examples, the electronic device 402 receives the identifier data 438 from the one or more other electronic devices. In some examples, the electronic device 402 receives the identifier data 438 from the hub device 202, the remote system 108, and/or another device.

The electronic device 402 may be configured to determine power level(s) of one or more other electronic devices, such as one or more other electronic devices included in a group of devices. In some examples, to determine the power level of another electronic device (referred to, in these examples, as a "second electronic device"), the electronic device 402 may receive data packet(s) 440 from the second electronic device. As shown, the data packets(s) 440 may include at least preamble data 442 (e.g., a header, a preamble, etc.) that synchronizes the electronic device 402 with one or more other electronic devices, group identifier data 444 representing an identifier associated with the group of devices, identifier data 438 representing an identifier associated with the second electronic device, power level data 446 representing a power level of an internal power source of the second electronic device, and/or the like. In some instances, the electronic device 402 receives the data packet(s) 440 at set time intervals. In some instances, the electronic device 402 receives the data packet(s) 440 based at least in part on sending a request for the power level data 446 to the second electronic device. Also, in some examples, the electronic device 402 receives the data packet(s) 440 when the power level of the second electronic device is below a threshold power level.

Additionally, or alternatively, in some examples, the electronic device 402 may determine the power level using computer vision analysis, substantially as described above with reference to FIGS. 1A and 1B. For instance, the electronic device 402 may use the camera 410 to generate the image data 424 representing the second electronic device. The electronic device 402 may then analyze the image data 116 using one or more computer vision algorithms, such as one or more object recognition algorithms. Based at least in part on the analysis, the electronic device 402 may determine that the second electronic device is using one or more light source(s) to emit light using a pattern. The pattern may include, but is not limited to, the second electronic device flashing the light, changing an intensity level of the light, changing a color of the light, and/or the like. Based at least in part on the pattern, the electronic device 402 may determine the power level of the second electronic device.

Additionally, in some examples, to perform the analysis, the electronic device 402 may store data that associates one or more patterns with one or more respective power levels of the internal power source. In such examples, the electronic device 402 may analyze the image data 424 to determine that the second electronic device is causing the light source(s) to emit the light according to a pattern. The electronic device 402 may then match the identified pattern to a pattern represented by the data. Based at least in part on the match, the electronic device 402 may use the data to determine that the pattern is associated with a power level of the internal power source.

In some examples, based at least in part on determining the power level, the electronic device 402 may generate power level data 448 indicating the power level of the second electronic device. The electronic device 402 may then store the power level data 448 in the memory 404 and/or send the power level data 448 to the remote system 108. Additionally, in some examples, the electronic device 402 may use threshold data 450 representing power level threshold(s) to determine if the power level of the second electronic device is below a power level threshold. A power level threshold may include, but is not limited to, 5%, 10%, 15%, 20%, and/or any other threshold. Furthermore, in some examples, the electronic device 402 may continue to perform these processes to continue to update the power level data 448 representing the power level of the second electronic device and/or continue to determine if the power level is below the power level threshold.

Figure 5:
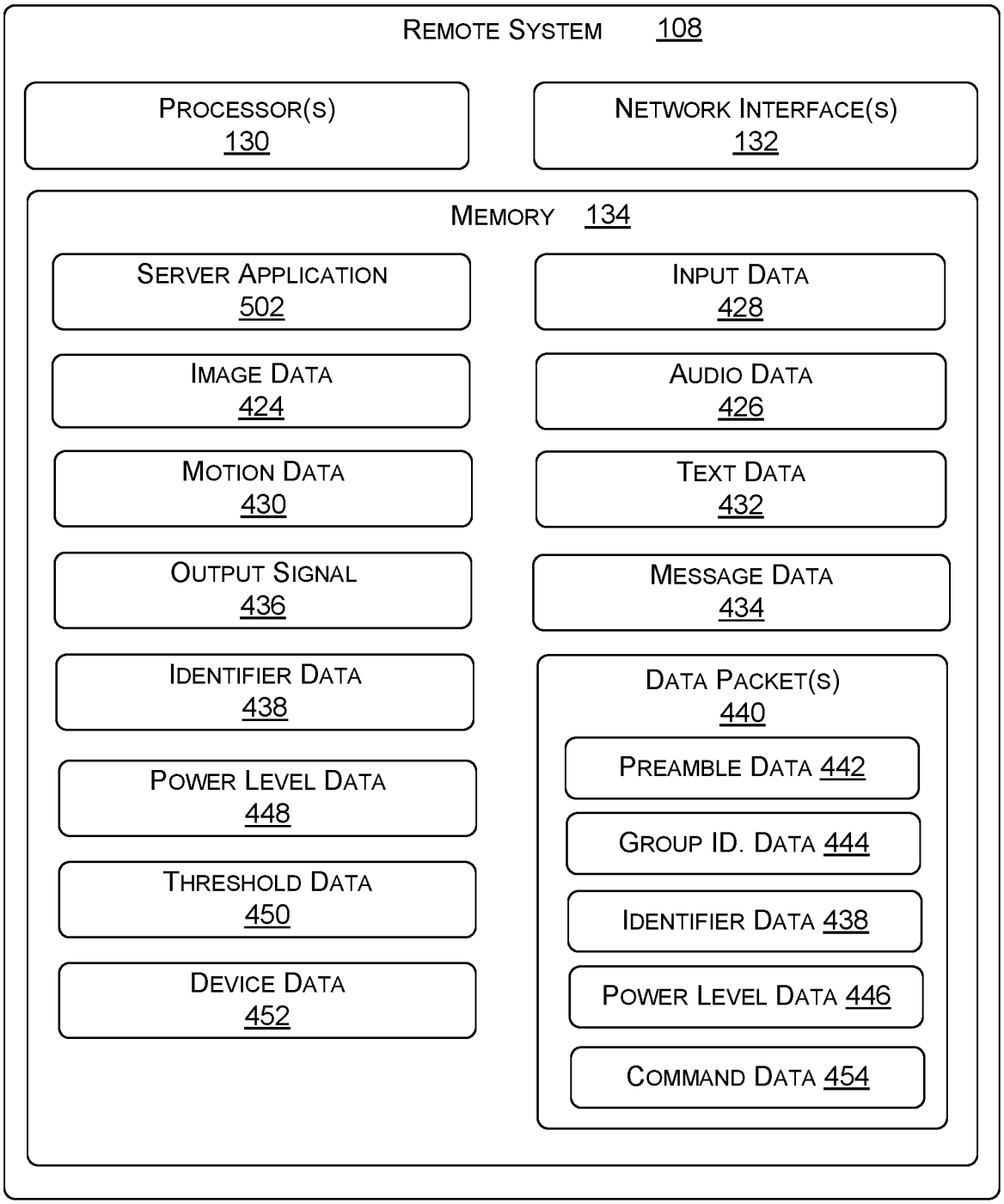
FIG. 5 is a functional block diagram illustrating one example embodiment of a remote system, according to various aspects of the present disclosure.

FIG. 5 is a functional block diagram illustrating one embodiment of the remote system 108, according to various aspects of the present disclosure. As shown, the remote system 108 may comprise the processor(s) 130, the network interface(s) 132, and the memory 134. The network interface(s) 132 may allow the remote system 108 to access and communicate with devices connected to the network (Internet/PSTN) 212 (e.g., the A/V device 210, the hub device 202, the client devices 214, 216, the electronic device(s) 230, the light emitters 232, the electronic device 402, etc.).

The memory 134 may include a server application 502. The server application 502 may include instruction that cause the processor(s) 130 to receive and/or retrieve the audio data 426, the text data 432, the messages data 434, the image data 424, the motion data 430, and/or the input data 428 from the electronic device 402 (which, as discussed above, may represent the A/V device 210, the hub device 202, the client devices 214, 216, the electronic device(s) 230, the light emitters 232, etc.) and/or the client device 214, 216. The server application 502 may also include instructions that cause the processor(s) 130 to send (and/or forward) the audio data 426, the text data 432, the messages data 434, the image data 424, the motion data 430, and/or the input data 428 to the client devices 214, 216 using the network interface(s) 132.

Although referred to as the remote system 108 with reference to the processes described herein, the remote system 108 may additionally, or alternatively, include one or more of the devices from the network(s) of servers/backend devices 220. For example, the processes described herein with respect to the remote system 108 may additionally, or alternatively, at least in part, be performed by one or more backend APIs 226.

As described herein, at least some of the processes of the electronic device 402 may be executed by the remote system 108. For instance, the remote system 108 may be configured to determine the power level of electronic devices, such as the second electronic device described with respect to FIG. 4. In some examples, to determine the power level, the remote system 108 may receive, from the electronic device 402 and/or the second electronic device, the data packet(s) 440 and/or the power level data 448. Additionally, or alternatively, in some examples, to determine the power level, the remote system 108 may receive, from the electronic device 402, the image data 424 representing the second electronic device. The remote system 108 may then analyze the image data 424, using similar processes as described herein with regard to the electronic device 402, to determine the power level. In some examples, based at least in part on determining power level, the remote system 108 may then determine whether the power level is below the threshold power level.

The remote system 108 may further be configured to notify the user about the power level of the second electronic device. In some examples, the remote system 108 notifies the user when the power level is below the threshold power level. In some examples, the remote system 108 notifies the user when the user is in proximity to the second electronic device, the electronic device 402, and/or one or more of the electronic devices included in the group of devices.

For instance, the remote system 108 may determine that the user and/or the client device 214 is in proximity to the second electronic device, the electronic device 402, and/or one or more of the electronic devices included in the group of devices. In some examples, to make the determination, the remote system 108 may receive device data 452 from the electronic device 402 and/or one of the other electronic device. The remote system 108 may then analyze the device data 452, using similar processes as described herein with regard to the electronic device 402, to determine that the device data 452 was sent from the client device 214. Based at least in part on the determination, the remote system 108 may determine that the client device 214 is in proximity to the second electronic device, the electronic device 402, and/or one or more of the electronic devices included in the group of devices.

Additionally, or alternatively, in some examples, to make the determination, the remote system 108 may receive, from the electronic device 402, image data 424 representing the user. The remote system 108 may then analyze the image data 424, using similar processes as described herein with regard to the electronic device 402, to determine that the image data 424 represents the user. Based at least in part on the determination, the remote system 108 may determine that the user is in proximity to the second electronic device, the electronic device 402, and/or one or more of the electronic devices included in the group of devices. Additionally, or alternatively, in some examples, to make the determination, the remote system 108 may receive, from the electronic device 402 and/or another electronic device, motion data 430 indicating that an object was detected. Based at least in part on the determination, the remote system 108 may determine that the user is in proximity to the second electronic device, the electronic device 402, and/or one or more of the electronic devices included in the group of devices.

The remote system 108 may further be configured to notify the user of the power level of the second electronic device. In some examples, to notify the user, the remote system 108 may send data to the electronic device 402. The data may represent a command to notify the user using one or more of the processes described above with respect to the electronic device 402. Additionally, or alternatively, in some examples, to notify the user, the remote system 108 may generate and send data packet(s) 440 to one or more electronic devices, using similar processes as described herein with regard to the electronic device 402. For instance, the data packet(s) 440 may cause the one or more electronic devices to emit light indicating the power level of the second electronic device. Additionally, or alternatively, in some examples, to notify the user, the remote system 108 may send message data 434 to the client device 214, where the message data 434 represents a message indicating the power level of the second electronic device and/or indicating that the power level of the second electronic device is below the threshold power level.

Figure 6A:
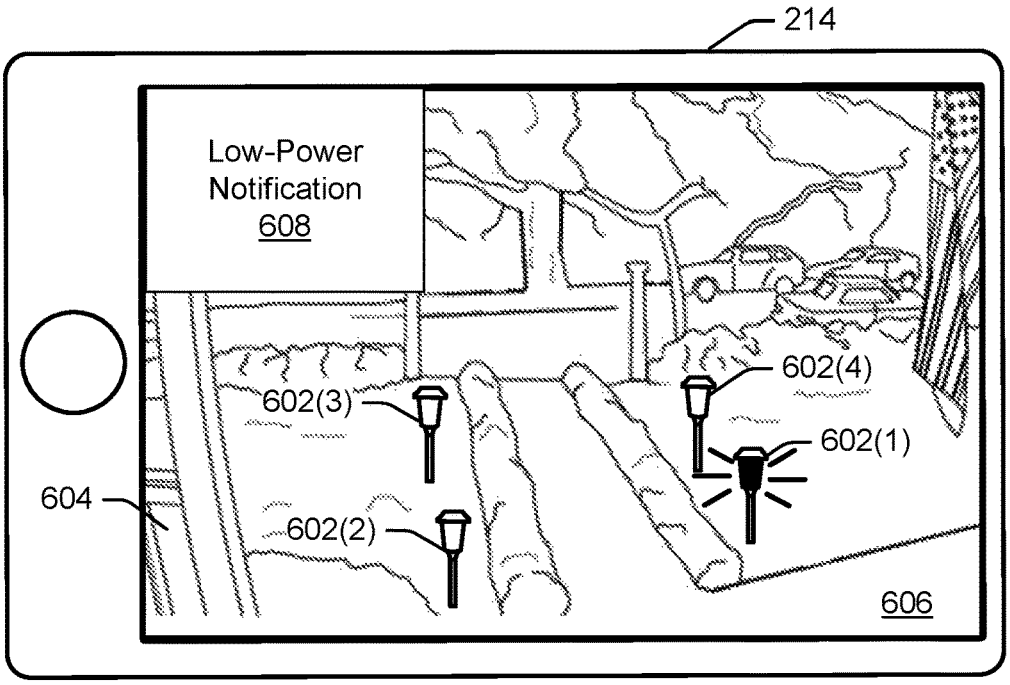
FIG. 6A illustrates a first example message indicating a low power level of an electronic device, according to various aspects of the present disclosure.

FIG. 6A illustrates a first example message indicating a power level of an electronic device, according to various aspects of the present disclosure. For instance, the client device 214 may receive the message data 434 (FIG. 4) from the second electronic device 402 (and/or the remote system 108), wherein the message data 434 includes at least the image data 424 representing the light emitters 602(1)-(4) located in the field of view of the electronic device 402, and power level data 448 indicating the power level of the first light emitter 602(1). The client device 214 may then display a user interface 604 that includes image(s) 606 represented by the image data 424 and an interface element 608 associated with low-power notification. In the example of FIG. 6A, the first light emitter 602(1) is activated, since the first light emitter 602(1) includes the power level that is below the threshold power level. However, in other examples, in addition to, or alternatively from the first light emitter 602(1) being activated, the user interface 604 may include an interface element that indicates the first light emitter 602(1). The interface element may include, but is not limited to, a box around the representation of the first light emitter 602(1), an arrow pointing toward the representation of the first light emitter 602(1), and/or the like.

Figure 6B:
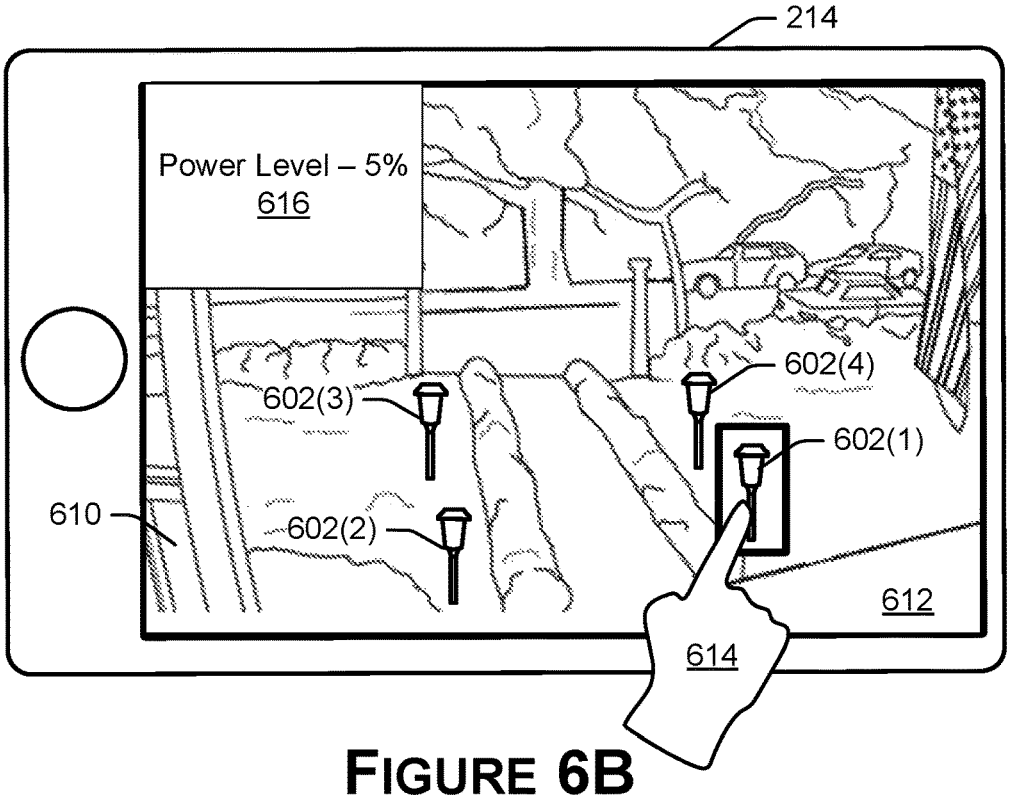
FIG. 6B illustrates a second example message indicating a low power level of an electronic device, according to various aspects of the present disclosure.

FIG. 6B illustrates a second example message indicating a power level of an electronic device, according to various aspects of the present disclosure. For instance, the client device 214 may receive, from the electronic device 402 (and/or the remote system 108), the image data 424 representing the light emitters 602(1)-(4). The client device 214 may then display a user interface 610 that incudes image(s) 612 represented by the image data 424. While displaying the image(s) 612, the client device 214 may receive an input from the user 614 that selects the first light emitter 602(1). Based at least in part on the input, the client device 214 may display an indication 616 of the power level of the first light emitter 602(1). The client device 214 may perform similar processes to notify the user 614 about the power levels of the other light emitters 602(2)-(4) as the user 614 selects each of the other light emitters 602(2)-(4).

In another example, the user interface 610 may display indications (not shown) of the power level of each light emitter 602 without the user 614 having to individually select any of the light emitters 602(1)-(4). For example, the user interface 610 may include text and/or a graphic next to each of the light emitters 602(1)-(4) indicating the power level of each.

In the example of FIG. 6B, the electronic device 402 may send the image data 424 to the client device 214 based at least in part on receiving, from the client device 214, data representing a request for the image data 424 (and/or a request for the power levels). The electronic device 402 may further send, to the client device 214, the power level data 448 representing the power levels of the light emitters 602(1)-(4). In some examples, the electronic device 402 sends the power level data 448 representing the power levels of the light emitters 602(1)-(4) along with the image data 424. In other examples, the electronic device 402 sends the power level data 448 representing the power level of a selected light emitter 602(1)-(4) based at least in part on the user 614 selecting the light emitter 602(1)-(4) on the user interface 610. For example, when the user 614 selects one of the light emitters 602(1)-(4) on the user interface 610, the client device 214 may send a signal to the electronic device 402 with a request for the power level data 448 for the selected one of the light emitters 602(1)-(4). The electronic device 402 may then respond to the request by transmitting a signal to the client device 214 with the power level data 448 for the selected one of the light emitters 602(1)-(4), and the client device 214 may then display the requested power level data 448 on the user interface 610. In various embodiments, the signals sent between the client device 214 and the electronic device 402 may be sent via direct transmission, using a short-range communication protocol or technology (e.g., BLE), or the signals may be sent via the remote system 108.

Although the examples of FIGS. 6A-6B describe notifying the user about the power levels of the light emitters 602(1)-(4), in other examples similar processes may be used to notify the user about the power levels of other electronic devices. For instance, similar processes may be used to notify the user about the power levels of A/V device(s) 210, hub device(s) 202, VA device(s) 208, automation device(s) 206, sensor(s) 204, electronic device(s) 230, and/or the like.

Figure 7A:
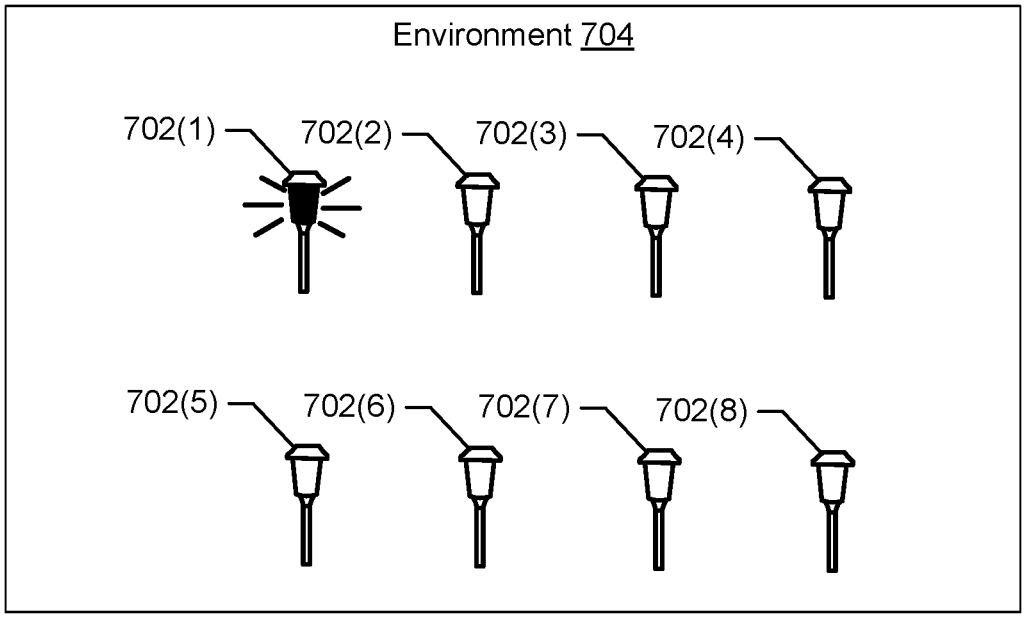
FIG. 7A illustrates a first example of electronic devices emitting light using a pattern in order to notify a user about a low power level of one of the electronic devices, according to various aspects of the present disclosure.

FIG. 7A illustrates a first example of electronic devices emitting light using a pattern in order to notify a user about a power level of one of the electronic devices, according to various aspects of the present disclosure. For instance, in the example of FIG. 7A, the light emitters 702(1)-(8) may be located at an environment 704 (e.g., at the user 142's property). The first light emitter 702(1) includes a power level that is below the threshold power level. Once the electronic device 402 determines that the user and/or the client device 214 is/are in proximity to the light emitters 702(1)-(8), such as using the processes described herein, the electronic device 402 may send a data packet 440 to one or more of the light emitters 702(1)-(8). In the example of FIG. 7A, the data packet 440 may include at least identifier data 438 representing the identifier of the first light emitter 702(1) and command data 454 representing a command to activate the light source(s) of the first light emitter 702(1) according to a pattern.

The one or more light emitters 702(1)-(8) may receive the data packet 440 from the electronic device 402 (and/or the remote system 108). Since the data packet 440 includes the identifier data 438 representing the identifier of the first light emitter 702(1), the first electronic device 702(1) may activate the light source(s) according to the pattern. Additionally, the other light emitters 702(2)-(8) may refrain from activating their respective light source(s) according to the pattern. As such, and as shown in the example of FIG. 7A, the first light emitter 702(1) is emitting light such that the user can determine that it is the power level of the first light emitter 702(1) that is below the threshold power level. The example of FIG. 7A may be particularly advantageous when the power level of the first light emitter 702(1) is high enough (even though it is below the threshold power level) that it is still capable of emitting light.

Figure 7B:
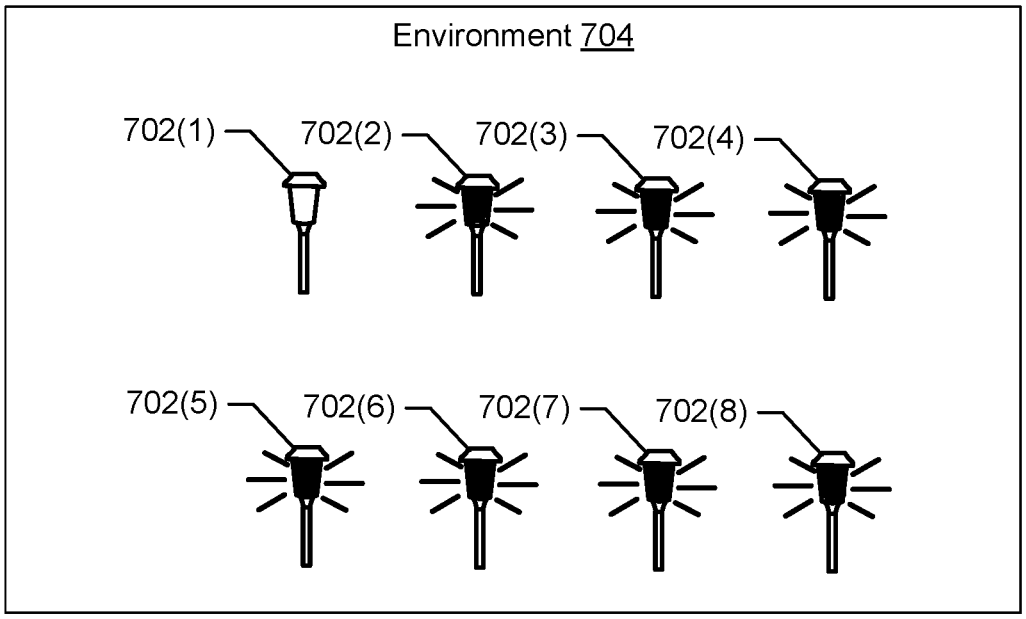
FIG. 7B illustrates a second example of electronic devices emitting light using a pattern in order to notify a user about a low power level of one of the electronic devices, according to various aspects of the present disclosure.

FIG. 7B illustrates a second example of electronic devices emitting light using a pattern in order to notify a user about a power level of one of the electronic devices, according to various aspects of the present disclosure. For instance, in the example of FIG. 7B, the light emitters 702(1)-(8) may again be located at the environment 704, where the first light emitter 702(1) includes a power level that is below the threshold power level. Once the electronic device 402 determines that the user and/or the client device 214 is/are in proximity to the electronic devices 702(1)-(8), such as using the processes described herein, the electronic device 402 may send a data packet 440 to one or more of the light emitters 702(1)-(8). In the example of FIG. 7B, the data packet 440 may include at least identifier data 438 representing the identifiers of the light emitters 702(2)-(8) and command data 454 representing a command to activate the light source(s) of the second through eighth light emitters 702(2)-(8) according to a pattern.

The one or more light emitters 702(1)-(8) may receive the data packet 440 from the electronic device 402 (and/or the remote system 108). Since the data packet 440 includes the identifier data 438 representing the identifiers of the second through eighth light emitters 702(2)-(8), the second through eighth light emitters 702(2)-(8) may activate their respective light source(s) according to the pattern. Additionally, the first light emitter 702(1) may refrain from activating its light source(s) according to the pattern. As such, and as shown in the example of FIG. 7B, the light emitters 702(2)-(8) are emitting light such that the user can determine that it is the power level of the first light emitter 702(1) that is below the threshold power level. The example of FIG. 7B may be particularly advantageous when the power level of the first light emitter 702(1) is so low (e.g., 0%) that it is not currently capable of emitting light. In this scenario, the other light emitters 702(2)-(8) may be leveraged to communicate to the user that the internal power source of the first light emitter 702(1) is badly in need of recharging.

Although the examples of FIGS. 7A-7B describe notifying the user about the power levels of the light emitters 702(1)-(8), in other examples, similar processes may be used to notify the user about the power levels of other electronic devices. For instance, similar processes may be used to notify the user about the power levels of A/V device(s) 210, hub device(s) 202, VA device(s) 208, automation device(s) 206, sensor(s) 204, electronic device(s) 230, and/or the like.

Figure 8:
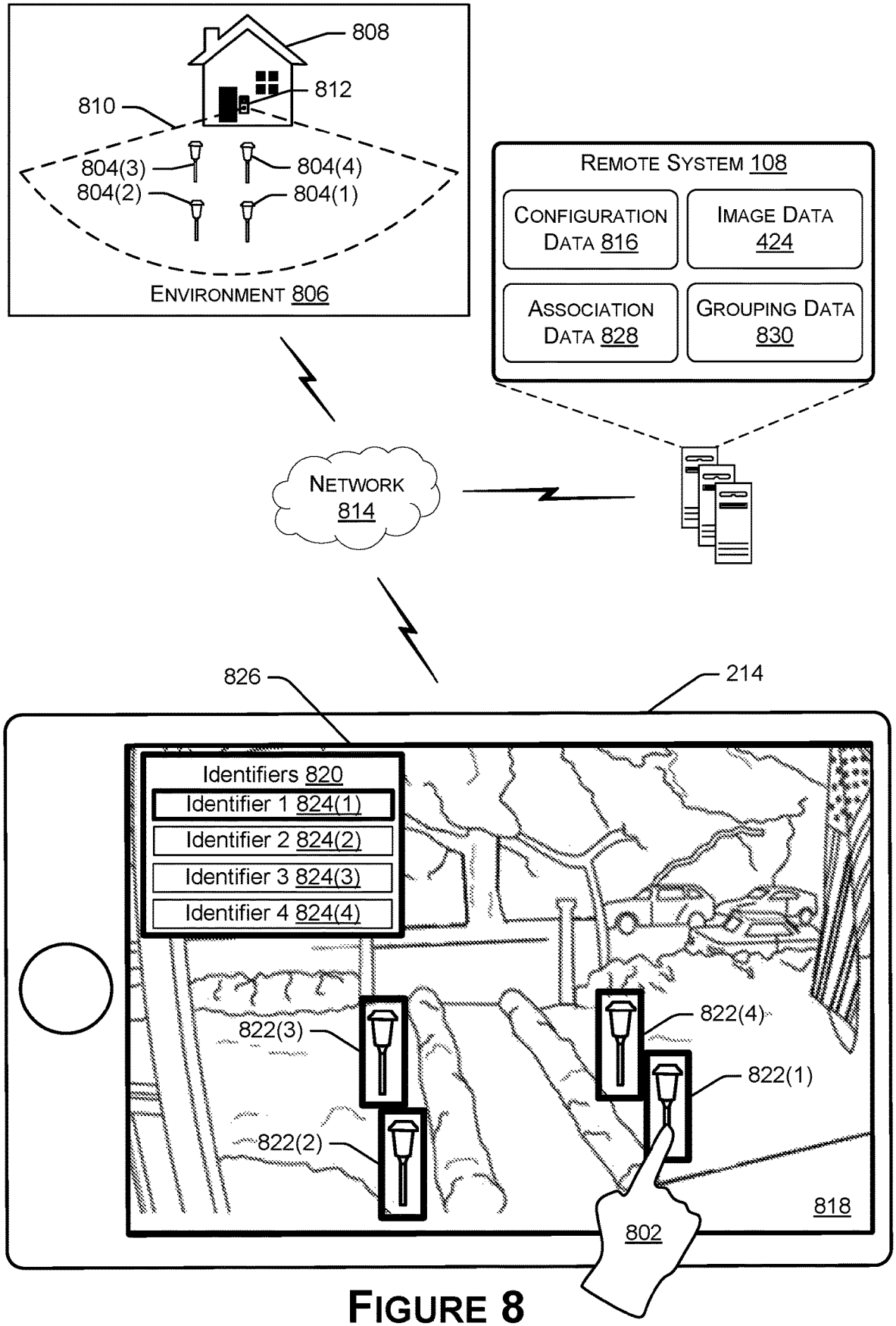
FIG. 8 is a schematic diagram illustrating an example of configuring electronic devices that are located within a field of view of another electronic device, according to various aspects of the present disclosure.

FIG. 8 is a schematic diagram illustrating an example of configuring electronic devices that are located within a field of view of another electronic device, according to various aspects of the present disclosure. For example, a user 802 may have installed the light emitters 804(1)-(4) at an environment 806 (e.g., around the property surrounding the user's home 808). As shown, each of the light emitters 804(1)-(4) is located within a field of view (FOV) 810 of a camera of an A/V device 812 (which may represent, and/or be similar to, the electronic device 402). After installing the light emitters 804(1)-(4), the remote system 108 may receive, over a network 814, data (e.g., configuration data 816) from a client device 214, where the configuration data 816 indicates a request to configure the light emitters 804(1)-(4). Based at least in part on the configuration data 816, the remote system 108 may transmit, over the network 814 and to the client device 214, image data 424 generated by the camera of the A/V device 812.

The client device 214 may receive the image data 424 from the remote system 108, and display a GUI that includes image(s) 818 represented by the image data 424, where the image(s) 818 represent the light emitters 804(1)-(4). In other words, the GUI may show a live video stream including the image data 424 generated by the camera of the A/V device 812. Additionally, the GUI may include a list of identifiers 820 associated with the light emitters 802(1)-(4) that are to be configured by the user 802. While displaying the image(s) 818, and for one or more of the light emitters 804(1)-(4), the client device 214 may receive an input selecting a respective portion 822(1)-(4) of the image(s) 818 that represents the respective light emitter 804(1)-(4). For example, and as illustrated in FIG. 8, the client device 214 may receive an input from the user 802, where the input corresponds to a selection of a first portion 822(1) of the image(s) 818 that represent the first light emitter 804(1). In some examples, the input may comprise the user 802 drawing a shape around the portion 822(1) of the image(s) 818 that represents the first light emitter 804(1). The shape may include, but is not limited to, a circle, a triangle, a square, a rectangle, a pentagon, and/or any other shape, including irregular polygons and open polygons. In other examples, the input may comprise the user 802 tapping (or double tapping, or clicking, or double clicking, etc.) the image(s) 818 that represents the first light emitter 804(1).

Additionally, the client device 214 may receive an input selecting a first identifier 824(1) associated with the first light emitter 804(1), which may be indicated by the highlighted graphical element around the first identifier 824(1) in the example of FIG. 8. Each identifier 824(1)-(4) may include, but is not limited to, an IP address, a MAC address, a numerical identifier, an alphabetic identifier, a mixed numerical and alphabetic identifier, and/or any other type of identifier that may be used to identify the respective light emitter 804(1)-(4). In some examples, the client device 214 may then store data that associates a portion (which may be represented by the first portion 822(1)) of the FOV 810 of the A/V device 812 (and/or the first portion 822(1) of the image(s) 818, and/or a portion of the display 826 of the client device 214) that represents the first light emitter 804(1) with the first identifier 824(1) of the first light emitter 804(1). Additionally, or alternatively, in some examples, the client device 214 may transmit, over the network 814 and to the remote system 108, data (e.g., association data 828) indicating that the portion of the FOV 810 of the A/V device 812 (and/or the first portion 822(1) of the image(s) 818, and/or the portion of the display 826) that represents the first light emitter 804(1) is associated with the first identifier 824(1) of the first light emitter 804(1). The client device 214 may then perform a similar process for one or more of the other light emitters 804(2)-(4).

In some examples, when configuring the light emitters 804(1)-(4) using the foregoing process, the client device 214 may first receive, over the network 814 and from the remote system 108, data indicating the portions 822(1)-(4) of the image(s) 818 that represent potential light emitters. The remote system 108 may have determined the portions 822(1)-(4) by analyzing the image(s) 818 using one or more computer vision algorithms, for example. The client device 214 may then display interface elements (which may also be represented by the rectangles overlying the light emitters 804(1)-(4) in FIG. 8) over the portions 822(1)-(4) of the image(s) 818 that represent the potential light emitters. In such examples, while displaying the image(s) 818, the client device 214 may receive an input selecting an interface element and an input selecting the identifier 824(1) of the first light emitter 804(1). In some examples, the client device 214 may then store data that associates the portion of the FOV 810 of the A/V device 812 (and/or the first portion 822(1) of the image(s) 818, and/or the portion of the display 826 of the client device 214) that represents the first light emitter 804(1) with the first identifier 824(1) of the first light emitter 804(1). Additionally, or alternatively, in some examples, the client device 214 may transmit, over the network 814 and to the remote system 108, the association data 828 indicating that the portion of the FOV 810 of the A/V device 812 (and/or the first portion 822(1) of the image(s) 818, and/or the portion of the display 826) that represents the first light emitter 804(1) is associated with the first identifier 824(1) of the first light emitter 804(1). The client device 214 may then perform a similar process for one or more of the other light emitters 804(2)-(4).

In some examples, such as after configuring the light emitters 804(1)-(4), the remote system 108 may group the light emitters 804(1)-(4) located within the FOV 810 of the A/V device 812. For example, the remote system 108 may determine that one or more of the light emitters 804(1)-(4) is/are located within the FOV 810 of the A/V device 812. The remote system 108 may then store data (e.g., grouping data 830) indicating that one or more of the light emitters 804(1)-(4) is included in a group of light emitters that is associated with the A/V device 812 and/or is located within the FOV 810 of the A/V device 812.

In some examples, the remote system 108 may then send the association data 828 and/or the grouping data 830 to the A/V device 812. The A/V device 812 may then use the association data 828 to determine the power level of the light emitters 804(1)-(4). For example, when analyzing the image data 424, the A/V device 812 may analyze the portions 822(2) of the image data 824 that represent the light emitters 804(1)-(4) to determine whether one of the light emitters 804(1)-(4) is emitting light according to a pattern. Based on determining that one of the light emitters 804(1)-(4) is emitting light according to a pattern, the A/V device 812 may determine the power level of that light emitter 804(1)-(4) and/or that the power level of that light emitter 804(1)-(4) is below the threshold power level, using the processes described herein. Additionally, using the association data 828, the A/V device 812 may determine the identifier 824(1)-(4) of the light emitter 814(1)-(4).

For example, the A/V device 812 may use the association data 828 to determine that a first portion of the FOV 810 of the A/V device 812 represents the first light emitter 804(1). The A/V device 812 may then use computer vision analysis, described herein, to determine that a light emitter located in the first portion of the FOV 810 is emitting light according to a pattern that indicates the power level of that light emitter. Based on the association data 828 indicating that the first portion of FOV 810 represents the first light emitter 804(1), the A/V device 812 may determine that it is the first light emitter 804(1) that is emitting the light according to the pattern. As such, the A/V device 812 may determine the power level of the first light emitter 804(1) based on the pattern, using the processes described herein. Additionally, the A/V device 812 may perform similar processes to determine power levels of each of the other electronic devices 804(2)-(4).

Although the example of FIG. 8 describes configuring the light emitters 804(1)-(4) that are located in the field of view 810 of the A/V device 812, in other examples, similar processes may be used to configure other types of electronic devices. For instance, similar processes may be used to configure A/V device(s) 210, hub device(s) 202, VA device(s) 208, automation device(s) 206, sensor(s) 204, electronic device(s) 230, and/or the like.

FIGS. 9-13 illustrate various processes for systems that notify a user about a power level of an electronic device. The processes described herein are illustrated as collections of blocks in logical flow diagrams, which represent a sequence of operations, some or all of which may be implemented in hardware, software or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process, or alternative processes, and not all of the blocks need be executed.

Figure 9:
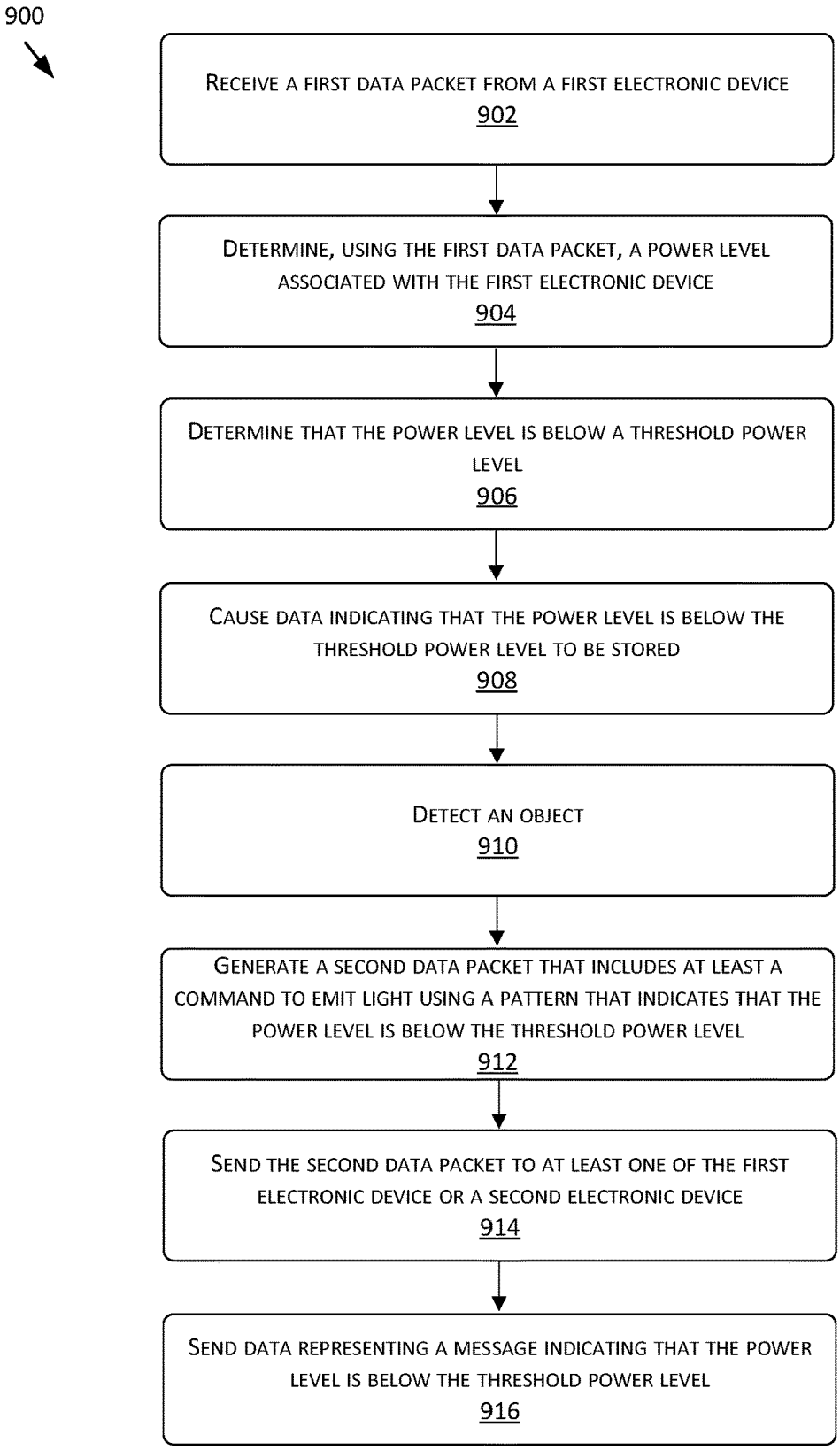
FIG. 9 is a flowchart illustrating an example process of notifying a user that a power level of an electronic device is below a threshold power level, according to various aspects of the present disclosure.

FIG. 9 is a flowchart illustrating an example process 900 of notifying a user that a power level of an electronic device is below a threshold power level, according to various aspects of the present disclosure. At block 902, the process 900 may include receiving a first data packet from a first electronic device. For instance, the electronic device 402 may receive the first data packet 440 from the first electronic device. The first data packet 440 may include, but is not limited to, identifier data 438 indicating an identifier of the first electronic device and power level data 446 indicating a power level of in internal power source of the first electronic device. The first electronic device may include, but is not limited to, an A/V device 210, a hub device 202, a VA device 208, an automation device 206, a sensor 204, an electronic device 230, a light emitter 232, and/or the like.

At block 904, the process 900 may include determining, using the first data packet, a power level associated with the first electronic device. For instance, the electronic device 402 may determine, using the first data packet 440, the power level associated with the first electronic device. In some examples, the electronic device 402 determines the power level using the power level data 446 in the first data packet 440 that indicates the power level.

At block 906, the process 900 may include determining that the power level is below a threshold power level. For instance, the electronic device 402 may determine that the power level is below the threshold power level. In some examples, to make the determination, the electronic device 402 may use the threshold data 450 indicating the threshold power level. The electronic device 402 may then compare the power level indicated by the power level data 446 to the threshold power level indicated by the threshold data 450. Based at least in part on the comparison, the electronic device 402 may determine that the power level is below the threshold power level. For instance, if the power level is 5% and the threshold power level is 10%, the electronic device 402 may determine that the 5% power level is below the 10% threshold.

At block 908, the process 900 may include causing data indicating that the power level is below the threshold power level to be stored. For instance, the electronic device 402 may generate the power level data 448 indicating that the power level associated with the first electronic device is below the threshold power level. In some examples, the electronic device 402 may then store the power level data 448, such is in the memory 404. Additionally, or alternatively, in some examples, the electronic device 402 may send the power level data 448 to the remote system 108 for storage.

At block 910, the process 900 may include detecting an object. For instance, the electronic device 402 may detect the object. In some examples, the object may include the client device 214. In such examples, to detect the object, the electronic device 402 may receive, from the client device 214, device data 452 representing an identifier of the client device 214. The electronic device 402 may then use the identifier to determine that the client device 214 is in proximity to (e.g., within wireless communication range of) the electronic device 402 and/or the first electronic device. As described above, the electronic device 402 and the client device 214 may be paired with one another during a process of setting up the electronic device 402, and/or at a later time. Once paired, the electronic device 402 and the client device 214 may automatically connect to one another whenever the two devices are within wireless communication range of one another. Additionally, or alternatively, in some examples, the object may include a user. In such examples, to detect the object, the electronic device 402 may generate image data 424 representing the user. The electronic device 402 may then analyze the image data 424 using one or more computer vision algorithms. Based at least in part on the analysis, the electronic device 402 may determine that the image data 424 represents the user.

In some examples, based at least in part on detecting the object, the electronic device 402 may send data to the remote system 108, where the data indicates that the object was detected. The electronic device 402 may then receive, from the remote system 108, the power level data 448 indicating that the power level associated with the first electronic device is below the threshold power level.

At block 912, the process 900 may include generating a second data packet that includes at least a command to emit light using a pattern that indicates that the power level is below the threshold level. For instance, the electronic device 402 may generate the second data packet 440 including at least the command data 454 indicating a command to emit light using the pattern that indicates that the power level associated with the first electronic device is below the threshold power level. In some examples, the electronic device 402 further generates the second data packet 440 to include the identifier data 438 representing the identifier of the first electronic device. In some examples, the electronic device 402 further generates the second data packet 440 to include identifier data 438 representing an identifier of a second electronic device.

At block 914, the process 900 may include sending the second data packet to at least one of the first electronic device or a second electronic device. For instance, the electronic device 402 may send the second data packet 440 to at least one of the first electronic device or the second electronic device. The at least one of the first electronic device or the second electronic device may receive the second data packet 440 and, based at least in part on receiving the second data packet 440, emit light according to the pattern.

At block 916, the process 900 may include sending data representing a message indicating that the power level is below the threshold power level. For instance, the electronic device 402 may generate the message that indicates that the power level associated with the first electronic device is below the threshold power level. The electronic device 402 may then send, to the client device 214, the message data 434 representing the message.

Figure 10:
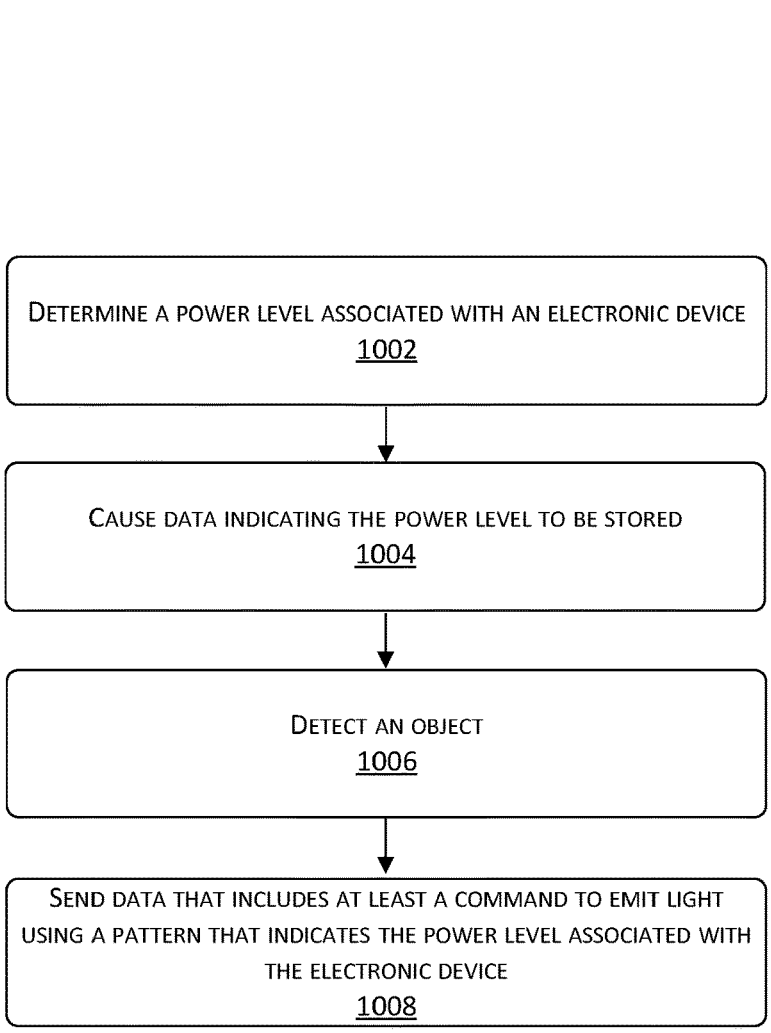
FIG. 10 is a flowchart illustrating an example process of notifying of a user about a power level of an electronic device, according to various aspects of the present disclosure.

FIG. 10 is a flowchart illustrating an example process 1000 of notifying a user about a low power level of an electronic device, according to various aspects of the present disclosure. At block 1002, the process 1000 may include determining a power level associated with an electronic device. For instance, the electronic device 402 may determine the power level of another electronic device. In some examples, to determine the power level, the electronic device 402 may receive a first data packet 440 from the other electronic device. The first data packet 440 may include, but is not limited to, the identifier data 438 indicating an identifier of the other electronic device, and the power level data 446 indicating the power level associated with the other electronic device.

Additionally, or alternatively, in some examples, to determine the power level, the electronic device 402 may generate image data 424 representing the other electronic device. The electronic device 402 may then analyze the image data 424 using one or more computer vision algorithms. Based at least in part on the analysis, the electronic device 402 may determine that the other electronic device is emitting light according to a pattern. The electronic device 402 may then determine that the pattern indicates the power level associated with the other electronic device.

At block 1004, the process 1000 may include causing data indicating the power level to be stored. For instance, the electronic device 402 may generate the power level data 448 indicating the power level associated with the other electronic device. In some examples, the electronic device 402 may then store the power level data 448, such is in the memory 404. Additionally, or alternatively, in some examples, the electronic device 402 may send the power level data 448 to the remote system 108 for storage.

At block 1006, the process 1000 may include detecting an object. For instance, the electronic device 402 may detect the object. In some examples, the object may include the client device 214. In such examples, to detect the object, the electronic device 402 may receive, from the client device 214, device data 452 representing an identifier of the client device 214. The electronic device 402 may then use the identifier to determine that the client device 214 is in proximity to (e.g., within wireless communication range of) the electronic device 402. Additionally, or alternatively, in some examples, the object may include a user. In such examples, to detect the object, the electronic device 402 may generate image data 424 representing the user. The electronic device 402 may then analyze the image data 424 using one or more computer vision algorithms. Based at least in part on the analysis, the electronic device 402 may determine that the image data 424 represents the user.

In some examples, based at least in part on detecting the object, the electronic device 402 may send data to the remote system 108, where the data indicates that the object was detected. The electronic device 402 may then receive, from the remote system 108, the power level data 448 indicating the power level associated with the electronic device.

At block 1008, the process 1000 may include sending data that includes at least a command to emit light using a pattern that indicates the power level associated with the electronic device. For instance, the electronic device 402 may send the command data 454 indicating a command to emit light using the pattern that indicates the power level associated with the other electronic device. In some examples, the electronic device 402 further sends the identifier data 438 representing an identifier of the other electronic device. In some examples, the electronic device 402 further sends the identifier data 438 representing identifier(s) of one or more additional electronic devices.

Figure 11:
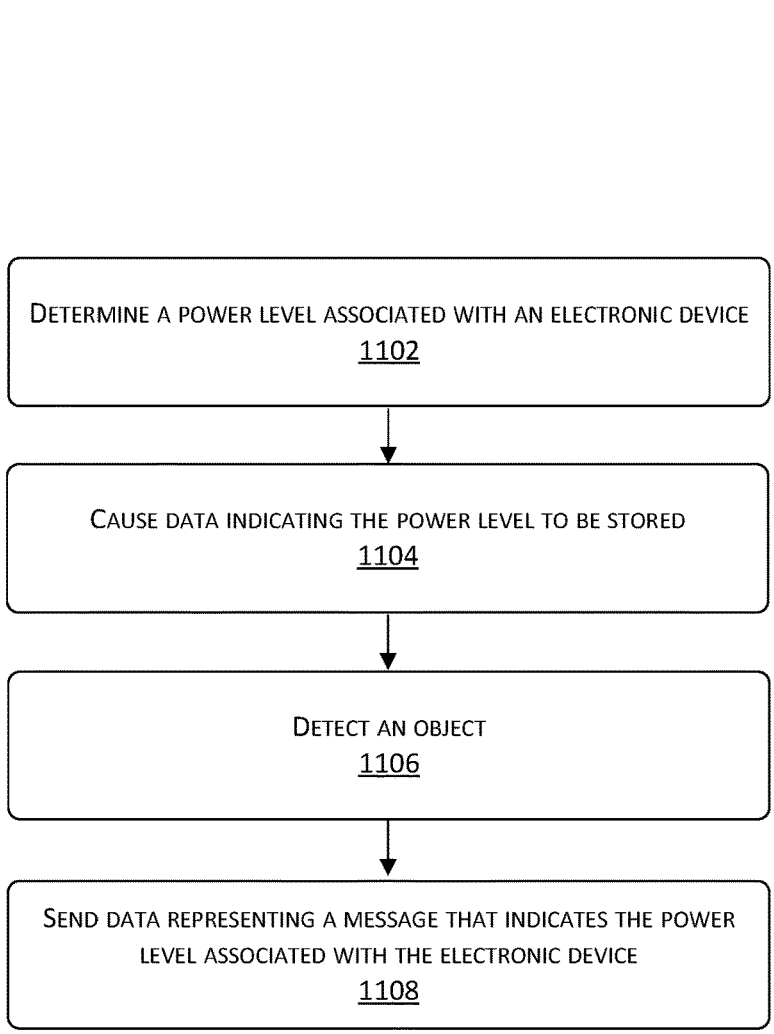
FIG. 11 is a flowchart illustrating an example process of sending a message that indicates a low power level of an electronic device, according to various aspects of the present disclosure.

FIG. 11 is a flowchart illustrating an example process 1100 of sending a message that indicates a low power level of an electronic device, according to various aspects of the present disclosure. At block 1102, the process 1100 may include determining a power level associated with an electronic device. For instance, the electronic device 402 may determine the power level of the other electronic device. In some examples, to determine the power level, the electronic device 402 may receive a first data packet 440 from the other electronic device. The first data packet 440 may include, but is not limited to, the identifier data 438 indicating an identifier of the other electronic device and the power level data 446 indicating the power level associated with the other electronic device.

Additionally, or alternatively, in some examples, to determine the power level, the electronic device 402 may generate the image data 424 representing the other electronic device. The electronic device 402 may then analyze the image data 424 using one or more computer vision algorithms. Based at least in part on the analysis, the electronic device 402 may determine that the other electronic device is emitting light according to a pattern. The electronic device 402 may then determine that the pattern indicates the power level associated with the other electronic device.

At block 1104, the process 1100 may include causing data indicating the power level to be stored. For instance, the electronic device 402 may generate the power level data 448 indicating the power level associated with the other electronic device. In some examples, the electronic device 402 may then store the power level data 448, such is in the memory 404. Additionally, or alternatively, in some examples, the electronic device 402 may send the power level data 448 to the remote system 108 for storage.

At block 1106, the process 1100 may include detecting an object. For instance, the electronic device 402 may detect the object. In some examples, the object may include the client device 214. In such examples, to detect the object, the electronic device 402 may receive, from the client device 214, the device data 452 representing an identifier of the client device 214. The electronic device 402 may then use the identifier to determine that the client device 214 is in proximity to (e.g., within wireless communication range of) the electronic device 402. Additionally, or alternatively, in some examples, the object may include a user. In such examples, to detect the object, the electronic device 402 may generate the image data 424 representing the user. The electronic device 402 may then analyze the image data 424 using one or more computer vision algorithms. Based at least in part on the analysis, the electronic device 402 may determine that the image data 424 represents the user.

In some examples, based at least in part on detecting the object, the electronic device 402 may send data to the remote system 108, where the data indicates that the object was detected. The electronic device 402 may then receive, from the remote system 108, the power level data 448 indicating the power level associated with the electronic device.

At block 1108, the process 1100 may include sending data representing a message that indicates the power level associated with the electronic device. For instance, based at least in part on detecting the object and/or based at least in part on detecting that the object is in proximity to the electronic device 402, the electronic device 402 may send the message data 434 to the client device 214. The message data 434 may represent the message that indicates the power level associated with the other electronic device.

Figure 12:
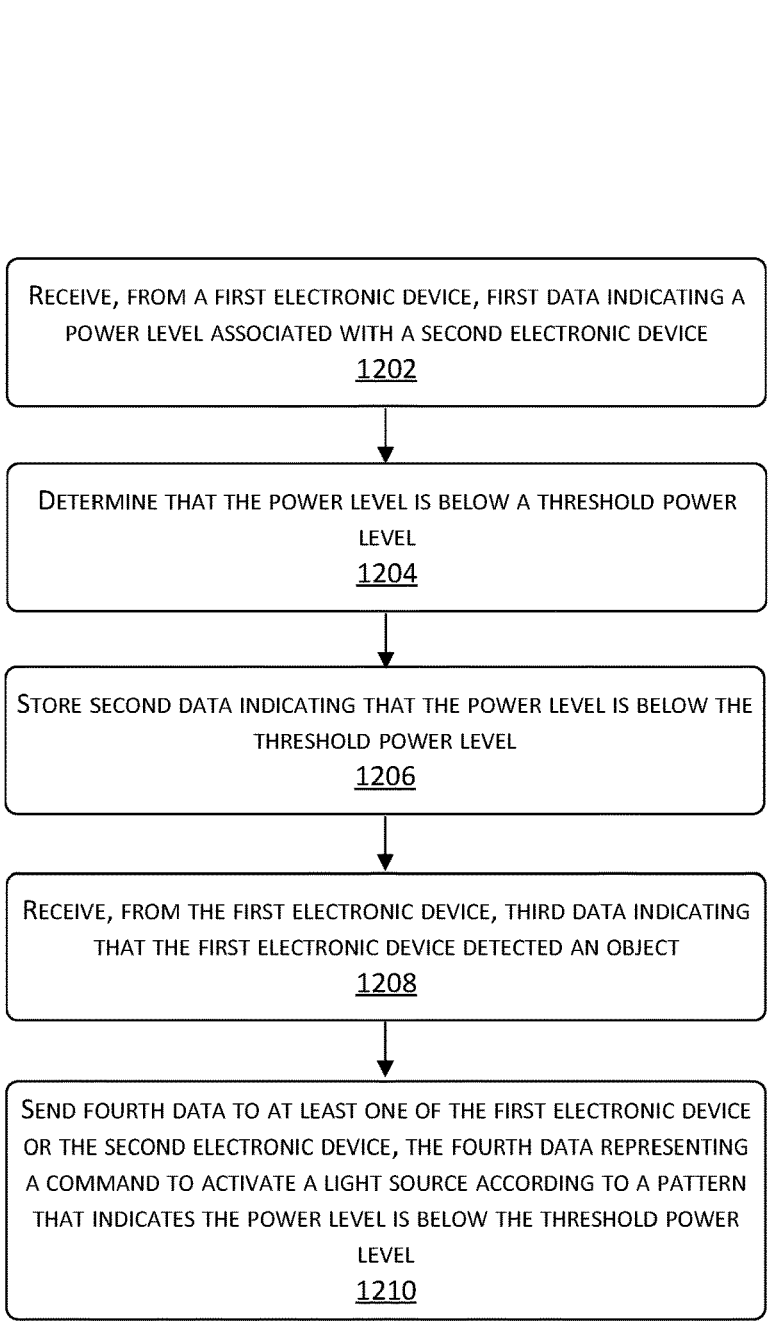
FIG. 12 is a flowchart illustrating a first example process of a remote system notifying a user about a low power level of an electronic device, according to various aspects of the present disclosure.

FIG. 12 is a flowchart illustrating a first example process 1200 of a remote system notifying a user about a low power level of an electronic device, according to various aspects of the present disclosure. At block 1202, the process 1200 may include receiving, from a first electronic device, first data indicating a power level associated with a second electronic device. For instance, the remote system 108 may receive, from the electronic device 402 (referred to, in this example, as the "first electronic device 402"), the first data that indicates the power level of a second electronic device. In some examples, the first data may include a first data packet 440. In some examples, the first data may include the power level data 448.

At block 1204, the process 1200 may include determining that the power level is below a threshold power level. For instance, the remote system 108 may determine that the power level is below the threshold power level. In some examples, to make the determination, the remote system 108 may use the threshold data 450 indicating the threshold power level. The remote system 108 may then compare the power level indicated by the first data to the threshold power level indicated by the threshold data 450. Based at least in part on the comparison, the remote system 108 may determine that the power level is below the threshold power level. For instance, if the power level is 5% and the threshold power level is 10%, the remote system 108 may determine that the 5% power level is below the 10% power level threshold.

At block 1206, the process 1200 may include storing second data indicating that the power level is below the threshold power level. For instance, the remote system 108 may store the power level data 448 (e.g., the second data) indicating that the power level is below the threshold power level.

At block 1208, the process 1200 may include receiving, from the first electronic device, third data indicating that the first electronic device detected an object. For instance, the remote system 108 may receive, from the first electronic device 402, the third data indicating that the first electronic device 402 detected an object. In some examples, such as when the object includes the client device 214, the third data may include device data 452 received by the first electronic device 402 from the client device 214, where the device data indicates an identifier associated with the client device 214. In some examples, such as when the object includes the user, the third data may include the image data 424 generated by the first electronic device 402, where the image data 424 represents the user.

At block 1210, the process 1200 may include sending fourth data to at least one of the first electronic device or the second electronic device, the fourth data representing a command to activate a light source according to a pattern that indicates the power level is below the threshold level. For instance, the remote system may send the fourth data to at least one of the first electronic device 402 or the second electronic device. In some examples, the fourth data may include a second data packet 440 that includes the identifier data 438 representing the identifier of the second electronic device and the command data 454 representing the command to activate the light source according to the pattern. In some examples, such as when the remote system 108 sends the fourth data to the first electronic device 402, the first electronic device 402 may then send the fourth data and/or a data packet 440 to the second electronic device, where the data packet 440 represents at least the command to activate the light source according to the pattern.

Figure 13:
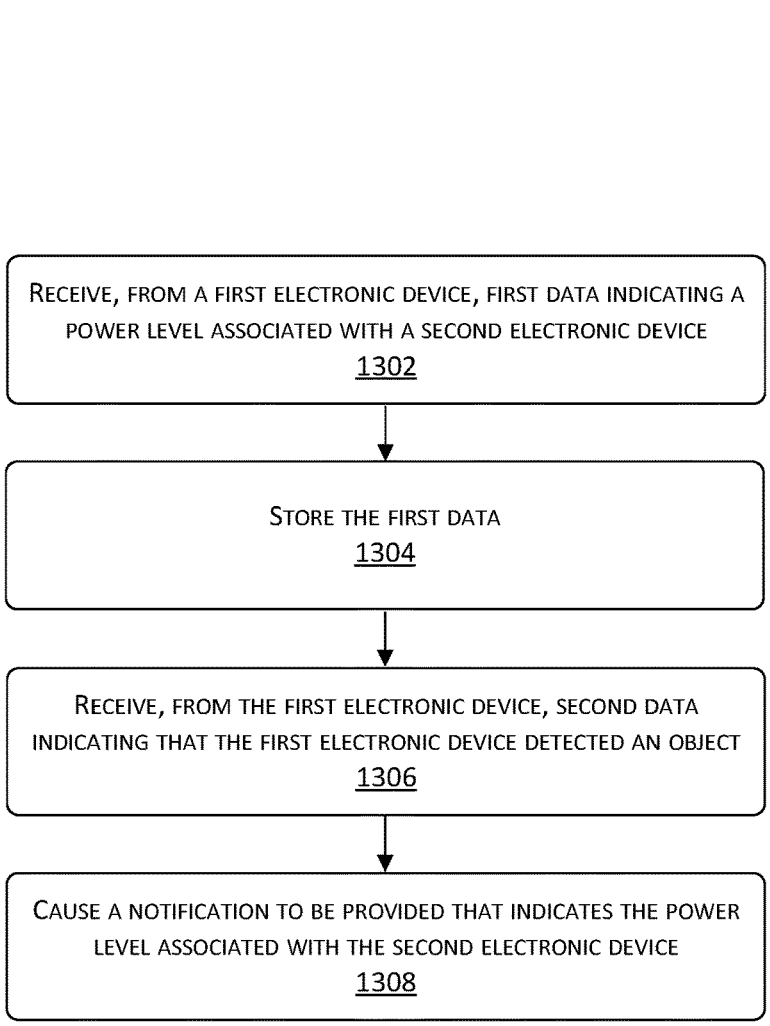
FIG. 13 is a flowchart illustrating a second example process of a remote system notifying a user about a low power level of an electronic device, according to various aspects of the present disclosure.

FIG. 13 is a flowchart illustrating a second example process 1300 of a remote system notifying a user about a low power level of an electronic device, according to various aspects of the present disclosure. At block 1302, the process 1300 may include receiving, from a first electronic device, first data indicating a power level associated with a second electronic device. For instance, the remote system 108 may receive, from the electronic device 402 (referred to, in this example, as the "first electronic device 402"), the first data that indicates the power level of a second electronic device. In some examples, the first data may include a first data packet 440. In some examples, the first data may include the power level data 448.

At block 1304, the process 1300 may include storing the first data. For instance, the remote system 108 may store the first data.

At block 1306, the process 1300 may include receiving, from the first electronic device, second data indicating that the first electronic device detected an object. For instance, the remote system 108 may receive, from the first electronic device 402, the second data indicating that the first electronic device 402 detected an object. In some examples, such as when the object includes the client device 214, the second data may include device data 452 received by the first electronic device 402 from the client device 214, where the device data indicates an identifier associated with the client device 214. In some examples, such as when the object includes the user, the second data may include the image data 424 generated by the first electronic device 402, where the image data 424 represents the user.

At block 1308, the process 1300 may include causing a notification to be provided that indicates the power level associated with the first electronic device. For instance, the remote system 108 may cause the notification to be provided that indicates the power level associated with the second electronic device. In some examples, to cause the notification to be provided, the remote system 108 may send, to the first electronic device 402, data that includes a command to provide the notification. The first electronic device 402 may then send a data packet 440 to the second electronic device and/or one or more other electronic devices, where the data packet 440 includes at least the command data 454 representing a command to emit light according to a pattern that indicates the power level. Additionally, or alternatively, the first electronic device 402 may send, to the client device 214, the message data 434 that represents a message indicating the power level. Additionally, or alternatively, in some examples, to cause the notification to be provided, the remote system 108 may send, to the client device 214, the message data 434 that represents a message indicating the power level.

Figure 14:
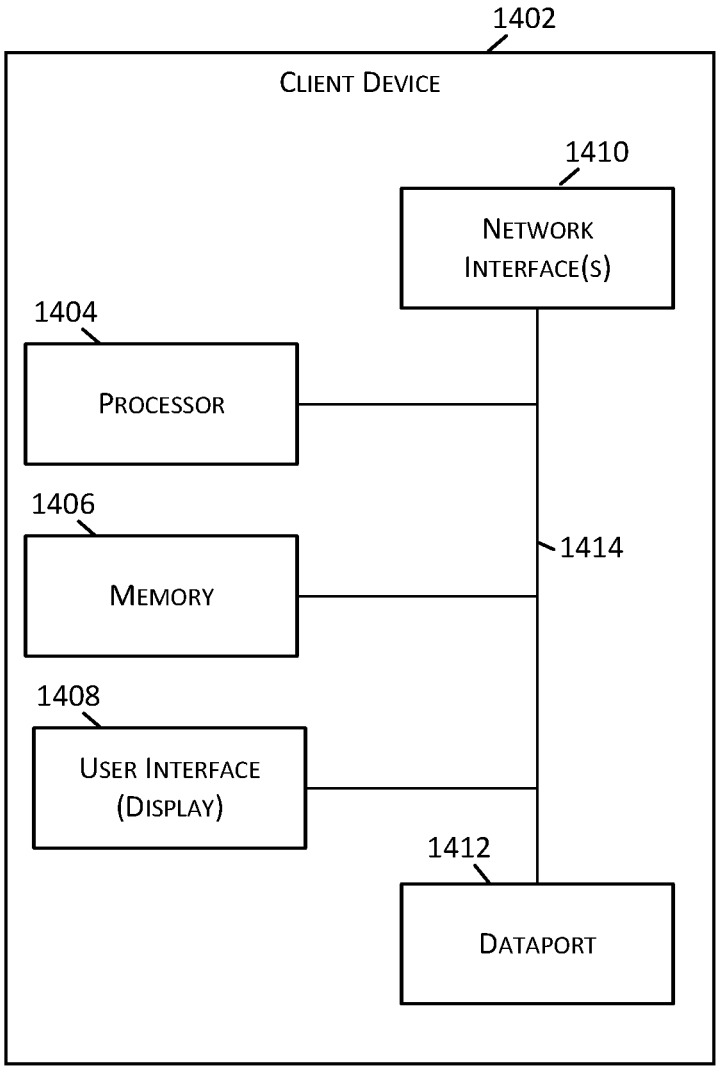
FIG. 14 is a functional block diagram of a client device on which the present embodiments may be implemented according to various aspects of the present disclosure.

FIG. 14 is a functional block diagram of a client device 1402 on which the present embodiments may be implemented according to various aspects of the present disclosure. The client device(s) 214, 216 described with reference to FIG. 2 may include some or all of the components and/or functionality of the client device 1402. The client device 1402 may comprise, for example, a smartphone.

With reference to FIG. 14, the client device 1402 includes a processor 1404, a memory 1406, a user interface 1408, network interface(s) 1410, and a dataport 1412. These components are communicatively coupled together by an interconnect bus 1414. The processor 1404 may include any processor used in smartphones and/or portable computing devices, such as an ARM processor (a processor based at least in part on the RISC (reduced instruction set computer) architecture developed by Advanced RISC Machines (ARM).). In some embodiments, the processor 1404 may include one or more other processors, such as one or more conventional microprocessors, and/or one or more supplementary co-processors, such as math co-processors.

The memory 1406 may include both operating memory, such as random-access memory (RAM), as well as data storage, such as read-only memory (ROM), hard drives, flash memory, or any other suitable memory/storage element. The memory 1406 may include removable memory elements, such as a CompactFlash card, a MultiMediaCard (MMC), and/or a Secure Digital (SD) card. In some embodiments, the memory 1406 may comprise a combination of magnetic, optical, and/or semiconductor memory, and may include, for example, RAM, ROM, flash drive, and/or a hard disk or drive. The processor 1404 and the memory 1406 each may be, for example, located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 1404 may be connected to the memory 1406 via the dataport 1412.

The user interface 1408 may include any user interface or presentation elements suitable for a smartphone and/or a portable computing device, such as a keypad, a display screen, a touchscreen, a microphone, and a speaker. The network interface(s) 1410 are configured to handle communication links between the client device 1402 and other, external devices or receivers, and to route incoming/outgoing data appropriately. For example, inbound data from the dataport 1412 may be routed through the network interface(s) 1410 before being directed to the processor 1404, and outbound data from the processor 1404 may be routed through the network interface(s) 1410 before being directed to the dataport 1412. The network interface(s) 1410 may include one or more transceiver components capable of sending and receiving data, and using, for example, one or more protocols and/or technologies, such as GSM, UMTS (3GSM), IS-95 (CDMA one), IS-1400 (CDMA 1400), LTE, FDMA, TDMA, W-CDMA, CDMA, OFDMA, Wi-Fi, WiMAX, or any other protocol and/or technology.

The dataport 1412 may be any type of connector used for physically interfacing with a smartphone and/or a portable computing device, such as a mini-USB port or an IPHONE®/IPOD® 30-pin connector or LIGHTNING® connector. In other embodiments, the dataport 1412 may include multiple communication channels for simultaneous communication with, for example, other processors, servers, and/or client terminals.

The memory 1406 may store instructions for communicating with other systems, such as a computer. The memory 1406 may store, for example, a program (e.g., computer program code) adapted to direct the processor 1404 in accordance with the present embodiments. The instructions also may include program elements, such as an operating system. While execution of sequences of instructions in the program causes the processor 1404 to perform the process steps described herein, hard-wired circuitry may be used in place of, or in combination with, software/firmware instructions for implementation of the processes of the present embodiments. Thus, the present embodiments are not limited to any specific combination of hardware and software.

Figure 15:
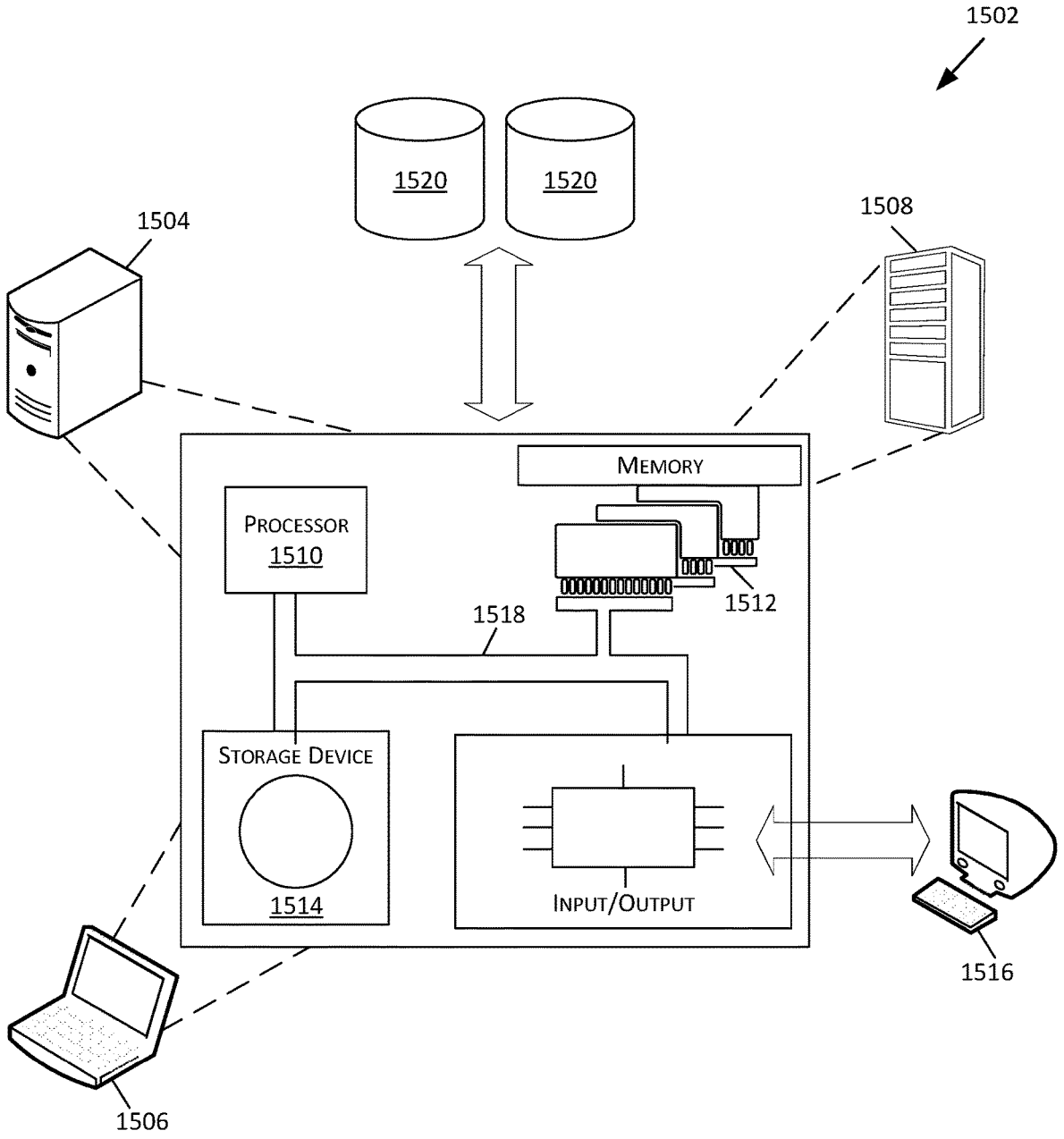
FIG. 15 is a functional block diagram of a general-purpose computing system on which the present embodiments may be implemented according to various aspects of present disclosure.

FIG. 15 is a functional block diagram of a general-purpose computing system on which the present embodiments may be implemented according to various aspects of the present disclosure. The computer system 1502 may be embodied in at least one of a personal computer (also referred to as a desktop computer) 1504, a portable computer (also referred to as a laptop or notebook computer) 1506, and/or a server 1508 is a computer program and/or a machine that waits for requests from other machines or software (clients) and responds to them. A server typically processes data. The purpose of a server is to share data and/or hardware and/or software resources among clients. This architecture is called the client-server model. The clients may run on the same computer or may connect to the server over a network. Examples of computing servers include database servers, file servers, mail servers, print servers, web servers, game servers, and application servers. The term server may be construed broadly to include any computerized process that shares a resource to one or more client processes.

The computer system 1502 may execute at least some of the operations described above. The computer system 1502 may include at least one processor 1510, memory 1512, at least one storage device 1514, and input/output (I/O) devices 1516. Some or all of the components 1510, 1512, 1514, 1516 may be interconnected via a system bus 1518. The processor 1510 may be single- or multi-threaded and may have one or more cores. The processor 1510 execute instructions, such as those stored in the memory 1512 and/or in the storage device 1514. Information may be received and output using one or more I/O devices 1516.

The memory 1512 may store information, and may be a computer-readable medium, such as volatile or non-volatile memory. The storage device(s) 1514 may provide storage for the system 1502 and, in some embodiments, may be a computer-readable medium. In various aspects, the storage device(s) 1514 may be a flash memory device, a hard disk device, an optical disk device, a tape device, or any other type of storage device.

The I/O devices 1516 may provide input/output operations for the system 1502. The I/O devices 1516 may include a keyboard, a pointing device, and/or a microphone. The I/O devices 1516 may further include a display unit for displaying graphical user interfaces, a speaker, and/or a printer. External data may be stored in one or more accessible external databases 1514.

The features of the present embodiments described herein may be implemented in digital electronic circuitry, and/or in computer hardware, firmware, software, and/or in combinations thereof. Features of the present embodiments may be implemented in a computer program product tangibly embodied in an information carrier, such as a machine-readable storage device, and/or in a propagated signal, for execution by a programmable processor. Embodiments of the present method steps may be performed by a programmable processor executing a program of instructions to perform functions of the described implementations by operating on input data and generating output.

The features of the present embodiments described herein may be implemented in one or more computer programs that are executable on a programmable system including at least one programmable processor coupled to receive data and/or instructions from, and to send data and/or instructions to, a data storage system, at least one input device, and at least one output device. A computer program may include a set of instructions that may be used, directly or indirectly, in a computer to perform a certain activity or bring about a certain result. A computer program may be written in any form of programming language, including compiled or interpreted languages, and it may be deployed in any form, including as a stand-alone program or as a component, component, subroutine, or other unit suitable for use in a computing environment.

Suitable processors for the execution of a program of instructions may include, for example, both general and special purpose processors, and/or the sole processor or one of multiple processors of any kind of computer. Generally, a processor may receive instructions and/or data from a read only memory (ROM), or a random-access memory (RAM), or both. Such a computer may include a processor for executing instructions and one or more memories for storing instructions and/or data.

Generally, a computer may also include, or be operatively coupled to communicate with, one or more mass storage devices for storing data files. Such devices include magnetic disks, such as internal hard disks and/or removable disks, magneto-optical disks, and/or optical disks. Storage devices suitable for tangibly embodying computer program instructions and/or data may include all forms of non-volatile memory, including for example semiconductor memory devices, such as EPROM, EEPROM, and flash memory devices, magnetic disks such as internal hard disks and removable disks, magneto-optical disks, and CD-ROM and DVD-ROM disks. The processor and the memory may be supplemented by, or incorporated in, one or more ASICs (application-specific integrated circuits).

To provide for interaction with a user, the features of the present embodiments may be implemented on a computer having a display device, such as an LCD (liquid crystal display) monitor, for displaying information to the user. The computer may further include a keyboard, a pointing device, such as a mouse or a trackball, and/or a touchscreen by which the user may provide input to the computer.

The features of the present embodiments may be implemented in a computer system that includes a back-end component, such as a data server, and/or that includes a middleware component, such as an application server or an Internet server, and/or that includes a front-end component, such as a client computer having a graphical user interface (GUI) and/or an Internet browser, or any combination of these. The components of the system may be connected by any form or medium of digital data communication, such as a communication network. Examples of communication networks may include, for example, a LAN (local area network), a WAN (wide area network), and/or the computers and networks forming the Internet.

The computer system may include clients and servers. A client and server may be remote from each other and interact through a network, such as those described herein. The relationship of client and server may arise by virtue of computer programs running on the respective computers and having a client-server relationship to each other.

As used herein, the phrases "at least one of A, B and C," "at least one of A, B, or C," and "A, B, and/or C" are synonymous and mean logical "OR" in the computer science sense. Thus, each of the foregoing phrases should be understood to read on (A), (B), (C), (A and B), (A and C), (B and C), and (A and B and C), where A, B, and C are variables representing elements or features of the claim. Also, while these examples are described with three variables (A, B, C) for ease of understanding, the same interpretation applies to similar phrases in these formats with any number of two or more variables.

The above description presents the best mode contemplated for carrying out the present embodiments, and of the manner and process of practicing them, in such full, clear, concise, and exact terms as to enable any person skilled in the art to which they pertain to practice these embodiments. The present embodiments are, however, susceptible to modifications and alternate constructions from those discussed above that are fully equivalent. Consequently, the present invention is not limited to the particular embodiments disclosed. On the contrary, the present invention covers all modifications and alternate constructions coming within the spirit and scope of the present disclosure. For example, the steps in the processes described herein need not be performed in the same order as they have been presented, and may be performed in any order(s). Further, steps that have been presented as being performed separately may in alternative embodiments be performed concurrently. Likewise, steps that have been presented as being performed concurrently may in alternative embodiments be performed separately.

EXAMPLE CLAUSES

In a first aspect, an electronic device comprises: one or more network interfaces; one or more processors; and one or more computer-readable media storing instructions that, when executed by the one or more processors, cause the one or more processors to perform operations comprising: receiving, using the one or more network interfaces, a first data packet from a lighting device, the first data packet including at least: first data representing an identifier of the lighting device; and second data representing a power level of an internal power source of the lighting device; determining that the power level is below a threshold power level; storing third data indicating that the power level of the internal power source of the lighting device is below the threshold power level; detecting a client device within wireless communication range of the electronic device; based at least in part on the detecting of the client device, generating a second data packet, the second data packet including at least: fourth data representing the identifier of the lighting device; and fifth data representing a command for the lighting device to emit light using a pattern that indicates that the power level is below the threshold power level; sending, using the one or more network interfaces, the second data packet to the lighting device; and sending, using the one or more network interfaces, sixth data representing a message to the client device, the message indicating that the power level of the internal power source of the lighting device is below the threshold power level.

In an embodiment of the first aspect, the one or more computer-readable media store further instructions that, when executed by the one or more processors, cause the one or more processors to perform further operations comprising: storing seventh data representing a first identifier of the client device, detecting the client device within wireless communication range of the electronic device comprises: receiving, using the one or more network interfaces, eighth data from the client device, the eighth data representing a second identifier of the client device; and determining that the first identifier represented by the seventh data corresponds to the second identifier represented by the eighth data.

In another embodiment of the first aspect, the pattern includes at least one of: flashing the light using a frequency that indicates the power level; emitting the light at an intensity that indicates the power level; or flashing the light a number of times, the number of times indicating the power level.

In a second aspect, a method comprises: receiving, by a first electronic device, first data from a second electronic device, the first data representing a power level of a power source of the second electronic device; receiving, by the first electronic device, second data using a sensor, the second data indicating that the sensor detected an object; and sending, by the first electronic device, third data to the second electronic device, the third data representing at least a command to activate a light source, of the second electronic device, using a pattern that indicates the power level of the power source of the second electronic device.

In an embodiment of the second aspect, the method further comprising, after receiving the second data, sending a message to a client device, the message indicating the power level of the power source.

In another embodiment of the second aspect, the method further comprising, after receiving the second data, sending a message to a client device, the message indicating that the second electronic device is emitting the light using the pattern in order to indicate the power level of the power source.

In another embodiment of the second aspect, the method further comprising: determining that a threshold period of time has elapsed since the sending of the third data; and sending fourth data to the second electronic device, the fourth data representing an additional command to cease activating the light source using the pattern.

In another embodiment of the second aspect, the method further comprising: receiving fourth data from the second electronic device, the fourth data representing an additional power level of the power source; and sending fifth data to the second electronic device, the fifth data representing at least an additional command to activate the light source using an additional pattern that indicates the additional power level of the power source, the additional pattern being different than the pattern.

In another embodiment of the second aspect, the method further comprising sending fourth data to a third electronic device, the fourth data representing at least an additional command to activate an additional light source, of the third electronic device, using an additional pattern that indicates the power level of the power source of the second electronic device.

In another embodiment of the second aspect, the method further comprising receiving, by the first electronic device, power from an external power source.

In another embodiment of the second aspect, the method further comprising flashing the light source at a frequency that indicates the power level of the power source, the pattern includes flashing the light source at the frequency.

In another embodiment of the second aspect, the method further comprising activating the light source at an intensity that indicates the power level of the power source, the pattern includes activating the light source at the intensity.

In another embodiment of the second aspect, the method further comprising flashing the light source a number of times, the number of times indicating the power level of the power source, the pattern includes flashing the light source the number of times.

In another embodiment of the second aspect, the method further comprising generating a data packet, the data packet including at least: third data representing a first identifier of the second electronic device; and the third data representing at least the command to activate the light source using the pattern that indicates the power level of the power source of the second electronic device, sending the third data to the second electronic device comprises sending the data packet to the second electronic device.

In a third aspect, a first electronic device comprises: one or more network interfaces; one or more processors; and one or more computer-readable media storing instructions that, when executed by the one or more processors, cause the one or more processors to perform operations comprising: receiving, using the one or more network interfaces, data indicating a power level of a power source of a second electronic device; detecting an object in proximity to the first electronic device; and sending, using the one or more network interfaces, a message to a client device, the message indicating the power level of the power source of the second electronic device.

In an embodiment of the third aspect, the one or more computer-readable media storing further instructions that, when executed by the one or more processors, cause the one or more processors to perform further operations comprising sending, using the one or more network interfaces, additional data to at least one of the second electronic device or a third electronic device, the additional data representing at least a command to activate a light source using a pattern that indicates the power level.

In another embodiment of the third aspect, the pattern includes at least one of: flashing the light source at a frequency that indicates the power level; activating the light source at an intensity that indicates the power level; or flashing the light source a number of times, the number of times indicating the power level.

In another embodiment of the third aspect, the message further indicates that the second electronic device is activating the light source according to the pattern.

In another embodiment of the third aspect, further comprising a camera, and the one or more computer-readable media store further instructions that, when executed by the one or more processors, cause the one or more processors to perform further operations comprising: generating, using the camera, image data representing an image; and determining that a portion of the image represents the second electronic device, the message indicating the power level of the power source of the second electronic device includes at least the image, a first indication that the portion of the image data represents the second electronic device, and a second indication of the power level.

In another embodiment of the third aspect, further comprising at least one connector for receiving power from an external power source.

In a fourth aspect, one or more computing devices comprise: one or more network interfaces; one or more processors; and one or more computer-readable media storing instructions that, when executed by the one or more processors, cause the one or more processors to perform operations comprising: receiving, using the one or more network interfaces, first data from a first electronic device, the first data indicating a power level of a power source of a second electronic device; receiving, using the one or more network interfaces, second data from the first electronic device, the second data indicating that the first electronic device detected an object; and sending, using the one or more network interfaces, third data to at least one of the first electronic device or the second electronic device, the third data representing a command to activate a light source according to a pattern that indicates the power level of the power source of the second electronic device.

In a fifth aspect, one or more computing devices comprise: one or more network interfaces; one or more processors; and one or more computer-readable media storing instructions that, when executed by the one or more processors, cause the one or more processors to perform operations comprising: receiving, using the one or more network interfaces, first data from a first electronic device, the first data indicating a power level of an internal power source of a second electronic device; storing the first data; receiving, using the one or more network interfaces, second data from the first electronic device, the second data indicating that the first electronic device detected an object; and sending, using the one or more network interfaces, third data to a client device, the third data representing a message that indicates the power level of the internal power source of the second electronic device.

What is claimed is:

1. A method comprising:

receiving first data representing a first power level of a power source of a first electronic device;

receiving second data from at least one of the first electronic device or a second electronic device, the second data indicating that an object was detected; and based at least in part on the receiving of the second data, sending third data that causes a light source of the first electronic device to activate according to a pattern that indicates the first power level of the power source.

2. The method as recited in claim 1, further comprising, based at least in part on the receiving of the second data, sending a message to a user device, the message indicating the first power level of the power source of the first electronic device.

3. The method as recited in claim 1, further comprising, based at least in part on the receiving of the second data, sending a message to a user device, the message indicating that the first electronic device is activating the light source using the pattern in order to indicate the first power level.

4. The method as recited in claim 1, further comprising:

determining that a threshold period of time has elapsed since the sending of the third data; and sending fourth data that causes the light source to deactivate.

5. The method as recited in claim 1, further comprising:

receiving fourth data representing a second power level of the power source of the first electronic device; and sending fifth data that causes the light source to activate using a second pattern that indicates the second power level of the power source, the second pattern being different than the first pattern.

6. The method as recited in claim 1, further comprising sending fourth data that causes a second light source, of a third electronic device, to activate using a second pattern that indicates the power level of the power source of the first electronic device.

7. The method as recited in claim 1, further comprising generating the third data, the third data representing at least one of:

a first command to flash the light source at a frequency that represents the power level of the power source;

a second command to activate the light source at an intensity that represents the power level of the power source; or a third command to flash the light source a number of times that represents the power level of the power source.

8. The method as recited in claim 1, further comprising generating a data packet, the data packet including at least:

fourth data representing an identifier of the first electronic device; and the third data, wherein the sending of the third data comprises sending the data packet to the first electronic device.

9. A system comprising:

one or more network interfaces;

one or more processors; and one or more computer-readable media storing instructions that, when executed by the one or more processors, cause the system to perform operations comprising:

receiving, using the one or more network interfaces, first data indicating a power level of a power source of a first electronic device;

determining that an object is located proximate to at least one of the first electronic device or a second electronic device; and based at least in part on the determining that the object is located proximate to the at least one of the first electronic device or the second electronic device, sending, using the one or more network interfaces, a message to a user device, the message indicating the power level of the power source of the first electronic device.

10. The system as recited in claim 9, the one or more computer-readable media storing further instructions that, when executed by the one or more processors, cause the system to perform further operations comprising sending, using the one or more network interfaces, second data that causes a light source, of the first electronic device, to activate using a pattern that indicates the power level of the power source.

11. The system as recited in claim 10, wherein the pattern includes at least one of:

flashing the light source at a frequency that indicates the power level of the power source;

activating the light source at an intensity that indicates the power level of the power source; or flashing the light source a number of times, the number of times indicating the power level of the power source.

12. The system as recited in claim 9, wherein the message further indicates that the first electronic device is activating a light source.

13. The system as recited in claim 9, wherein the determining that the object is located proximate to the at least one of the first electronic device or the second electronic device comprises receiving, using the one or more network interfaces and from the first electronic device, second data indicating that the first electronic device detected possible motion of the object.

14. The system as recited in claim 9, wherein the determining that the object is located proximate to the at least one of the first electronic device or the second electronic device comprises receiving, using the one or more network interfaces and from the second electronic device, second data indicating that the second electronic device detected possible motion of the object.

15. The system as recited in claim 9, the one or more computer-readable media storing further instructions that, when executed by the one or more processors, cause the system to perform further operations comprising:

determining that the power level is below a threshold power level; and storing second data indicating that the power level of the power source of the first electronic device is below the threshold power level.

16. The system as recited in claim 9, the one or more computer-readable media storing further instructions that, when executed by the one or more processors, cause the system to perform further operations comprising sending, using the one or more network interfaces, image data to the user device, the image data representing at least an image that indicates the first electronic device.

17. A system comprising:

one or more network interfaces;

one or more processors; and one or more computer-readable media storing instructions that, when executed by the one or more processors, cause the system to perform operations comprising:

receiving, using the one or more network interfaces, first data indicating a power level of a power source of a first electronic device;

determining that an object is located proximate to at least one of the first electronic device or a second electronic device; and based at least in part on the determining that the object is located proximate to the at least one of the first electronic device or the second electronic device, sending, using the one or more network interfaces, second data that causes a light source of the first electronic device to activate according to a pattern that indicates the power level of the power source.

18. The system as recited in claim 17, the one or more computer-readable media storing further instructions that, when executed by the one or more processors, cause the system to perform further operations comprising sending, using the one or more network interfaces, a message to a user device, the message indicating at least one of:

the power level of the power source of the first electronic device; or that the first electronic device is activating the light source using the pattern in order to indicate the power level of the power source.

19. The system as recited in claim 17, wherein the determining that the object is located proximate to the at least one of the first electronic device or the second electronic device comprises at least one of:

receiving, using the one or more network interfaces and from the first electronic device, third data indicating that the first electronic device detected possible motion of the object;

receiving, using the one or more network interfaces and from the second electronic device, fourth data indicating that the second electronic device detected possible motion of the object; or receiving, using the one or more network interfaces, fifth data from a user device, the fifth data indicating that the user device is located proximate to the at least one of the first electronic device or the second electronic device.

20. The system as recited in claim 17, wherein the second data is sent to at least one of the first electronic device or the second electronic device.

* * * * *